US011357329B2

(12) United States Patent
Deevers et al.

(10) Patent No.: US 11,357,329 B2
(45) Date of Patent: Jun. 14, 2022

(54) BODY SUPPORT ASSEMBLY AND METHODS FOR THE USE AND ASSEMBLY THEREOF

(71) Applicant: Steelcase Inc., Grand Rapids, MI (US)

(72) Inventors: Nickolaus William Charles Deevers, Holland, MI (US); Kurt R. Heidmann, Grand Rapids, MI (US); Gordon J. Peterson, Rockford, MI (US); David Bodnar, Grand Rapids, MI (US); James Ludwig, Grand Rapids, MI (US); Nate Brock, Alto, MI (US); Mark Spoelhof, Grand Rapids, MI (US)

(73) Assignee: STEELCASE INC., Grand Rapids, MI (US)

( * ) Notice: Subject to any disclaimer, the term of this patent is extended or adjusted under 35 U.S.C. 154(b) by 0 days.

(21) Appl. No.: 17/119,490

(22) Filed: Dec. 11, 2020

(65) Prior Publication Data

US 2021/0204699 A1 Jul. 8, 2021

Related U.S. Application Data

(63) Continuation-in-part of application No. 16/794,946, filed on Feb. 19, 2020, now Pat. No. 11,109,683.

(60) Provisional application No. 62/947,911, filed on Dec. 13, 2019, provisional application No. 62/947,914, filed on Dec. 13, 2019.

(51) Int. Cl.

| | |
|---|---|
| ***A47C 3/026*** | (2006.01) |
| ***A47C 7/02*** | (2006.01) |
| ***A47C 7/14*** | (2006.01) |
| ***A47C 7/28*** | (2006.01) |
| ***A47C 7/44*** | (2006.01) |
| ***A47C 1/024*** | (2006.01) |
| *A47C 7/54* | (2006.01) |

(52) U.S. Cl.
CPC ..... *A47C 7/44* (2013.01); *A47C 1/024* (2013.01); *A47C 7/541* (2018.08)

(58) Field of Classification Search
CPC ..... A47C 7/029; A47C 7/282; A47C 7/44
USPC ..... 297/296, 297, 300.1–309, 452.55
See application file for complete search history.

(56) References Cited

U.S. PATENT DOCUMENTS

| | | | |
|---|---|---|---|
| 136,531 | A | 3/1873 | Mitchell |
| 171,356 | A | 12/1875 | Cushman et al. |
| 217,169 | A | 7/1879 | Taylor |
| 248,342 | A | 10/1881 | Patchin et al. |
| 258,338 | A | 5/1882 | Wooldridge |
| 363,723 | A | 5/1887 | Brown |

(Continued)

FOREIGN PATENT DOCUMENTS

| | | | |
|---|---|---|---|
| AT | 505212 | A1 | 11/2008 |
| BE | 519252 | | 4/1953 |

(Continued)

OTHER PUBLICATIONS

US 10,932,573 B2, 03/2021, Masunaga et al. (withdrawn)

(Continued)

*Primary Examiner* — Rodney B White
(74) *Attorney, Agent, or Firm* — Crowell & Moring LLP

(57) ABSTRACT

A body support assembly includes a seat assembly and backrest assembly supported by a tilt control assembly. Methods of using and assembling the body support assembly are provided.

24 Claims, 62 Drawing Sheets

(56) References Cited

U.S. PATENT DOCUMENTS

| | | | |
|---|---|---|---|
| 409,389 | A | 8/1889 | Campbell |
| 447,854 | A | 3/1891 | Webster |
| 480,822 | A | 8/1892 | Mayes |
| 827,693 | A | 7/1906 | Korb |
| 1,597,355 | A | 8/1926 | Fussell |
| 1,789,337 | A | 1/1931 | Knabusch et al. |
| 1,886,308 | A | 11/1932 | Schultes |
| 2,028,633 | A | 1/1936 | Thomas |
| 2,083,838 | A | 6/1937 | Goenen |
| 2,087,254 | A | 7/1937 | Herold |
| 2,271,925 | A | 2/1942 | Niles |
| 2,321,385 | A | 6/1943 | Herold |
| 2,343,739 | A | 3/1944 | Bernstein |
| 2,347,859 | A | 5/1944 | Williams |
| 2,355,635 | A | 8/1944 | Dubilier |
| 2,414,978 | A | 1/1947 | Richardson |
| 2,487,502 | A | 11/1949 | Willinsky |
| 2,540,823 | A | 2/1951 | Heller |
| 2,560,925 | A | 7/1951 | Brown |
| 2,579,502 | A | 12/1951 | Lorenz |
| 2,613,731 | A | 10/1952 | Roginski |
| 2,615,496 | A | 10/1952 | Lorenz et al. |
| 2,616,484 | A | 11/1952 | Christie |
| 2,746,520 | A | 5/1956 | Ducrot |
| 2,818,911 | A | 1/1958 | Syak |
| 2,830,650 | A | 4/1958 | Lorenz |
| D183,440 | S | 8/1958 | Williams |
| D192,165 | S | 2/1962 | Brandon |
| 3,041,109 | A | 6/1962 | Eames et al. |
| 3,059,971 | A | 10/1962 | Becker |
| 3,117,819 | A | 1/1964 | Kudriavetz |
| 3,121,590 | A | 2/1964 | Schliephacke |
| 3,120,407 | A | 2/1965 | Propst |
| D200,640 | S | 3/1965 | Yamasaki |
| 3,271,072 | A | 9/1966 | Barker |
| 3,284,131 | A | 11/1966 | Fletcher |
| 3,298,742 | A | 1/1967 | Cadiou |
| D207,955 | S | 6/1967 | Rodrigo |
| 3,330,251 | A | 7/1967 | Helms |
| 3,337,267 | A | 8/1967 | Rogers, Jr. |
| 3,370,885 | A | 2/1968 | Gale |
| 3,423,775 | A | 1/1969 | Cockerill |
| 3,463,547 | A | 8/1969 | Brennan et al. |
| 3,560,048 | A | 2/1971 | Flint |
| 3,565,482 | A | 2/1971 | Blodee |
| 3,576,704 | A | 4/1971 | Groce et al. |
| 3,583,759 | A | 6/1971 | Kramer |
| 3,588,370 | A | 6/1971 | Barecki et al. |
| 3,601,446 | A | 8/1971 | Horby |
| 3,602,537 | A | 8/1971 | Kerstholt et al. |
| 3,606,464 | A | 9/1971 | Arbuthnot |
| 3,643,308 | A | 2/1972 | Yamamoto |
| 3,711,156 | A | 1/1973 | Bloomfield |
| 3,712,666 | A | 1/1973 | Stoll |
| 3,740,792 | A | 6/1973 | Werner |
| 3,741,607 | A | 6/1973 | Cramer |
| D227,829 | S | 7/1973 | Klose |
| D228,717 | S | 10/1973 | Kramer |
| 3,815,954 | A | 6/1974 | Rogers et al. |
| 3,827,750 | A | 8/1974 | Fantoni |
| 3,844,612 | A | 10/1974 | Borggren et al. |
| 3,862,454 | A | 1/1975 | Mazzucconi |
| 3,874,727 | A | 4/1975 | Mehbert et al. |
| 3,877,750 | A | 4/1975 | Scholpp |
| 3,880,465 | A | 4/1975 | Scheben |
| 3,930,565 | A | 1/1976 | Scheben et al. |
| 3,948,702 | A | 4/1976 | Theissen |
| 4,009,856 | A | 3/1977 | Wolters et al. |
| 4,036,527 | A | 7/1977 | Faul |
| 4,072,288 | A | 2/1978 | Wirges et al. |
| 4,143,910 | A | 3/1979 | Geffers et al. |
| 4,157,203 | A | 6/1979 | Ambasz |
| 4,161,337 | A | 7/1979 | Ross et al. |
| 4,200,332 | A | 4/1980 | Brauning |
| D255,183 | S | 6/1980 | Locher |
| D255,184 | S | 6/1980 | Locher |
| 4,226,473 | A | 10/1980 | Johnson |
| 4,331,360 | A | 5/1982 | Roundybuch et al. |
| 4,370,002 | A | 1/1983 | Koepke |
| 4,373,692 | A | 2/1983 | Knoblauch et al. |
| 4,380,352 | A | 4/1983 | Diffrient |
| 4,388,801 | A | 6/1983 | d'Alquen |
| 4,411,469 | A | 10/1983 | Drabert et al. |
| 4,429,917 | A | 2/1984 | Diffrient |
| 4,432,582 | A | 2/1984 | Wiesmann et al. |
| 4,451,085 | A | 5/1984 | Franck et al. |
| 4,471,994 | A | 9/1984 | Zuend et al. |
| 4,478,454 | A | 10/1984 | Faiks |
| 4,479,679 | A | 10/1984 | Fries et al. |
| D276,575 | S | 12/1984 | Helmholdt |
| D276,576 | S | 12/1984 | Helmholdt |
| 4,502,729 | A | 3/1985 | L:ocher |
| 4,536,029 | A | 8/1985 | Rogers, Jr. |
| 4,537,445 | A | 8/1985 | Neuhoff |
| 4,545,614 | A | 10/1985 | Abu-Isa et al. |
| 4,552,405 | A | 11/1985 | Ohl |
| 4,555,136 | A | 11/1985 | Dranger |
| 4,555,139 | A | 11/1985 | Leib |
| 4,575,150 | A | 3/1986 | Smith |
| 4,577,907 | A | 3/1986 | Talmon et al. |
| 4,585,272 | A | 4/1986 | Ballarini |
| 4,597,566 | A | 7/1986 | Scrivner |
| 4,609,225 | A | 9/1986 | Loucks |
| 4,640,548 | A | 2/1987 | Desanta |
| D289,120 | S | 4/1987 | Chadwick et al. |
| 4,665,606 | A | 5/1987 | Saito et al. |
| 4,707,026 | A | 11/1987 | Johansson |
| 4,709,962 | A | 12/1987 | Steinmann |
| 4,709,963 | A | 12/1987 | Uecker et al. |
| 4,711,491 | A | 12/1987 | Ginat |
| 4,712,834 | A | 12/1987 | Warrick |
| 4,752,101 | A | 6/1988 | Yurchenco et al. |
| 4,761,033 | A | 8/1988 | Lanuzzi et al. |
| 4,779,925 | A | 10/1988 | Heinzel |
| 4,819,458 | A | 4/1989 | Kavesh et al. |
| 4,826,249 | A | 5/1989 | Bradbury |
| 4,834,453 | A | 5/1989 | Makiol |
| 4,854,641 | A | 8/1989 | Reineman et al. |
| 4,865,284 | A | 9/1989 | Desanta |
| 4,869,554 | A | 9/1989 | Abu-Isa et al. |
| 4,889,384 | A | 12/1989 | Sutzer |
| 4,889,385 | A | 12/1989 | Chadwick et al. |
| 4,892,356 | A | 1/1990 | Pittman et al. |
| 4,911,501 | A | 3/1990 | Decker et al. |
| D307,221 | S | 4/1990 | Mudge |
| 4,962,962 | A | 10/1990 | Maschate et al. |
| 4,962,964 | A | 10/1990 | Snodgrass |
| 4,966,411 | A | 10/1990 | Katagiri et al. |
| 4,979,778 | A | 12/1990 | Shields |
| 4,988,145 | A | 1/1991 | Engel |
| 5,013,089 | A | 5/1991 | Abu-Isa et al. |
| 5,029,940 | A | 7/1991 | Golynsky et al. |
| 5,029,942 | A | 7/1991 | Rink |
| 5,046,780 | A | 9/1991 | Decker et al. |
| 5,052,753 | A | 10/1991 | Buchacz |
| 5,071,189 | A | 12/1991 | Kratz |
| 5,080,318 | A | 1/1992 | Takamatsu et al. |
| 5,102,196 | A | 4/1992 | Kaneda et al. |
| 5,195,801 | A | 3/1993 | Franck et al. |
| 5,215,807 | A | 6/1993 | Day et al. |
| 5,224,758 | A | 7/1993 | Takamatsu |
| RE34,354 | E | 8/1993 | Sondergeld |
| 5,235,826 | A | 8/1993 | Brooks et al. |
| 5,249,839 | A | 10/1993 | Faiks et al. |
| 5,251,958 | A | 10/1993 | Roericht et al. |
| 5,267,777 | A | 12/1993 | Valtri |
| 5,269,777 | A | 12/1993 | Doiron et al. |
| 5,282,285 | A | 2/1994 | de Gelis et al. |
| 5,288,127 | A | 2/1994 | Berg et al. |
| D345,867 | S | 4/1994 | Narita |
| 5,308,144 | A | 5/1994 | Korn |
| 5,333,368 | A | 8/1994 | Kriener et al. |
| 5,345,120 | A | 9/1994 | Völkle |
| 5,348,372 | A | 9/1994 | Takamatsu et al. |

(56) References Cited

U.S. PATENT DOCUMENTS

D351,744 S 10/1994 Caruso et al.
5,356,199 A 10/1994 Elzenbeck et al.
5,366,274 A 11/1994 Roericht et al.
5,386,728 A 2/1995 Norton et al.
5,397,165 A 3/1995 Grin et al.
5,405,179 A 4/1995 Jih
D358,514 S 5/1995 Lovegrove
5,417,473 A 5/1995 Bräuning
D360,316 S 7/1995 Hodge et al.
5,430,410 A 7/1995 Raynaud
5,447,357 A 9/1995 Dauphin
5,457,968 A 10/1995 McClintock et al.
5,462,336 A 10/1995 Desanta
5,486,035 A 1/1996 Koepke et al.
5,518,294 A 5/1996 Ligon, Sr. et al.
5,558,171 A 9/1996 McGlothlin et al.
5,558,398 A 9/1996 Santos
D376,982 S 12/1996 Otto
5,582,463 A 12/1996 Lindner et al.
D378,480 S 3/1997 Doerner
5,649,739 A 7/1997 Zapf
5,683,139 A 11/1997 Golynsky et al.
5,704,689 A 1/1998 Kim
RE32,594 E 2/1998 Theissen
5,765,804 A 6/1998 Stumpf et al.
5,769,492 A 6/1998 Jensen
5,774,911 A 7/1998 Stube
5,775,774 A 7/1998 Okano
5,795,026 A 8/1998 Dral et al.
5,810,439 A 9/1998 Roslund, Jr.
5,842,264 A 12/1998 Roossien et al.
5,853,223 A 12/1998 Ritt et al.
5,855,991 A 1/1999 McLarty, III
5,868,467 A 2/1999 Moll
5,871,258 A 2/1999 Battey et al.
5,873,634 A 2/1999 Geidmann et al.
D408,161 S 4/1999 Caruso
5,901,109 A 5/1999 Miura
5,934,758 A 8/1999 Ritch et al.
5,944,382 A 8/1999 Ambasz
5,951,109 A 9/1999 Roslund, Jr. et al.
5,964,503 A 10/1999 Inoue
5,975,634 A 11/1999 Knoblock et al.
5,979,985 A 11/1999 Bauer et al.
6,000,755 A 12/1999 Uhlenbrock
6,000,756 A 12/1999 Hybarger et al.
6,003,943 A 12/1999 Schneider
6,015,187 A 1/2000 Roslund, Jr. et al.
6,021,712 A 2/2000 Harrop
6,050,646 A 4/2000 Stenzel et al.
6,056,361 A 5/2000 Cvek
6,059,363 A 5/2000 Roslund, Jr. et al.
6,079,785 A 6/2000 Peterson et al.
6,086,153 A 7/2000 Heidmann et al.
6,099,076 A 8/2000 Nagel et al.
6,109,694 A 8/2000 Kurtz
6,116,688 A 9/2000 Wilkerson et al.
6,120,097 A 9/2000 Perry et al.
6,176,548 B1 1/2001 Thole et al.
D437,497 S 2/2001 Brauning
6,209,958 B1 4/2001 Thole
6,213,552 B1 4/2001 Miotto
6,224,155 B1 5/2001 DeKraker et al.
6,224,160 B1 5/2001 Takeuchi et al.
6,231,125 B1 5/2001 Maeda
6,234,573 B1 5/2001 Roder et al.
6,238,000 B1 5/2001 Hallmark et al.
D445,580 S 7/2001 Pennington et al.
6,254,190 B1 7/2001 Gregory
6,257,665 B1 7/2001 Nagamitsu et al.
D446,954 S 8/2001 Sottsass
6,279,998 B1 8/2001 Chu et al.
6,279,999 B1 8/2001 Lee et al.
6,286,900 B1 9/2001 Roark
D449,172 S 10/2001 Van De Riet et al.
D449,938 S 11/2001 Vanderiet et al.
6,341,822 B2 1/2002 Apissomian
6,361,110 B2 3/2002 Roslund, Jr. et al.
6,361,117 B1 3/2002 Tate
D455,571 S 4/2002 Van De Riet et al.
D456,160 S 4/2002 Van De Riet et al.
D456,164 S 4/2002 Vanderiet et al.
6,367,876 B2 4/2002 Caruso
6,378,944 B1 4/2002 Weisser
D456,627 S 5/2002 Pearce et al.
D457,739 S 5/2002 Pearce et al.
6,386,634 B1 5/2002 Stumpf et al.
6,394,546 B1 5/2002 Knoblock et al.
6,398,309 B1 6/2002 Chen
D460,870 S 7/2002 Van De Riet et al.
D461,660 S 8/2002 Koepke et al.
D461,661 S 8/2002 Koepke et al.
6,439,661 B1 8/2002 Bräuning
D462,536 S 9/2002 Levy
D463,174 S 9/2002 Chu
6,447,063 B1 9/2002 Beggs
6,450,577 B1 9/2002 Roslund, Jr.
6,481,801 B1 11/2002 Schmale
6,511,128 B2 1/2003 Piretti
6,523,897 B2 2/2003 Pan
6,523,898 B1 2/2003 Ball et al.
6,536,841 B1 3/2003 Pearce et al.
D474,346 S 5/2003 Saylor et al.
D474,926 S 5/2003 Koepke et al.
6,557,939 B1 5/2003 Bräuning
6,572,190 B2 6/2003 Koepke et al.
D476,821 S 7/2003 Kiepke et al.
6,588,842 B2 7/2003 Stumpf
6,588,844 B1 7/2003 Stenzel
6,598,251 B2 7/2003 Habboub et al.
6,598,937 B2 7/2003 Caruso et al.
6,609,755 B2 8/2003 Koepke et al.
6,616,228 B2 9/2003 Heidmann
6,626,497 B2 9/2003 Nagamitsu et al.
6,632,756 B1 10/2003 Waldrop et al.
6,644,741 B2 11/2003 Nelson et al.
6,669,294 B2 12/2003 Kinoshita et al.
6,669,301 B1 12/2003 Funk et al.
6,679,553 B2 1/2004 Battey et al.
6,688,690 B2 2/2004 Watson et al.
6,688,698 B1 2/2004 Chou et al.
6,692,075 B2 2/2004 Sander et al.
6,692,077 B1 2/2004 Beggs et al.
6,695,404 B2 2/2004 Bruske
6,695,410 B2 2/2004 Hsia
D487,197 S 3/2004 Edwards et al.
6,698,839 B2 3/2004 Ballendat
6,701,550 B2 3/2004 Baeriswyl
6,709,057 B2 3/2004 Sander et al.
6,709,058 B1 3/2004 Diffrient
6,710,244 B1 3/2004 Pferschy
6,722,735 B2 4/2004 Lucci et al.
6,722,741 B2 4/2004 Stumpf et al.
6,729,688 B2 5/2004 Erne
6,729,691 B2 5/2004 Koepke et al.
6,733,084 B2 5/2004 Butler
6,739,663 B2 5/2004 Gevaert
6,749,261 B2 6/2004 Knoblock et al.
6,752,459 B2 6/2004 Deisig
6,755,467 B1 6/2004 Chu
6,755,473 B2 6/2004 Reed et al.
6,761,406 B2 7/2004 Kinoshita et al.
6,771,312 B2 8/2004 Kamishima et al.
6,779,846 B2 8/2004 Spendlove et al.
6,779,847 B2 8/2004 Klein
6,783,184 B2 8/2004 DiBattista et al.
6,786,544 B1 9/2004 Muraishi
6,786,548 B2 9/2004 Pearce et al.
6,802,566 B2 10/2004 Prince et al.
6,811,215 B2 11/2004 Horiki et al.
6,811,218 B2 11/2004 Deimen et al.
6,814,412 B2 11/2004 Cramb, III et al.
6,817,667 B2 11/2004 Pennington et al.
6,820,388 B2 11/2004 Newhouse et al.

(56) References Cited

U.S. PATENT DOCUMENTS 6,820,933 B2 11/2004 Fereira Da Silva
6,820,934 B2 11/2004 Ware et al.
6,820,935 B1 11/2004 Cioncada
D499,564 S 12/2004 Meda
D500,211 S 12/2004 Kosh et al.
6,837,546 B2 1/2005 VanDeReit et al.
D501,333 S 2/2005 Piretti
6,863,346 B2 3/2005 Zund
6,869,142 B2 3/2005 Heidmann et al.
6,871,909 B2 3/2005 Hobb et al.
6,874,852 B2 4/2005 Footitt
6,877,816 B1 4/2005 Farmont
6,880,886 B2 4/2005 Bodnar et al.
6,890,030 B2 5/2005 Wilkerson et al.
6,896,327 B1 5/2005 Barile, Sr.
6,896,328 B2 5/2005 Goodworth
6,896,329 B2 5/2005 Sander et al.
6,899,398 B2 5/2005 Coffield
6,908,159 B2 6/2005 Prince et al.
6,910,736 B2 6/2005 White
6,910,741 B2 6/2005 Footitt
6,929,327 B2 8/2005 Piretti
6,932,430 B2 8/2005 Bedford et al.
6,932,431 B2 8/2005 Koch et al.
6,935,689 B2 * 8/2005 Horiki ..... A47C 1/03266
297/300.5
6,935,690 B2 8/2005 Lucci et al.
D509,388 S 9/2005 Koepke et al.
6,924,300 B2 9/2005 Numa et al.
6,942,300 B2 9/2005 Numa et al.
6,945,601 B1 9/2005 Wu
6,945,602 B2 9/2005 Fookes et al.
6,945,605 B2 9/2005 Kinoshita et al.
D510,668 S 10/2005 Eldøy
6,951,085 B2 10/2005 Hodges et al.
6,957,862 B2 10/2005 Chen
6,959,965 B2 11/2005 Diffrient
6,966,604 B2 11/2005 Stumpf et al.
6,974,189 B2 12/2005 Machael et al.
6,983,997 B2 1/2006 Wilkerson et al.
6,986,549 B2 1/2006 Kniese
7,004,543 B2 2/2006 Caruso et al.
D516,831 S 3/2006 Eldøy
7,021,718 B2 4/2006 Coffield et al.
7,029,071 B2 4/2006 Watson et al.
7,032,971 B2 4/2006 Williams
7,036,881 B1 5/2006 Beggs
7,048,335 B2 5/2006 Norman et al.
7,055,911 B2 6/2006 Simpson et al.
7,066,537 B2 6/2006 Coffield et al.
7,066,538 B2 6/2006 Machael et al.
7,066,550 B1 6/2006 Su
D525,445 S 7/2006 Liu et al.
D525,446 S 7/2006 Farber
7,070,242 B2 7/2006 Mears et al.
7,096,549 B2 8/2006 Coffield
7,097,247 B2 8/2006 Battey et al.
7,097,249 B2 8/2006 Igarashi et al.
7,108,322 B2 9/2006 Erker
7,118,177 B2 10/2006 Piretti
7,147,285 B2 12/2006 Lin
7,152,929 B2 12/2006 Wu
7,159,943 B2 1/2007 Costaglia
7,165,811 B2 1/2007 Bodnar et al.
7,185,910 B2 3/2007 Beauchesne et al.
7,204,557 B1 4/2007 Burton
7,207,630 B1 4/2007 Reynolds
D542,574 S 5/2007 Johnson
D543,399 S 5/2007 Johnson
7,213,880 B2 5/2007 Schmitz et al.
7,213,886 B2 5/2007 Schmitz et al.
7,226,130 B2 6/2007 Tubergen et al.
7,234,772 B2 6/2007 Wells
7,234,774 B2 6/2007 Heidmann et al.
7,234,775 B2 6/2007 Serber
7,237,841 B2 7/2007 Norman et al.
7,243,993 B2 7/2007 Igarashi et al.
7,243,997 B1 7/2007 Tomero
7,246,859 B2 7/2007 Igarashi et al.
7,249,802 B2 7/2007 Schmitz et al.
7,250,091 B2 7/2007 Gupta et al.
7,251,917 B2 8/2007 Cvek
7,262,371 B2 8/2007 Makwinski et al.
7,264,311 B2 9/2007 Heidmann
7,270,378 B2 9/2007 Wilkerson et al.
7,273,252 B2 9/2007 Iijima et al.
D551,868 S 10/2007 Chu
D552,368 S 10/2007 Scheper et al.
D553,380 S 10/2007 Natuzzi
7,275,788 B2 10/2007 Dettmann et al.
7,275,793 B2 10/2007 Fujita et al.
7,278,688 B1 10/2007 Hung
7,281,764 B2 10/2007 Thole
7,287,815 B2 10/2007 Leguen et al.
7,293,833 B2 11/2007 Takeuchi et al.
D557,025 S 12/2007 Chen
D559,002 S 1/2008 Williams et al.
7,320,503 B2 1/2008 Eysing
D560,918 S 2/2008 Fuksas
7,334,845 B2 2/2008 Peterson et al.
D564,264 S 3/2008 Smith et al.
7,344,194 B2 3/2008 Maier et al.
7,347,495 B2 3/2008 Beyer et al.
7,360,835 B2 4/2008 Tubergen et al.
7,364,233 B2 4/2008 Donati
D571,568 S 6/2008 Overthun et al.
7,393,057 B2 7/2008 Fraser
7,396,077 B2 7/2008 Boulva
7,396,081 B2 7/2008 Matern et al.
7,406,733 B2 8/2008 Coffiled et al.
7,408,114 B2 8/2008 VanderVelde et al.
7,416,256 B2 8/2008 Fujita et al.
7,419,215 B2 9/2008 Wilkerson et al.
7,419,222 B2 9/2008 Schmitz et al.
7,425,037 B2 9/2008 Schmitz et al.
7,425,039 B2 9/2008 Lin
7,429,081 B2 9/2008 Roslund et al.
7,434,879 B2 10/2008 Ueda et al.
7,434,880 B2 10/2008 Ronnestad
7,434,888 B2 10/2008 Lin
7,441,758 B2 10/2008 Coffield et al.
7,441,839 B2 10/2008 Pennington et al.
D579,695 S 11/2008 Wu
7,490,395 B2 2/2009 Coffield et al.
7,513,570 B2 4/2009 Roslund et al.
7,517,024 B2 4/2009 Cvek
D596,871 S 7/2009 Farber
7,566,099 B2 7/2009 Catanzarite et al.
7,568,763 B2 8/2009 Bedford et al.
7,568,765 B2 8/2009 Bräuning
7,568,768 B1 8/2009 Tsai
D600,052 S 9/2009 Smith et al.
7,589,286 B2 9/2009 VanderVelde et al.
7,594,700 B2 9/2009 Stumpf et al.
7,600,820 B2 10/2009 Bouche et al.
7,604,298 B2 10/2009 Peterson et al.
D604,527 S 11/2009 Ooki et al.
D604,535 S 11/2009 Parker et al.
7,625,045 B2 12/2009 Hatcher et al.
7,647,714 B2 1/2010 Coffield et al.
7,648,201 B2 1/2010 Eysing
D609,482 S 2/2010 Englisch et al.
7,654,616 B2 2/2010 Kinoshita et al.
7,654,617 B2 2/2010 Farnsworth
7,665,805 B2 2/2010 Ueda
D610,824 S 3/2010 Piretti
7,673,942 B2 3/2010 Tuckey et al.
7,681,952 B2 3/2010 Piretti
7,695,067 B2 4/2010 Goetz et al.
D616,213 S 5/2010 Parker et al.
7,708,349 B2 5/2010 Chen
7,712,833 B2 5/2010 Ueda
7,712,834 B2 5/2010 Knoblock et al.
7,716,797 B2 5/2010 Kismarton et al.

(56) References Cited

U.S. PATENT DOCUMENTS 7,717,513 B2 5/2010 Ueda
7,727,519 B2 5/2010 Kismarton et al.
7,731,295 B2 6/2010 Lin
7,735,923 B2 6/2010 Roslund et al.
7,753,447 B2 7/2010 Sulzer
7,770,973 B2 8/2010 Gehner et al.
7,784,870 B2 8/2010 Machaet et al.
7,794,017 B2 9/2010 Kan et al.
7,794,022 B2 9/2010 Caruso et al.
7,798,573 B2 9/2010 Pennington et al.
7,806,478 B1 10/2010 Cvek
7,806,481 B2 10/2010 Ebertein
7,815,257 B2 10/2010 Costaglia et al.
7,823,973 B2 11/2010 Dragusin
7,837,265 B2 11/2010 Machael et al.
7,837,272 B2 11/2010 Masunaga et al.
7,841,664 B2 11/2010 Holdrege et al.
7,841,665 B2 11/2010 Geister et al.
7,841,666 B2 11/2010 Schmitz et al.
7,851,390 B2 12/2010 Salzmann et al.
7,857,389 B2 12/2010 Ueda
7,857,390 B2 12/2010 Schmitz et al.
7,862,120 B2 1/2011 Ueda
7,866,750 B2 1/2011 Bock
7,878,598 B2 2/2011 Oda
7,887,131 B2 2/2011 Chadwick et al.
7,887,135 B2 2/2011 Oda
7,887,138 B2 2/2011 Chen
7,896,439 B2 3/2011 Kan et al.
7,922,248 B2 4/2011 Aldrich et al.
7,926,879 B2 4/2011 Schmitz et al.
7,926,880 B2 4/2011 Heidmann et al.
7,931,257 B2 4/2011 VanDeRiet et al.
D637,423 S 5/2011 Behar et al.
D637,838 S 5/2011 Piretti
7,946,651 B2 5/2011 Donati
D639,091 S 6/2011 Behar et al.
7,971,935 B2 7/2011 Saez et al.
7,992,936 B2 8/2011 Schmitz et al.
7,992,937 B2 8/2011 Plikat et al.
7,997,652 B2 8/2011 Roslund et al.
8,002,351 B2 8/2011 Golynsky
8,025,334 B2 9/2011 Schmitz et al.
8,025,335 B2 9/2011 Gehner
D646,074 S 10/2011 Cantarutti
8,029,060 B2 10/2011 Parker et al.
8,029,066 B2 10/2011 Su
D647,738 S 11/2011 Chen
8,061,775 B2 11/2011 Diffrient
D652,657 S 1/2012 Behar et al.
D653,061 S 1/2012 Behar et al.
8,087,727 B2 * 1/2012 Parker ..... A47C 7/14 297/300.2
8,096,615 B2 1/2012 Parker et al.
8,104,838 B2 1/2012 Tsai
D654,291 S 2/2012 Pearson et al.
8,109,576 B2 2/2012 Lin
8,113,582 B2 2/2012 Liu
8,128,175 B2 3/2012 Groelsma et al.
D657,166 S 4/2012 Behar et al.
8,162,397 B2 4/2012 Booth et al.
D660,056 S 5/2012 Diffrient
8,167,375 B2 5/2012 Catanzarite et al.
8,172,332 B2 5/2012 Masunaga et al.
8,100,476 B2 6/2012 Jenkins
8,210,611 B2 7/2012 Aldrich et al.
8,215,710 B2 7/2012 Erker
8,226,167 B2 7/2012 Bruck et al.
8,235,468 B2 8/2012 Fookes et al.
8,246,113 B2 8/2012 Bock
8,246,117 B2 8/2012 Melhuish et al.
8,251,454 B2 8/2012 Tsukiji et al.
8,262,162 B2 9/2012 Castro, Jr. et al.
8,272,693 B2 9/2012 Hall et al.
D669,279 S 10/2012 Eldøy
8,282,169 B2 10/2012 Schmitz et al.
8,282,172 B2 10/2012 Schmitz et al.
8,297,701 B2 10/2012 Machael et al.
8,297,708 B2 10/2012 Mizobata et al.
8,313,140 B2 11/2012 Niitsuma et al.
D673,385 S 1/2013 Lu
D678,690 S 3/2013 Eldøy
8,388,064 B2 3/2013 Bertolini et al.
D680,345 S 4/2013 Xingchang
8,408,647 B2 4/2013 Wu
8,414,073 B2 4/2013 Schmitz et al.
8,414,075 B2 4/2013 Ko
8,419,133 B2 4/2013 Hoyt et al.
8,419,135 B2 4/2013 Moeseneder et al.
D683,150 S 5/2013 Smith et al.
8,449,037 B2 5/2013 Behar et al.
8,459,746 B2 6/2013 Lai
8,469,454 B2 6/2013 Holt et al.
8,480,171 B2 7/2013 Chadwick et al.
8,544,957 B2 10/2013 Lin
8,544,958 B2 10/2013 Holtzinger et al.
8,550,564 B1 10/2013 Kismarton et al.
8,562,073 B2 10/2013 Niitsuma et al.
8,567,864 B2 10/2013 Deisig et al.
8,579,376 B2 11/2013 Chen
8,602,494 B2 12/2013 Cvek
8,602,501 B2 12/2013 Walker et al.
8,613,481 B2 12/2013 Parker et al.
8,616,640 B2 12/2013 Van Hekken
8,616,655 B2 12/2013 Jung
8,622,474 B2 1/2014 Jenkins
8,646,839 B2 2/2014 Moreschi
8,668,265 B2 3/2014 Parker et al.
8,668,267 B2 3/2014 Piretti
8,671,482 B2 3/2014 Willingham
D703,458 S 4/2014 Nakamura et al.
D703,459 S 4/2014 Nakamura et al.
8,690,249 B2 4/2014 Kang et al.
8,691,370 B2 4/2014 Brill et al.
8,695,306 B2 4/2014 Cvek
D704,488 S 5/2014 Massaud
D704,945 S 5/2014 Massaud
D705,561 S 5/2014 Massaud
8,714,645 B2 5/2014 Cvek
D706,547 S 6/2014 Smtih et al.
8,752,896 B2 6/2014 Takeuchi et al.
D708,466 S 7/2014 Massaud
8,764,110 B2 7/2014 Hsuan-Chin
8,777,312 B2 7/2014 Diffrient
8,777,318 B2 7/2014 Chen
8,794,701 B2 8/2014 Nakayama et al.
8,820,835 B2 9/2014 Minino et al.
D714,563 S 10/2014 Amdal et al.
8,857,033 B2 10/2014 Coffield et al.
8,857,909 B2 10/2014 Bock
D717,555 S 11/2014 Massaud
8,876,209 B2 11/2014 Peterson et al.
8,888,183 B2 11/2014 Parker et al.
8,899,680 B2 12/2014 Meier et al.
8,926,016 B2 1/2015 Behar et al.
8,939,507 B2 1/2015 Thomaschewski et al.
8,944,507 B2 2/2015 Goetz
8,960,699 B2 2/2015 Springle et al.
8,960,796 B2 2/2015 Aldrich et al.
D724,367 S 3/2015 Sander
8,967,724 B2 3/2015 Battey et al.
8,967,726 B2 3/2015 Schmitz et al.
8,973,995 B2 3/2015 Donati
D727,076 S 4/2015 Usumoto
8,998,322 B2 4/2015 Horiki et al.
8,998,337 B2 4/2015 Miyamoto
8,998,338 B2 * 4/2015 Vander Veen ..... A47C 1/0307 297/452.56 X
8,998,339 B2 4/2015 Peterson et al.
9,004,597 B2 4/2015 Battey et al.
9,010,839 B2 4/2015 Schijve et al.
D728,292 S 5/2015 Ooki
9,022,482 B2 5/2015 Morio et al.
9,027,997 B2 5/2015 Battey et al.

(56) References Cited

U.S. PATENT DOCUMENTS 9,028,001 B2 5/2015 Battey et al.
9,033,421 B2 5/2015 Wlkinson et al.
9,039,093 B2 5/2015 Nishiura et al.
9,045,064 B2 6/2015 Weigert
9,049,936 B2 6/2015 Leone et al.
9,061,621 B2 6/2015 Hisamoto
9,095,217 B2 8/2015 Oda
9,132,760 B2 9/2015 Matsumoto et al.
9,155,393 B2 10/2015 Hunford et al.
9,161,627 B2 10/2015 Donati
9,168,855 B2 10/2015 Evans et al.
D742,674 S 11/2015 Wilkinson et al.
9,211,826 B2 12/2015 Matsumoto et al.
9,278,634 B2 3/2016 Mathews et al.
9,289,067 B2 3/2016 Meyer et al.
9,301,615 B2 4/2016 Behar et al.
9,326,613 B2 5/2016 Cvek
9,332,851 B2 5/2016 Macheal et al.
9,392,872 B2 7/2016 Saint Pierre et al.
D763,612 S 8/2016 Goetz
9,409,467 B2 8/2016 Peterson et al.
9,414,673 B2 8/2016 Behar et al.
9,427,086 B2 8/2016 Willingham
D767,318 S 9/2016 Kubryk
9,462,891 B2 10/2016 Kikuchi et al.
9,480,339 B2 11/2016 Cvek
9,486,081 B2 11/2016 Sander et al.
9,498,066 B2 11/2016 Christianson et al.
9,504,325 B2 11/2016 Sander et al.
D773,872 S 12/2016 Kim
9,510,684 B2 12/2016 Schmitz et al.
9,521,907 B2 12/2016 Romero
9,560,917 B2 2/2017 Roslund et al.
9,578,968 B2 2/2017 Masunaga et al.
9,622,579 B2 4/2017 Wilkinson et al.
D785,353 S 5/2017 Zhou
D786,326 S 5/2017 Jeong
9,648,957 B2 5/2017 Su
9,661,930 B2 5/2017 Norman et al.
D789,129 S 6/2017 Fromme-Ruthmann
9,668,580 B2 6/2017 Schmitz et al.
9,693,632 B2 7/2017 Duke
9,700,142 B2 7/2017 Wagner
9,713,380 B2 7/2017 Gehner et al.
9,826,836 B2 11/2017 Sander et al.
9,826,839 B2 11/2017 Battery et al.
9,833,074 B2 12/2017 Bohmann et al.
9,833,075 B2 * 12/2017 Unwalla ..... A47C 1/03255
9,883,746 B2 2/2018 Piretti
9,913,539 B2 3/2018 Potrykus et al.
9,918,552 B2 3/2018 Battey et al.
10,016,080 B2 7/2018 Schmitz et al.
10,017,082 B2 7/2018 Zwaan
10,021,984 B2 7/2018 Ludwig et al.
10,034,548 B2 7/2018 Willingham
10,098,466 B2 10/2018 Donati
10,111,525 B2 10/2018 Sander et al.
10,130,184 B2 11/2018 Lin et al.
10,159,351 B1 12/2018 Alexander et al.
10,165,862 B2 1/2019 Schmitz et al.
10,172,464 B2 1/2019 Cassaday
10,172,465 B2 1/2019 Machael et al.
10,173,567 B2 1/2019 Madrigal et al.
10,182,657 B2 1/2019 Beyer et al.
10,194,750 B2 2/2019 Ludwig et al.
10,206,507 B2 2/2019 Battey et al.
10,226,129 B2 3/2019 Christianson et al.
10,226,893 B2 3/2019 Coffiled et al.
10,258,820 B2 4/2019 Harlow
D847,880 S 5/2019 Tien et al.
10,299,595 B2 5/2019 Difffrient et al.
10,321,763 B2 6/2019 Bonneywell
10,383,448 B1 * 8/2019 VerBeek ..... A47C 1/03255
D874,202 S 2/2020 Schmitz et al.
11,109,683 B2 * 9/2021 Deevers ..... A47C 7/029
2001/0028188 A1 10/2001 Stumpf et al.
2001/0029781 A1 10/2001 Tai et al.
2001/0030457 A1 10/2001 Gregory
2001/0050500 A1 12/2001 Piretti
2002/0000745 A1 1/2002 Conte
2002/0021040 A1 2/2002 Caruso et al.
2002/0041118 A1 4/2002 Howell
2002/0109384 A1 8/2002 Hansen
2002/0190552 A1 12/2002 Koepke et al.
2003/0075961 A1 4/2003 Struppler et al.
2003/0085607 A1 5/2003 Jones et al.
2003/0132653 A1 7/2003 Thole
2003/0137171 A1 7/2003 Deimen et al.
2003/0178882 A1 9/2003 Schmitz et al.
2003/0184140 A1 10/2003 Bruske
2003/0189367 A1 10/2003 Erker
2003/0221741 A1 12/2003 Schwartz
2004/0051358 A1 3/2004 Bodnar et al.
2004/0124689 A1 7/2004 Numa et al.
2004/0160109 A1 8/2004 Bottemiller
2004/0195882 A1 10/2004 White
2004/0217521 A1 11/2004 DiBattista et al.
2004/0224127 A1 11/2004 DiBattista et al.
2004/0227387 A1 11/2004 Matern et al.
2004/0245828 A1 12/2004 Norman et al.
2004/0262977 A1 12/2004 DiBattista et al.
2005/0035638 A1 2/2005 Pennington et al.
2005/0099055 A1 5/2005 Koepke et al.
2005/0116525 A1 6/2005 Holcomb et al.
2005/0248205 A1 11/2005 Neil et al.
2005/0264071 A1 12/2005 Costaglia
2006/0080817 A1 4/2006 Klinker
2006/0101724 A1 5/2006 Hoekstra et al.
2006/0181126 A1 8/2006 Eysing
2006/0202530 A1 9/2006 Lin
2006/0238009 A1 10/2006 Igarashi et al.
2006/0250029 A1 11/2006 Wu
2006/0255636 A1 11/2006 Donati
2007/0001497 A1 1/2007 Diffeient
2007/0007812 A1 1/2007 Doricko
2007/0057562 A1 3/2007 Gregory et al.
2007/0102987 A1 5/2007 Chen
2007/0108831 A1 5/2007 Ueda
2007/0126271 A1 6/2007 Brodeur
2007/0170759 A1 7/2007 Nolan et al.
2007/0222265 A1 9/2007 Machael et al.
2007/0241599 A1 10/2007 Hodgdon
2007/0262634 A1 11/2007 Brill et al.
2008/0067848 A1 3/2008 Brauning
2008/0079307 A1 4/2008 Su
2008/0122285 A1 5/2008 Lin
2008/0217977 A1 9/2008 Aldrich et al.
2008/0258531 A1 10/2008 Lu
2008/0290712 A1 11/2008 Parker et al.
2009/0015047 A1 1/2009 Baumann
2009/0018833 A1 1/2009 Kozat et al.
2009/0020165 A1 1/2009 Oelerich
2009/0021065 A1 1/2009 Brauning
2009/0085388 A1 4/2009 Parker et al.
2009/0091170 A1 4/2009 Grentzelius et al.
2009/0102268 A1 4/2009 Schmitz et al.
2009/0146476 A1 6/2009 Kan et al.
2009/0211194 A1 8/2009 Fyfe et al.
2009/0261644 A1 10/2009 Piretti
2010/0007190 A1 1/2010 Johnson et al.
2010/0078975 A1 4/2010 Kang
2010/0117419 A1 5/2010 Schmitz et al.
2010/0164263 A1 7/2010 Malenotti
2010/0289308 A1 11/2010 Schmitz et al.
2011/0062758 A1 3/2011 Wiese
2011/0074202 A1 3/2011 Su
2011/0181086 A1 7/2011 Pfeifer et al.
2011/0198907 A1 8/2011 Masunaga et al.
2011/0215623 A1 9/2011 Tsai
2011/0233979 A1 9/2011 An
2011/0241405 A1 10/2011 Slagh
2011/0266863 A1 11/2011 Zhou
2012/0025574 A1 2/2012 Wilkinson et al.
2012/0056451 A1 3/2012 Dinati

(56) References Cited

U.S. PATENT DOCUMENTS

| | | | | |
|---|---|---|---|---|
| 2012/0091769 | A1 | 4/2012 | Parker et al. | |
| 2012/0119551 | A1 | 5/2012 | Brncick et al. | |
| 2012/0139321 | A1 | 6/2012 | Wu | |
| 2012/0161483 | A1 | 6/2012 | Hayashi | |
| 2012/0181831 | A1 | 7/2012 | Meier et al. | |
| 2012/0228911 | A1 | 9/2012 | Piretti | |
| 2013/0069414 | A1 | 3/2013 | Ko | |
| 2013/0082499 | A1 | 4/2013 | Schmitz et al. | |
| 2013/0099534 | A1 | 4/2013 | Barile, Jr. et al. | |
| 2013/0099548 | A1 | 4/2013 | Schmitz et al. | |
| 2013/0119744 | A1 | 5/2013 | Panozzo et al. | |
| 2013/0134756 | A1 | 5/2013 | Hisamoto | |
| 2013/0169017 | A1 | 7/2013 | Masunaga et al. | |
| 2013/0207427 | A1 | 8/2013 | Masunaga et al. | |
| 2013/0278025 | A1 | 10/2013 | Wakabayashi et al. | |
| 2013/0313878 | A1 | 11/2013 | Lin | |
| 2013/0341980 | A1 | 12/2013 | Halliday et al. | |
| 2014/0054947 | A1 | 2/2014 | Su | |
| 2014/0077429 | A1 | 3/2014 | Battey et al. | |
| 2014/0077548 | A1 | 3/2014 | Peterson et al. | |
| 2014/0077551 | A1 | 3/2014 | Battey et al. | |
| 2014/0077573 | A1 | 3/2014 | Schneider et al. | |
| 2014/0084652 | A1 | 3/2014 | Norman et al. | |
| 2014/0103688 | A1 | 4/2014 | Wilson | |
| 2014/0110983 | A1 | 4/2014 | Sander et al. | |
| 2014/0125104 | A1 | 5/2014 | Hasegawa et al. | |
| 2014/0132051 | A1 | 5/2014 | Freedman | |
| 2014/0139004 | A1 | 5/2014 | Matsumoto et al. | |
| 2014/0152064 | A1 | 6/2014 | Sander et al. | |
| 2014/0175849 | A1 | 6/2014 | Berti et al. | |
| 2014/0183914 | A1 | 7/2014 | Cvek | |
| 2014/0183915 | A1 | 7/2014 | Deisig et al. | |
| 2014/0265493 | A1 | 9/2014 | Machael et al. | |
| 2014/0292052 | A1 | 10/2014 | Parker et al. | |
| 2014/0354026 | A1 | 12/2014 | Gorgi | |
| 2015/0044419 | A1 | 2/2015 | Carson, Jr. et al. | |
| 2015/0091353 | A1 | 4/2015 | Horn | |
| 2015/0108809 | A1 | 4/2015 | Romero | |
| 2015/0130254 | A1 | 4/2015 | Yamaguchi et al. | |
| 2015/0123441 | A1 | 5/2015 | Duke | |
| 2015/0147517 | A1 | 5/2015 | Salzmann | |
| 2015/0157131 | A1 | 6/2015 | Battey et al. | |
| 2015/0216308 | A1 | 8/2015 | Wilkinson et al. | |
| 2015/0245713 | A1* | 9/2015 | Desanta | A47C 1/03255 297/316 |
| 2015/0245714 | A1* | 9/2015 | Schneider | A47C 1/03277 297/300.5 |
| 2015/0265053 | A1 | 9/2015 | Battey et al. | |
| 2015/0265058 | A1 | 9/2015 | Igarashi et al. | |
| 2015/0296989 | A1 | 10/2015 | Machael et al. | |
| 2015/0298587 | A1 | 10/2015 | Machael et al. | |
| 2015/0314501 | A1 | 11/2015 | Maslakow | |
| 2015/0343747 | A1 | 12/2015 | Meermann et al. | |
| 2016/0026102 | A1 | 1/2016 | Miyata et al. | |
| 2016/0029801 | A1 | 2/2016 | Potrykus et al. | |
| 2016/0081477 | A1 | 3/2016 | Coffiled | |
| 2016/0128481 | A1 | 5/2016 | Piretti | |
| 2016/0135603 | A1 | 5/2016 | Chan et al. | |
| 2016/0296026 | A1 | 10/2016 | Ludwig et al. | |
| 2016/0368405 | A1 | 12/2016 | Ishii et al. | |
| 2017/0079435 | A1 | 3/2017 | Donati | |
| 2017/0079439 | A1 | 3/2017 | Schmitz et al. | |
| 2017/0102987 | A1 | 4/2017 | Malnati | |
| 2017/0127839 | A1 | 5/2017 | Cassaday | |
| 2017/0135487 | A1 | 5/2017 | Donati | |
| 2017/0354254 | A1* | 12/2017 | Diffrient | A47C 1/024 |
| 2018/0160613 | A1 | 6/2018 | Battey et al. | |
| 2018/0310721 | A1 | 11/2018 | Schmitz et al. | |
| 2018/0332967 | A1 | 11/2018 | Jin et al. | |
| 2018/0352961 | A1 | 12/2018 | Deevers et al. | |
| 2019/0021500 | A1 | 1/2019 | Sander et al. | |
| 2019/0038033 | A1 | 2/2019 | Schmitz et al. | |
| 2019/0045934 | A1 | 2/2019 | Deisig et al. | |
| 2020/0085194 | A1 | 3/2020 | Maier et al. | |

FOREIGN PATENT DOCUMENTS

| | | | |
|---|---|---|---|
| BE | 702816 | | 1/1968 |
| CA | 1235055 | | 4/1988 |
| CA | 2395448 | A1 | 6/2002 |
| CA | 2437074 | C | 10/2009 |
| CA | 3026655 | A1 | 12/2017 |
| CN | 1531401 | A | 9/2004 |
| CN | 1177556 | C | 12/2004 |
| CN | 201360764 | Y | 12/2009 |
| CN | 201436914 | U | 4/2010 |
| CN | 201958277 | U | 9/2011 |
| CN | 102476448 | A | 5/2012 |
| CN | 201658054 | U | 12/2012 |
| CN | 103876498 | A1 | 6/2014 |
| CN | 203662373 | U | 6/2014 |
| CN | 104736018 | A | 6/2015 |
| CN | 109310209 | A | 2/2019 |
| DE | 1779854 | | 5/1961 |
| DE | 6925165 | | 10/1969 |
| DE | 2026929 | | 6/1970 |
| DE | 1404657 | | 10/1970 |
| DE | 2241209 | | 3/1973 |
| DE | 2222840 | | 11/1973 |
| DE | 24 54 471 | A1 | 5/1976 |
| DE | 27 57 652 | A1 | 6/1979 |
| DE | 2931072 | | 2/1980 |
| DE | 3116459 | A1 | 11/1982 |
| DE | 3139448 | A1 | 4/1983 |
| DE | 3203401 | A1 | 8/1983 |
| DE | 8419826 | | 7/1984 |
| DE | 3322450 | A1 | 1/1985 |
| DE | 3423857 | A1 | 1/1985 |
| DE | 3530868 | A1 | 3/1987 |
| DE | 3605809 | A1 | 8/1987 |
| DE | 3618705 | A1 | 12/1987 |
| DE | 3735256 | A1 | 4/1989 |
| DE | 37 37 491 | A1 | 5/1989 |
| DE | 3737491 | | 5/1989 |
| DE | 3821042 | A1 | 12/1989 |
| DE | 4023607 | A1 | 1/1992 |
| DE | 4121768 | C1 | 10/1992 |
| DE | 4235691 | A1 | 6/1993 |
| DE | 4216159 | A1 | 11/1993 |
| DE | 4303021 | A1 | 8/1994 |
| DE | 44 24 096 | | 1/1996 |
| DE | 4424096 | A1 | 1/1996 |
| DE | 29517458 | | 2/1996 |
| DE | 44 33 663 | A1 | 3/1996 |
| DE | 4442246 | A1 | 5/1996 |
| DE | 19607136 | A1 | 8/1996 |
| DE | 29 704 906 | U1 | 5/1997 |
| DE | 29704906 | | 7/1997 |
| DE | 196 11 345 | | 9/1997 |
| DE | 19611345 | | 9/1997 |
| DE | 19620260 | A1 | 11/1997 |
| DE | 29717573 | U1 | 2/1998 |
| DE | 19640564 | A1 | 4/1998 |
| DE | 197 14 546 | | 10/1998 |
| DE | 19714546 | A1 | 10/1998 |
| DE | 199 30 922 | A1 | 5/2000 |
| DE | 199 21 153 | A1 | 11/2000 |
| DE | 100 12 034 | A1 | 9/2001 |
| DE | 10051840 | A1 | 5/2002 |
| DE | 10122945 | | 12/2002 |
| DE | 203 06 685 | U1 | 8/2003 |
| DE | 202004004800 | U1 | 5/2004 |
| DE | 101 47 021 | B4 | 12/2004 |
| DE | 20 2006 006 678 | U1 | 7/2006 |
| DE | 20 2006 012 654 | U1 | 1/2007 |
| DE | 102005054125 | B3 | 5/2007 |
| DE | 20 2006 005 645 | U1 | 8/2007 |
| DE | 202006005645 | U1 | 9/2007 |
| DE | 202007010030 | U1 | 9/2007 |
| DE | 102006056928 | | 6/2008 |
| DE | 202007001395 | | 6/2008 |
| DE | 10 2008 009 509 | A1 | 8/2009 |
| DE | 102009019232 | | 11/2009 |
| DE | 20 2010 007 073 | U1 | 11/2010 |

(56) References Cited

FOREIGN PATENT DOCUMENTS

| | | | |
|---|---|---|---|
| DE | 20 2010 008 739 | | 1/2012 |
| DE | 20 2012 005 465 | U1 | 10/2013 |
| DE | 102013205784 | | 10/2014 |
| DE | 102013022122 | A1 | 7/2015 |
| DE | 10 2015 202 079 | A1 | 3/2016 |
| EP | 0006840 | A1 | 1/1980 |
| EP | 0014001 | A1 | 8/1980 |
| EP | 0049310 | A1 | 4/1982 |
| EP | 0081102 | A1 | 6/1983 |
| EP | 0107627 | A1 | 5/1984 |
| EP | 0151816 | A2 | 8/1985 |
| EP | 0202386 | A2 | 11/1986 |
| EP | 0247312 | | 12/1987 |
| EP | 0 815 778 | A1 | 1/1988 |
| EP | 0 284 272 | A1 | 3/1988 |
| EP | 284272 | A1 | 9/1988 |
| EP | 0298928 | A2 | 1/1989 |
| EP | 0338050 | | 10/1989 |
| EP | 0339089 | | 11/1989 |
| EP | 0540711 | | 5/1993 |
| EP | 0 552 388 | A1 | 7/1993 |
| EP | 0 559 185 | A1 | 9/1993 |
| EP | 0 578 276 | A1 | 1/1994 |
| EP | 0591932 | | 4/1994 |
| EP | 0592369 | | 4/1994 |
| EP | 0 678 260 | A1 | 10/1995 |
| EP | 0 860 355 | A1 | 2/1997 |
| EP | 0 839 478 | A1 | 5/1998 |
| EP | 0 870 443 | A2 | 10/1998 |
| EP | 0 982 180 | A1 | 3/1999 |
| EP | 0 960 586 | A2 | 12/1999 |
| EP | 0 982 179 | A2 | 3/2000 |
| EP | 1 040 999 | A2 | 10/2000 |
| EP | 1066776 | | 1/2001 |
| EP | 1 161 905 | A1 | 12/2001 |
| EP | 1 316 651 | A2 | 6/2003 |
| EP | 1 447 029 | A1 | 8/2004 |
| EP | 1 559 348 | A2 | 1/2005 |
| EP | 1 785 065 | A1 | 5/2007 |
| EP | 1 785 067 | A1 | 5/2007 |
| EP | 1 785 068 | A1 | 5/2007 |
| EP | 1 785 070 | A1 | 5/2007 |
| EP | 1 785 076 | A1 | 5/2007 |
| EP | 1 808 096 | A1 | 7/2007 |
| EP | 1 836 935 | A1 | 9/2007 |
| EP | 1854378 | A1 | 11/2007 |
| EP | 2070443 | | 12/2007 |
| EP | 1 232 703 | B1 | 2/2008 |
| EP | 1 886 798 | A2 | 2/2008 |
| EP | 1 911 374 | A1 | 6/2008 |
| EP | 2 047 769 | A1 | 4/2009 |
| EP | 2 100 539 | A1 | 9/2009 |
| EP | 2 110 050 | A1 | 10/2009 |
| EP | 2 110 051 | A1 | 10/2009 |
| EP | 2 110 052 | A1 | 10/2009 |
| EP | 2 005 861 | B1 | 4/2011 |
| EP | 2 070 446 | A1 | 5/2011 |
| EP | 2 319 967 | A1 | 5/2011 |
| EP | 2 335 527 | A1 | 6/2011 |
| EP | 2 520 199 | A1 | 11/2012 |
| EP | 2698 081 | A1 | 2/2014 |
| EP | 2 724 641 | A1 | 4/2014 |
| EP | 2765026 | A1 | 8/2014 |
| EP | 3 409 144 | A1 | 12/2018 |
| FR | 820791 | | 11/1937 |
| FR | 1383559 | | 11/1964 |
| FR | 1518777 | | 2/1968 |
| FR | 1518777 | | 3/1968 |
| FR | 1531798 | | 7/1968 |
| FR | 2045120 | | 2/1971 |
| FR | 2233799 | | 6/1973 |
| FR | 2461472 | | 2/1981 |
| FR | 2533428 | | 3/1984 |
| GB | 469313 | | 7/1937 |
| GB | 608327 | | 9/1948 |
| GB | 610741 | | 10/1948 |
| GB | 770169 | | 3/1957 |
| GB | 2028119 | | 3/1980 |
| GB | 1568368 | | 5/1980 |
| GB | 2092438 | | 8/1982 |
| JP | 3015411 | A | 1/1991 |
| JP | D7246123 | | 6/1995 |
| JP | H 0889359 | A | 4/1996 |
| JP | 2713169 | | 10/1997 |
| JP | 1099158 | A | 4/1998 |
| JP | 2001-78852 | A | 3/2001 |
| JP | 2002-119357 | | 4/2002 |
| JP | 2002-172036 | A | 6/2002 |
| JP | 2004049658 | | 2/2004 |
| JP | 2005-211250 | A | 8/2005 |
| JP | 3874392 | | 11/2006 |
| JP | 4176462 | B2 | 11/2008 |
| JP | 2009-268780 | A | 11/2009 |
| JP | 2010-063821 | A | 3/2010 |
| JP | 2010-063831 | A | 3/2010 |
| JP | 2010-82021 | A | 4/2010 |
| JP | 2010-94301 | A | 4/2010 |
| JP | 4491318 | B2 | 6/2010 |
| JP | 4704892 | B2 | 6/2011 |
| JP | 4718975 | B2 | 7/2011 |
| JP | 4932983 | B2 | 5/2012 |
| JP | 5007444 | B2 | 8/2012 |
| JP | 5290695 | B2 | 6/2013 |
| JP | 2013132402 | A | 7/2013 |
| JP | 2013132403 | A | 7/2013 |
| JP | 2013-151252 | A | 8/2013 |
| JP | 2015 123321 | A | 7/2015 |
| JP | 2015 177979 | A | 10/2015 |
| JP | 5881239 | B2 | 3/2016 |
| JP | 6015070 | B2 | 10/2016 |
| JP | 6537827 | B2 | 7/2019 |
| JP | 6538020 | B2 | 7/2019 |
| KR | 2006-0087336 | | 8/2006 |
| NL | 7804978 | | 5/1978 |
| WO | WO 92/20262 | | 11/1992 |
| WO | WO 99/34710 | A1 | 7/1999 |
| WO | WO 0074531 | | 8/2001 |
| WO | WO 01/76418 | A1 | 10/2001 |
| WO | WO 01/91614 | A1 | 12/2001 |
| WO | WO 02/058514 | A1 | 8/2002 |
| WO | WO 02/091880 | A1 | 11/2002 |
| WO | WO 2003/068025 | A3 | 8/2003 |
| WO | WO 2004/103121 | A1 | 12/2004 |
| WO | WO 2005/025379 | A1 | 3/2005 |
| WO | WO 2007/012418 | A1 | 2/2007 |
| WO | WO 2007/095960 | A1 | 8/2007 |
| WO | WO 2007/110732 | A1 | 10/2007 |
| WO | WO 2007112236 | | 10/2007 |
| WO | WO 2008/000295 | A1 | 1/2008 |
| WO | WO 2008/092562 | A1 | 8/2008 |
| WO | WO 2008/146887 | A1 | 12/2008 |
| WO | WO 2008/149224 | A1 | 12/2008 |
| WO | WO 2009/033535 | A1 | 3/2009 |
| WO | WO 2009/039231 | A1 | 3/2009 |
| WO | WO 2009134451 | A1 | 11/2009 |
| WO | WO 2009153811 | A1 | 12/2009 |
| WO | WO 2010/041894 | A2 | 4/2010 |
| WO | WO 2010/050204 | A1 | 6/2010 |
| WO | WO 2011/157392 | A1 | 12/2011 |
| WO | WO 2013/020088 | A2 | 2/2013 |
| WO | WO 2013/083562 | A1 | 6/2013 |
| WO | WO 2014/061732 | A1 | 4/2014 |
| WO | WO 2014/121923 | A1 | 8/2014 |
| WO | WO 2016/124328 | A1 | 8/2016 |
| WO | WO 2017/082316 | A1 | 5/2017 |
| WO | WO 2017/162310 | A1 | 9/2017 |
| WO | WO 2017/214564 | A1 | 12/2017 |

OTHER PUBLICATIONS

Steelcase brochure titled "Love how you work", dated 2008, 8 pgs.
Steelcase Please Chair with grey frame, obtained on the Internet at: https://2ndhnd,—2ndndn.com.com/products,steelcase-please-chair-

(56) References Cited

OTHER PUBLICATIONS with-grey-frame, dated Jun. 9, 2016, 4 pgs.
Adsausage Knoll The Different Executive Chair, obtained on the Internet at: http://www.adsausage.com/ad.cfm?id-50669, dated Jun. 9, 2006, 2 pgs.
Dauphin furniture brochure for Lordo chairs, located on the Internet at: www.dauhin.com, 6 pgs.
Herman Miller, Ergonomic Chairs, obtained from the Internet at: http://decobizz.com/ergonomic-chairs-1454.html, dated Sep. 6, 2016, 2 pgs.
Different Smart Chair, obtained from the Internet at: http://humanscale.comproducts, 1 pg.
Knoll brochure titled "Generation by Knoll", 2009, 18 pgs.
Knoll brochure titled "ReGeneration by Knoll", 2012, 8 pgs.
Steelcase brochure, 2105, 8 pgs.
Sedus brochure, "se:motion, Office swivel chair for agile working", obtained from the Internet at: www.sedus.com, not dated, 20 pgs.
International Search Report and Written Opinion for PCT Application No. PCT/US2020/018785, dated Feb. 19, 2020, 14 pgs.

* cited by examiner

BODY SUPPORT ASSEMBLY AND METHODS FOR THE USE AND ASSEMBLY THEREOF

This application claims the benefit of Provisional Application No. 62/947,911, filed Dec. 13, 2019 and entitled "Body Support Assembly and Methods for the Use and Assembly Thereof," claims the benefit of U.S. Provisional Application 62/947,914, filed Dec. 13, 2019 and entitled "Body Support Assembly and Methods for the Use and Assembly Thereof," and also claims the benefit of U.S. application Ser. No. 16/794,946, filed Feb. 19, 2020, now U.S. Pat. No. 11,109,683 B2, and entitled "Body Support Assembly and Methods for the Use and Assembly Thereof," the entire disclosure of which is hereby incorporated herein by reference.

FIELD OF THE INVENTION

The present application relates generally to a body support assembly, for example a chair, and in particular to a backrest assembly and/or seat assembly incorporated into the body support assembly, and various components incorporated therein, together with methods for the use and assembly thereof.

BACKGROUND

Chairs, and in particular office chairs, may have a body support member configured with a suspension material, such as a mesh fabric, that is stretched across a frame. Such suspension materials conform to the body of the user, providing micro compliance along with improved air circulation, and the attendant cooling benefit. Typically, the frame must be rigid in order to maintain an appropriate level of tension in the suspension material. Such rigidity may limit, however, the flexibility of the body support member, and introduce unforgiving pressure points around the perimeter of the frame. In addition, suspension materials installed on a seat of a chair are typically required to sustain higher tensions due to the load being applied thereto by a seated user, which may exacerbate the limited flexibility and rigidity of the supporting structure.

While various mechanical systems, such as lumbar supports and tilt control mechanisms, may be introduced to mitigate the limited flexibility and provide additional adjustment capabilities, such systems are relatively expensive to manufacture, require additional maintenance, are susceptible to wear and tear over time, and may not be appropriately exploited by the user due to the requirement for individual adjustments. In addition, such tilt mechanisms typically include one or more rigid links, and mechanical connections, which are rigid and non-compliant, which result in a more rigid and less forgiving ride, and which may lead to a less desirable user experience. Conversely, systems relying on the materiality of the seating structure to introduce the appropriate kinematics and flexibility may not be suitable to support a suspension material. While body support surfaces may be defined by one or more foam cushions, foam materials may limit air circulation and often do not provide localized support. In addition, body support members configured with plastic shells, supported for example by peripheral frames, typically do not provide a comfortable body-conforming support surface.

SUMMARY

The present invention is defined by the following claims, and nothing in this section should be considered to be a limitation on those claims.

In one aspect, one embodiment of a seat assembly includes a lower support platform having a first peripheral edge, an upper surface and a lower surface. A support ring is coupled to the first peripheral edge of the lower support platform and extends radially outwardly therefrom and defines a second peripheral edge. The support ring includes an upper surface. An upper shell is disposed over the upper surfaces of the lower support platform and the support ring and defines a concave cavity. The upper shell has a third peripheral edge defining a central opening and an upper surface. A suspension material is secured to the upper shell across the central opening and covers the concave cavity.

In another aspect, one embodiment of a body support member includes a carrier frame having a body facing first surface, a second surface opposite the first surface, a peripheral edge surface extending between the first and second surfaces, and a peripheral groove formed in and opening outwardly from the peripheral edge surface. A support frame includes a first surface and a peripheral edge. A flexible edge member is connected to the peripheral edge of the support frame. The flexible edge member has an inner surface spaced apart from and facing the peripheral edge surface of the carrier frame. The inner surface and the peripheral edge surface define a gap therebetween, with the gap being in communication with the peripheral groove. A textile material includes a peripheral edge. The textile material covers the first surface of the carrier frame and is disposed in the gap between the inner surface of the flexible edge and the peripheral edge surface of the carrier frame. The textile material engages at least a portion of the peripheral edge surface of the carrier frame. The peripheral edge of the textile material is disposed in the peripheral groove.

In another aspect, one embodiment of a method of manufacturing a body support member includes disposing a peripheral edge of a textile material into a groove formed in a peripheral edge surface of a carrier frame, covering at least a portion of the peripheral edge surface and a body-facing first surface of the carrier frame with the textile material, and connecting a flexible edge member to the carrier frame. The flexible edge member has an inner surface spaced apart from and facing the peripheral edge surface of the carrier frame, wherein the inner surface and the peripheral edge surface define a gap therebetween, wherein the gap is in communication with the peripheral groove, and wherein the textile material is disposed in the gap.

In another aspect, one embodiment of a seat assembly includes a lower support platform extending in a longitudinal direction. The lower support platform includes opposite side edges and a laterally extending first flex region extending between the opposite side edges that bifurcates the lower support platform into a front portion and a rear portion. The first flex region is bendable such that the rear portion is downwardly deflectable relative to the front portion, even though both the front and rear portions may move upwardly during recline in one embodiment. An upper shell includes opposite side members connected to the support platform with a pair of connectors. Each of the connectors includes a second flex region, wherein the second flex regions are bendable such that the opposite side members are upwardly moveable relative to the lower support platform as the rear portion is downwardly deflectable.

In another aspect, a body support member includes a carrier frame having a central portion and a peripheral ring connected to the central portion with a plurality of connectors each having a flex region, with the peripheral ring defining a central opening. An elastic textile material is coupled to the peripheral ring across the central opening. A cushion is disposed between the central portion and the textile material. At least one the plurality of connectors is inwardly deflectable a first amount from a first unloaded configuration to a first loaded configuration in response to a load applied to the elastic material, and the elastic material is downwardly deflectable a second amount from a second unloaded configuration to a second loaded configuration in response to the load applied thereto. The cushion engages and provides auxiliary support to the elastic material when the first and second amounts of deflection result in the elastic material contacting the cushion.

In another aspect, one embodiment of a body support member includes a flexible carrier frame deformable from an unloaded configuration to loaded configuration, an elastic textile material coupled to the carrier frame, and a cushion disposed beneath the textile material. The flexible carrier frame, elastic material and cushion provide first, second and third amounts of resilient support to a user engaging and supported by the textile material.

In another aspect, one embodiment of a body support member includes a carrier frame having opposite side portions defining an opening therebetween. An elastic textile material is coupled to the side portions across the opening, with a cushion disposed beneath the textile material. At least one of the side portions, and preferably both side portions, are inwardly deflectable a first amount from a first unloaded configuration to a first loaded configuration in response to a load applied to the elastic material. The elastic material is downwardly deflectable a second amount from a second unloaded configuration to a second loaded configuration in response to the load applied thereto, and the cushion engages and provides auxiliary support to the elastic material when the first and second amounts of deflection result in the elastic material contacting the cushion.

In another aspect, one embodiment of a body support assembly includes a base member and a lower support structure having a longitudinally extending portion coupled to the base member at a first location, a front link extending upwardly from the longitudinally extending portion forwardly of the first location, and a rear link extending upwardly from the longitudinally extending portion rearwardly of the first location. A back frame includes a first lower portion extending rearwardly from the rear link and an upright portion extending upwardly from the lower portion. A seat support member is coupled to the front link and to the rear link, wherein the seat support member supports a seating surface. A back support is pivotally connected to the upright portion at a second location above the seating surface and includes a second lower portion connected to the rear link below the seat support member.

In another aspect, one embodiment of a backrest assembly includes a base and a rigid back frame having a first upright portion and a first lower portion extending forwardly from the first upright portion and coupled to the base. The first lower portion is reclinable relative to the base about a first flex region. A flexible back support includes a second upright having a second flex region proximate a lumbar region of the back support, wherein the second upright is flexible about the second flex region, and a second lower portion extending forwardly from the second upright and coupled to the first lower portion. The second lower portion is reclinable with the first lower portion relative to the base about the first flex region. The second lower portion has a third flex region located between the first and second flex regions, wherein the second lower portion is flexible about the third flex region, and wherein the second upright is pivotally coupled to the back frame at a third location spaced above the second flex location.

In another aspect, one embodiment of a body support assembly includes a base member and a lower support structure including a longitudinally extending portion coupled to the base member at a first location, the longitudinally extending portion defining a first flex region positioned rearward of the first location. A front link extends upwardly from the longitudinally extending portion forwardly of the first location, wherein at least one of the lower support member and the front link define a second flex region positioned forward of the first location. A rear link extends upwardly from the longitudinally extending portion rearward of the first location. A seat support member is coupled to the front link and to the rear link, wherein the seat support member supports a seating surface. At least one of the seat support member and the front link define a third flex region and the seat support member defines a fourth flex region adjacent the rear link. A rigid back frame extends upwardly and rearwardly from the lower support structure, wherein the rigid back frame is rigidly connected to the rear link. A flexible back support includes an upper portion pivotally connected to the rigid back frame at a second location vertically spaced above the seat support and a lower portion rigidly connected to the rear link. The flexible back support has a fifth flex region located between the seat support and the second location and a sixth flex region located between the fifth flex region and the rear link.

In another aspect, one embodiment of a backrest assembly includes a back frame including a pair of first uprights and a back support includes a pair of second uprights, each of the second uprights positioned laterally outboard of one of the first uprights. A body support member is coupled to the back support. A pair of connectors extend laterally between one of the first uprights and one of the second uprights, wherein each of the connectors includes a first connector tab extending laterally from one of the first uprights and a second connector tab extending laterally from one of the second uprights, wherein the first and second connector tabs are overlapping.

In another aspect, one embodiment of a backrest assembly includes a back frame having a first upright and a back support having a second upright laterally spaced from the first upright. A body support member is coupled to the back support. A connector tab extends laterally from one of the first or second upright and includes a laterally extending and non-cylindrical insert portion received in a socket formed in the other of the first or second upright. The insert portion is rotatable about a laterally extending axis relative to the socket between at least first and second pivot positions, wherein the insert portion engages first and second stop surfaces of the socket when the insert portion is in the first and second positions respectively.

In another aspect, one embodiment of a support structure for a body support member includes a lower support member having an upwardly extending first post, a backrest frame having an upwardly extending second post, and a seat support having a downwardly extending boss structure coupled to the first and second posts.

In another aspect, one embodiment of a body support assembly includes a seat having opposite sides spaced apart in a lateral direction and a front and rear spaced apart in a first longitudinal direction. A back support has opposite sides spaced apart in the lateral direction and a top and bottom spaced apart in a second longitudinal direction. A support structure supports the seat at a pair of laterally spaced front locations and a central rear location, wherein the rear of the seat is rotatable relative to the front of the seat about a first longitudinal axis. The support structure supports the back support at a pair of laterally spaced upper locations and a central lower location, wherein the bottom of the back support is rotatable relative to a top of the back support about a second longitudinal axis. In one embodiment, the seat and the back support are coupled to a central rear link at the central rear location and the central bottom location respectively.

In another aspect, one embodiment of a body support assembly includes a body support member reclinable relative to a base. A recline limiter assembly interfaces between the body support member and the base to limit the recline of the body support member relative to the base. The recline limiter assembly includes a recline limiter having at least two rotational degrees of freedom.

In another aspect, one embodiment of a body support assembly includes a body support member rearwardly reclinable relative to a base. The body support member has a front and a rear spaced apart in a longitudinal direction. A recline stop member includes a first end connected to the body support member and a second end defining a stop portion. A recline limiter includes at least first and second longitudinally spaced stop surfaces, wherein the plurality of stop surfaces are angularly spaced about a longitudinal axis. The recline limiter is rotatably mounted to the base about the longitudinal axis, and is rotatable about the longitudinal axis between a first position, wherein the stop portion engages the first stop surface, and a second position, wherein the stop portion engages the second stop surface.

In another aspect, one embodiment of a body support assembly includes a lower base and a seat support connected to the lower base with an extensible support column having an actuation button. A handle is rotatable about a first lateral axis. A drive gear is connected to the handle and is rotatable about the first lateral axis from a non-engaged configuration to an engaged configuration. The drive gear includes a first plurality of teeth. A driven gear is rotatable about a second lateral axis spaced apart from the first lateral axis. The driven gear includes a second plurality of teeth, wherein the first and second pluralities of teeth are not engaged when the drive gear is in the non-engaged position. The drive gear is rotatable to the engaged configuration whereinafter the first plurality of teeth are brought into engagement with the second plurality of teeth after a first predetermined amount of rotation of the handle about the first lateral axis. The driven gear is rotated from a non-actuated position to an actuation position about the second lateral axis when the drive gear is in the engaged configuration. An actuator is coupled to the drive gear, wherein the actuator is rotatable into engagement with the actuation button as the driven gear is rotated to the actuation position.

In another aspect, one embodiment of a backrest assembly includes a backrest frame having first and second laterally spaced uprights defining a central opening therebetween. Each of the first and second uprights has upper and lower portions defining separate first and second forwardly facing convex curvatures. A cross member extends between and is coupled to the uprights at the junction between the upper and lower portions. A suspension material is connected to the first and second uprights and spans across the central opening. The suspension material has a front surface and a rear surface, wherein at least opposite side portions of the suspension material have first and second forwardly facing convex curvatures. A laterally extending stay is coupled to and extends between the rear surface of the suspension material and the cross member.

In another aspect, on embodiment of an armrest assembly for a seating unit includes an armrest support adapted for attachment to a seating unit and including an upper support platform. An armrest pad is adapted to support a person's arm and includes laterally spaced and downwardly extending rim portions positioned along opposite sides of the armrest pad. A pair of swing arms each have a first end pivotally connected to the upper support platform at spaced apart first locations and a second end pivotally and slidably connected to the armrest pad at spaced apart second locations. The swing arms adjustably support the armrest pad for independent longitudinal, lateral, and rotational adjustment. At least one of the rim portions engages at least one of the swing arms to limit inboard and/or outboard lateral movement of the armrest pad relative to the support platform.

Various methods of using and assembling the body support assembly and other components are also provided.

The various embodiments of the body support assembly and components, and methods for the use and assembly thereof, provide significant advantages over other body support assemblies and methods. For example and without limitation, the structure allows for the integration of a suspension material into the backrest and/or seat, while maintaining an overall flexibility of those components. The structure and user interface provide a body support structure that adapts to the user's body and provides for macro compliance during use, while also providing micro compliance at the user interface and avoiding hard interfaces around the periphery thereof.

In addition, the various links and flex regions provide a simple but robust structure that ensures a proper fit for a multitude of users without the requirement of complex mechanical mechanisms and adjustment interfaces. The body support assemblies, with their various flex regions and material compliance, provide for improved comfort and fit, while reducing costs by reducing and/or eliminating the overall number of parts, including various metal components, which may reduce manufacturing costs. In addition, the compliant materials may reduce the overall weight of the body support assembly, and the attendant shipping costs associated therewith. The body support assembly is uncomplicated, durable, visually appealing and capable of a long operating life. At the same time, various components are ideally suited for interfacing with the compliant seating structure, including for example and without limitation the floating recline limiter that accommodates the movement of a body support member relative to a base.

The armrest also provides significant advantages, with the rim of the pad limiting inboard and outboard movement, such that the underlying platform remains obscured during lateral movement, thereby improving the aesthetics of the armrest.

The disclosed backrest also provides significant advantages, for example and without limitation, providing for a single piece of suspension material to cover a frame having a plurality of separate convex curvatures. The stay allows for the suspension material to conform to the backrest, while pulling it rearwardly to provide a conforming shape and pleasing aesthetic appearance.

The foregoing paragraphs have been provided by way of general introduction, and are not intended to limit the scope of the claims presented below. The various preferred embodiments, together with further advantages, will be best understood by reference to the following detailed description taken in conjunction with the accompanying drawings.

DETAILED DESCRIPTION OF THE PRESENTLY PREFERRED EMBODIMENTS

Figure 1:
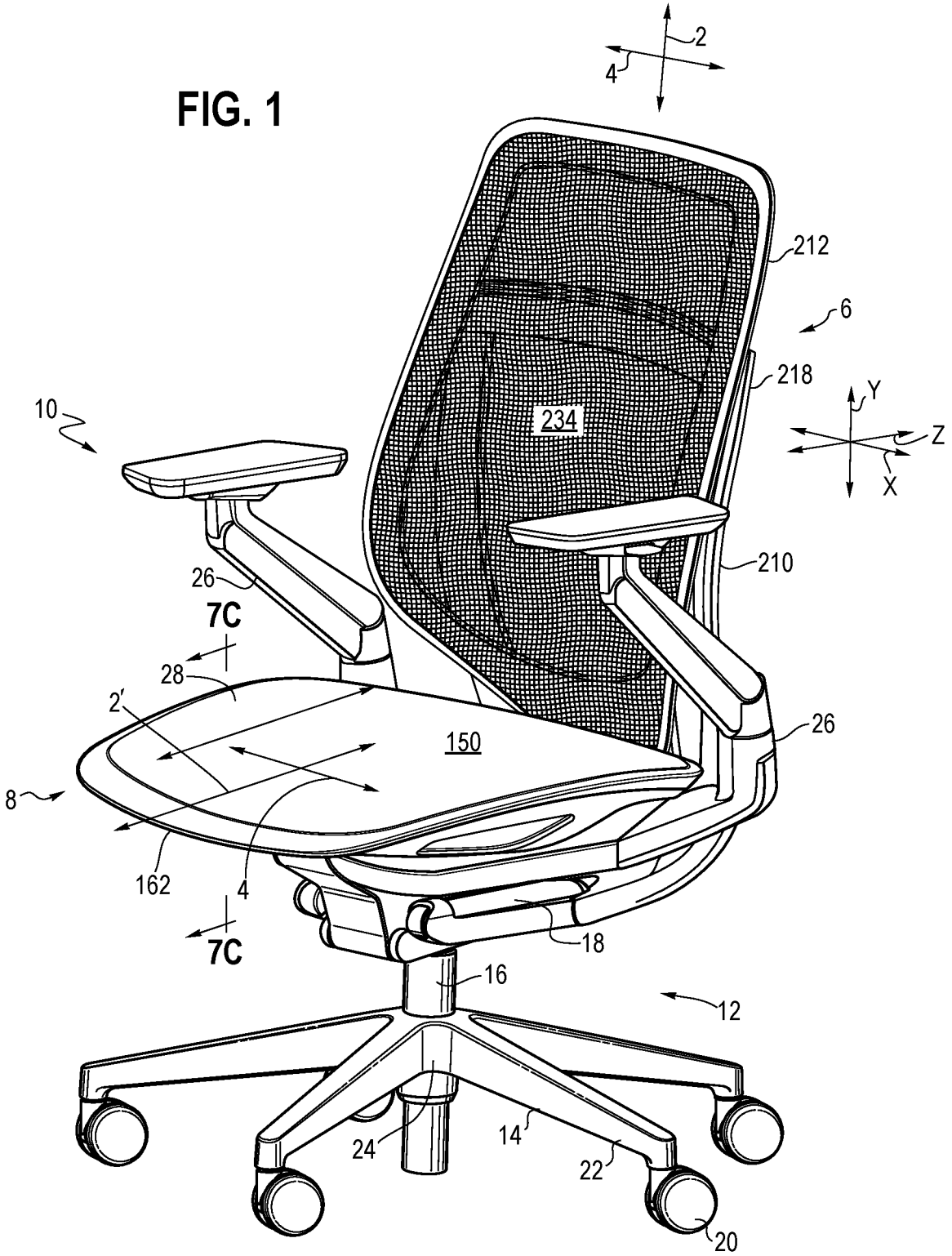
FIG. 1 is a perspective view of one embodiment of a body support assembly.
Figure 2:
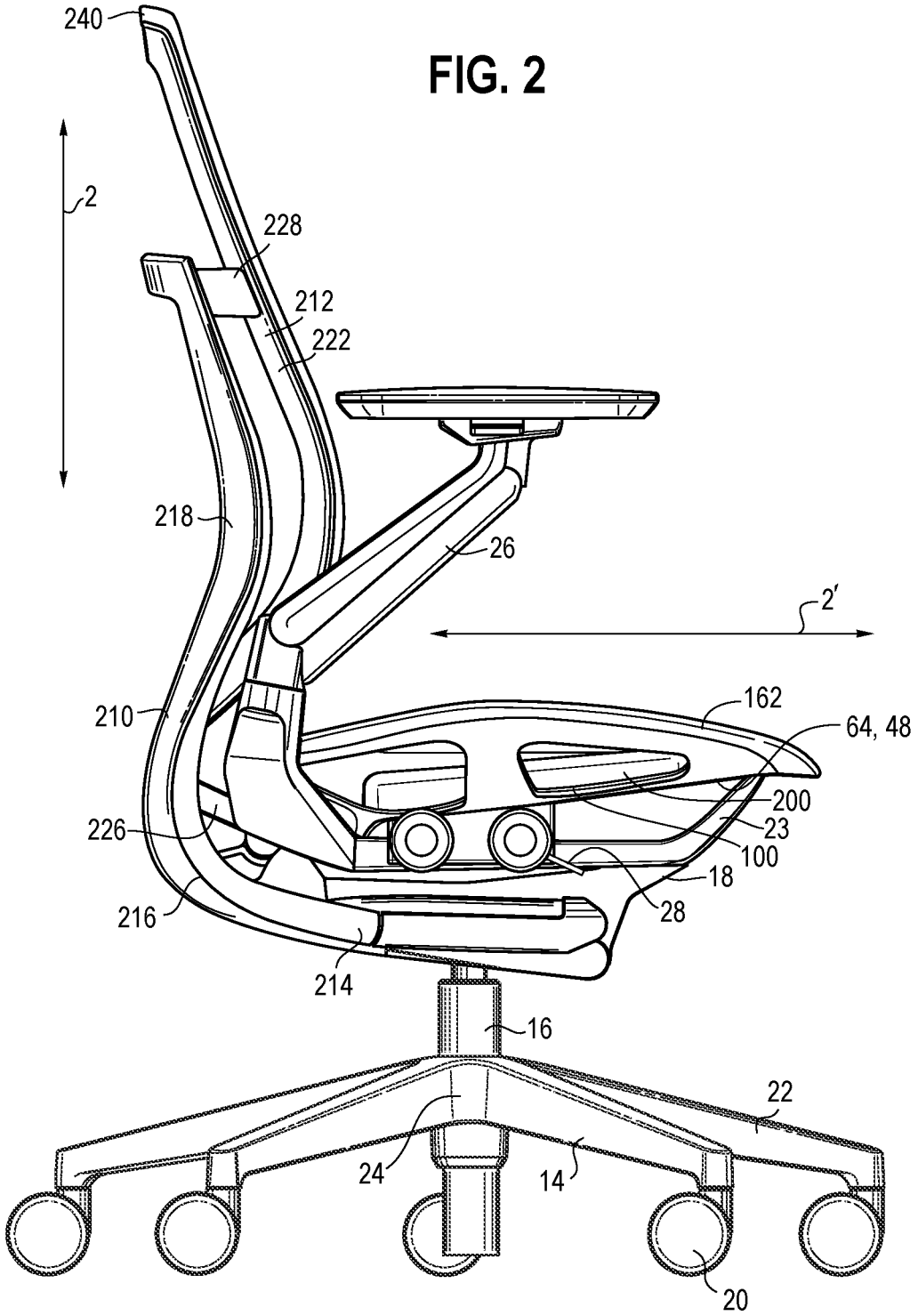
FIG. 2 is a right side view of the body support assembly shown in FIG. 1, with the left side view being a mirror image thereof.
Figure 3:
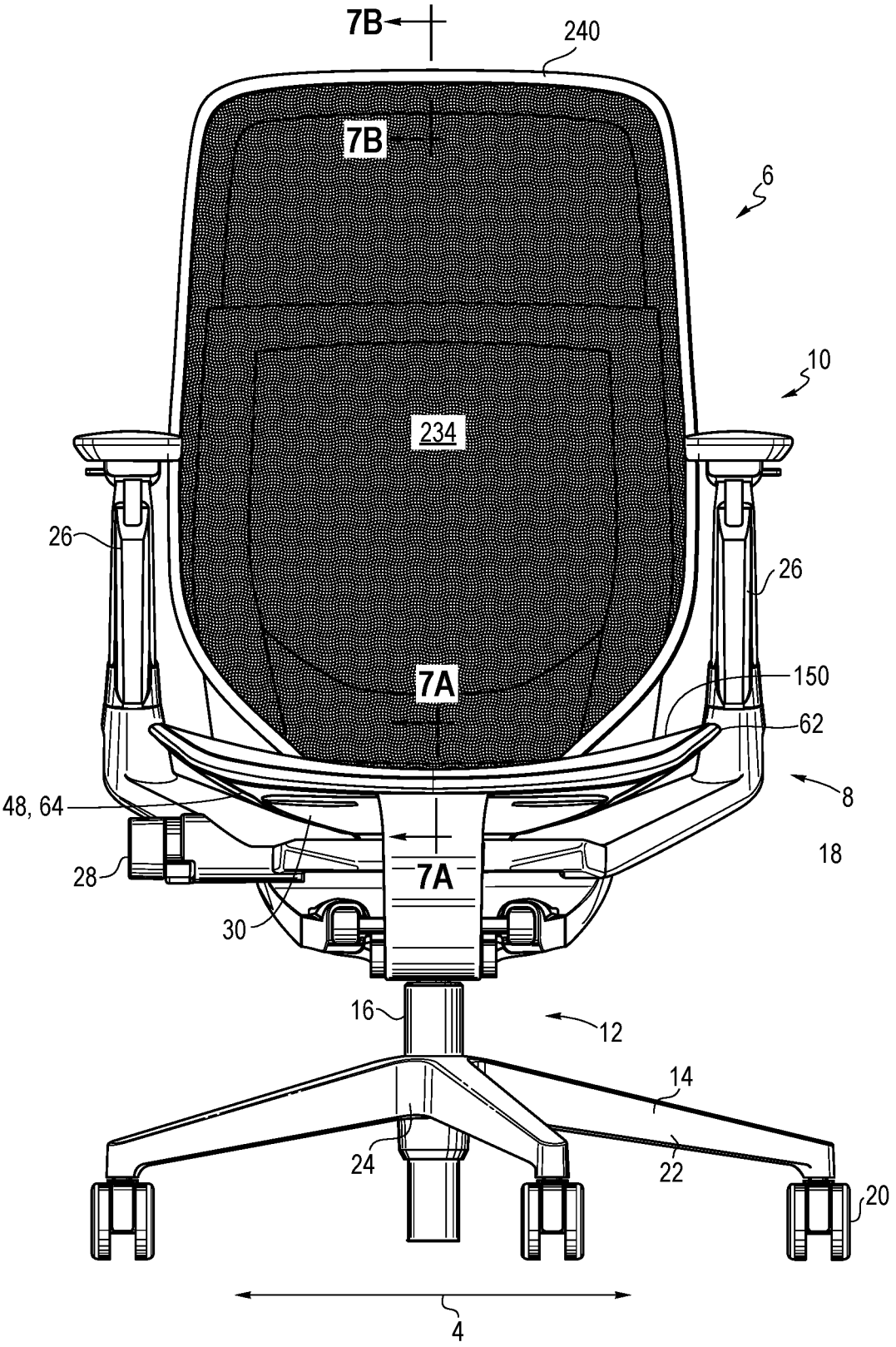
FIG. 3 is front view of the body support assembly shown in FIG. 1.
Figure 4:
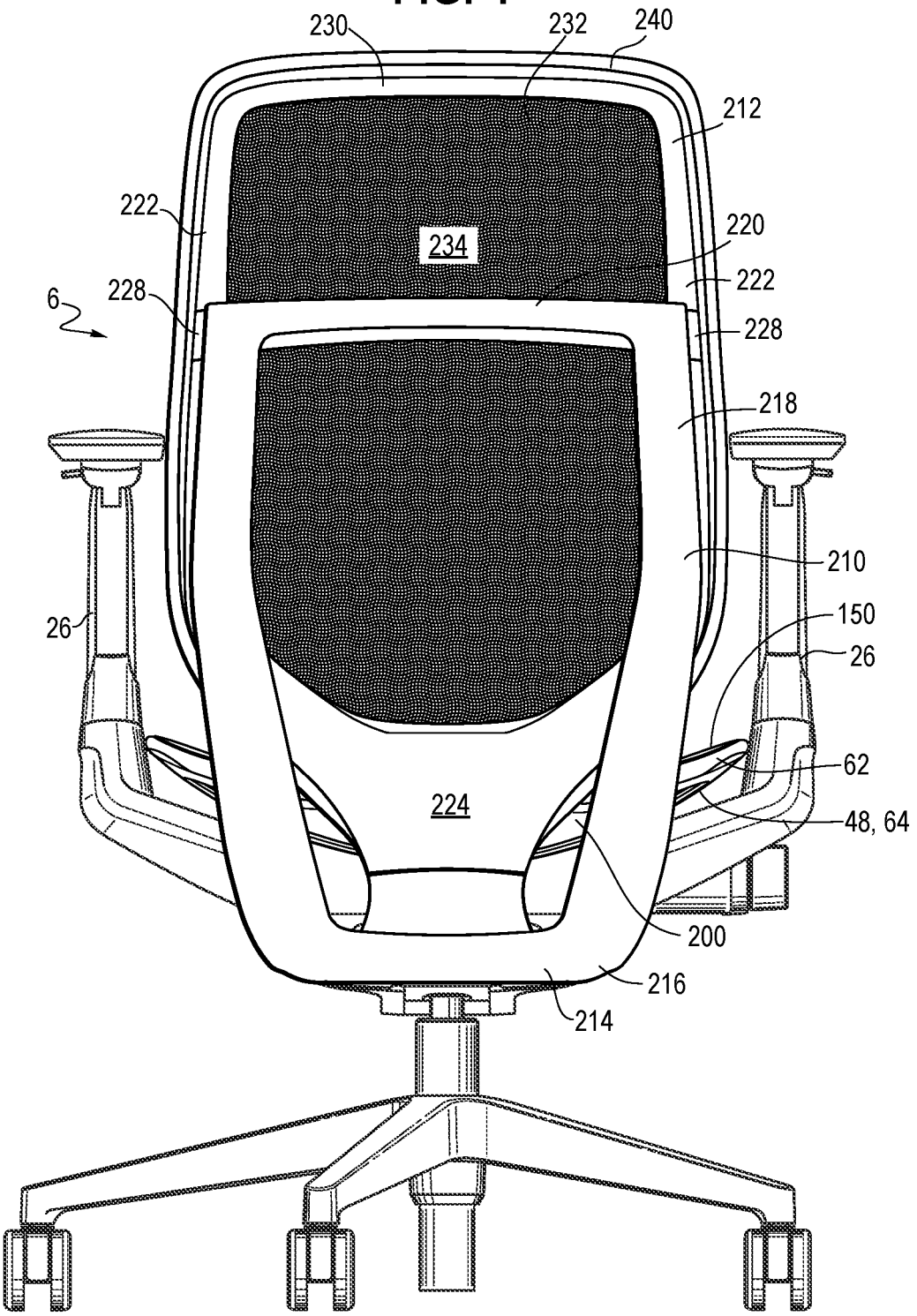
FIG. 4 is a rear view of the body support assembly shown in FIG. 1.
Figure 5:
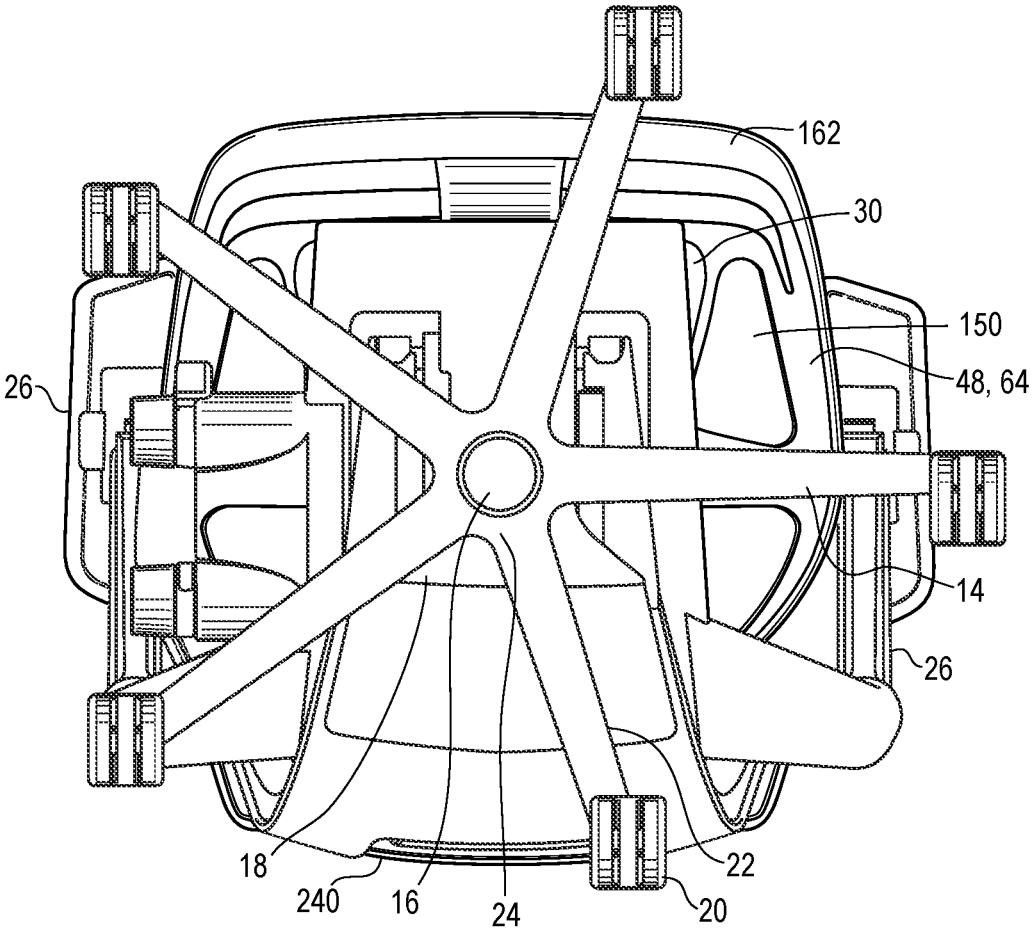
FIG. 5 is a bottom view of the body support assembly shown in FIG. 1.
Figure 6:
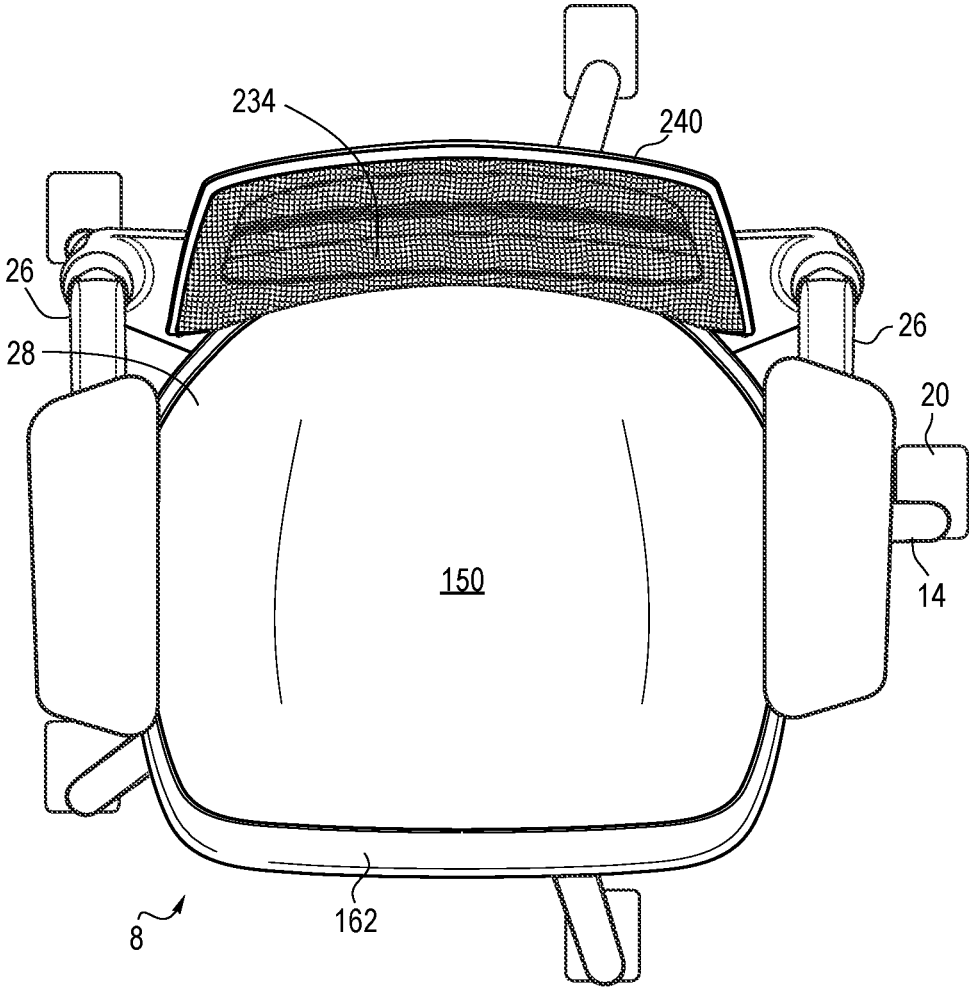
FIG. 6 is a top view of the body support assembly shown in FIG. 1.

It should be understood that the term "plurality," as used herein, means two or more. The term "longitudinal," as used herein means of or relating to a length or lengthwise direction 2, 2', for example a direction running from the bottom of a backrest assembly 6 to the top thereof, or vice versa, or from the front of a seat assembly 8 to the rear thereof, or vice versa. The term "lateral," as used herein, means situated on, directed toward or running in a side-to-side direction 4 of a body support assembly 10, shown in one embodiment as an office chair including the backrest assembly 6 and seat assembly 8. It should be understood that the body support assembly may be configured as any structure that supports a body, including without limitation automotive, aircraft and mass-transit seating, beds, home furnishings (including sofas and chairs), and other similar and suitable structures. In one embodiment of a backrest assembly disclosed below, a lateral direction 4 corresponds to a horizontal direction and a longitudinal direction 2 corresponds to a vertical direction, while in one embodiment of a seat assembly, the longitudinal direction 2' corresponds to a horizontal direction. The lateral direction 4 may be referred to as an X direction, while the longitudinal direction 2, 2' refers to a Y direction and a Z direction is orthogonal to the body support surface of both the backrest and seat assemblies 6, 8.

The term "coupled" means connected to or engaged with, whether directly or indirectly, for example with an intervening member, and does not require the engagement to be fixed or permanent, although it may be fixed or permanent. The terms "first," "second," and so on, as used herein are not meant to be assigned to a particular component so designated, but rather are simply referring to such components in the numerical order as addressed, meaning that a component designated as "first" may later be a "second" such component, depending on the order in which it is referred. It should also be understood that designation of "first" and "second" does not necessarily mean that the two components or values so designated are different, meaning for example a first direction may be the same as a second direction, with each simply being applicable to different components. The terms "upper," "lower," "rear," "front," "fore," "aft," "vertical," "horizontal," "right," "left," and variations or derivatives thereof, refer to the orientations of an exemplary body support assembly 10, shown as a chair in FIGS. 1-6 and 22-36, from the perspective of a user seated therein. The term "transverse" means non-parallel. The term "outwardly" refers to a direction facing away from a centralized location, for example the phrase "radially outwardly" refers to a feature diverging away from a centralized location, for example the middle or interior region of a seat or backrest, and lies generally in the X Y plane defined by the lateral and longitudinal directions 2, 2', 4. It should be understood that features or components facing or extending "outwardly" do not necessarily originate from the same centralized point, but rather generally emanate outwardly and exteriorly along a non-tangential vector. Conversely, the term "inwardly" refers to a direction facing toward the centralized or interior location.

The term "textile material" refers to a flexible material made of a network of natural or artificial fibers (yarn, monofilaments, thread, etc.). Textile materials may be formed by weaving, knitting, crocheting, knotting, felting, or braiding. Textile materials may include various furniture upholstery materials, which may be used for example to cover a foam cushion, and/or suspension materials, which may be stretched or put in tension across an opening to support a user.

Body Support Assembly:

Referring to FIGS. 1-6, 22-36 and 77, the body support assembly 10 is shown as including a tilt control assembly 18, also referred to as a lower support structure, a base structure 12 and the backrest and seat assemblies 6, 8. In one embodiment, the base structure 12 includes a leg assembly 14 and a support column 16 coupled to and extending upwardly from the leg assembly. The tilt control assembly 18 is supported by and coupled to a top of the support column 16. The leg assembly may alternatively be configured as a fixed structure, for example a four legged base, a sled base or other configuration. In one embodiment, the support column 16 may be height adjustable, including for example and without limitation a telescopic column with a pneumatic, hydraulic or electro-mechanical actuator. The leg assembly 14 includes a plurality of support legs 22 extending radially outwardly from a hub 24 surrounding the support column. Ends of each support leg may be outfitted with a caster, glide or other floor interface member 20.

Armrest Assembly:

In the embodiment of FIGS. 1-6, a pair of armrest assemblies 26 are coupled to the tilt control assembly 18. Various user interface controls 28 are provided to actuate and/or adjust the height of the seat, including for example an actuation lever pivotally coupled to the armrest assembly, or to control the tension and/or return force of the tilt control assembly 18, as further disclosed below.

Referring to FIGS. 22-36, 91A and B, another embodiment of an armrest assembly 300 is coupled to the base structure 12. The armrest assembly includes a base portion 302 disposed above the support column 16, and positioned between the base structure and seat assembly 6, and in particular above a longitudinally extending portion, or base link 33, of a lower support structure 18. A platform 402 supports the tilt control assembly 18, including a housing 422, which has a hub portion 405 receiving the support column. 16. A cover 900 extends around the housing, with the base portion 302 disposed on top of the cover 900 and covering the housing 522. The base portion 302 is coupled to the platform with one or more fasteners, shown as bolts, which clamp the housing 422 and lower portion 400 of the tilt control assembly 18 therebetween.

Figure 24:
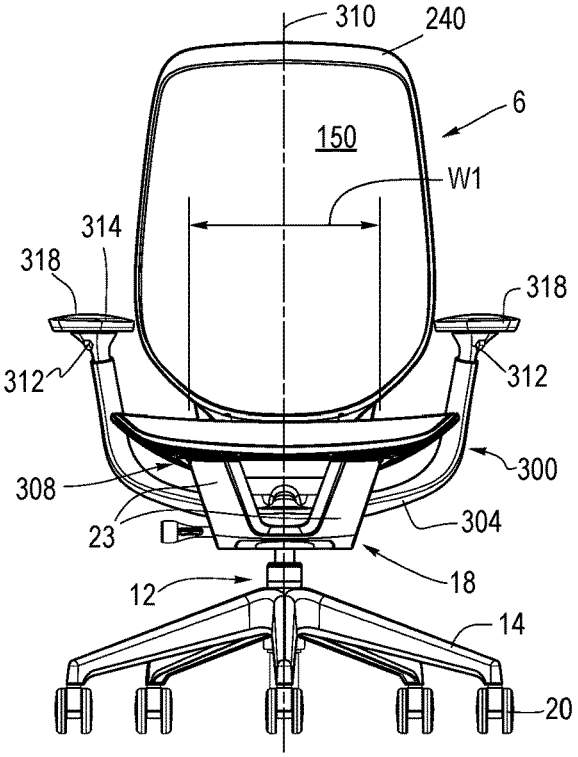
FIG. 24 is a front view of the body support assembly shown in FIG. 22.
Figure 26:
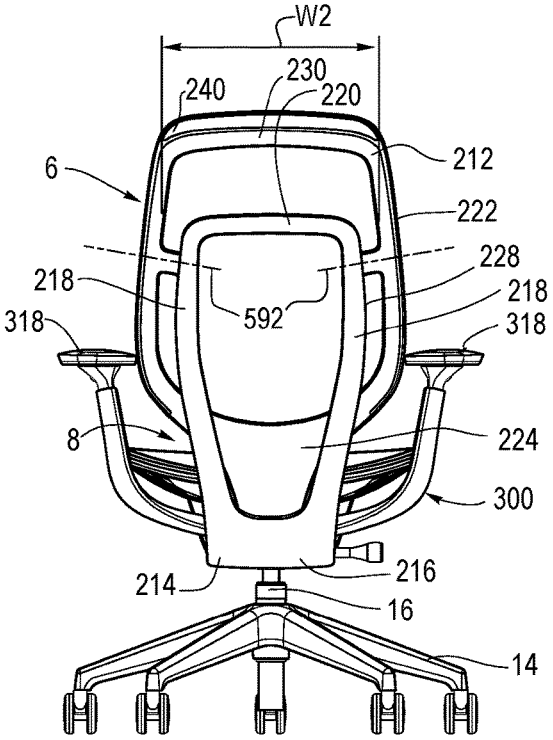
FIG. 26 is a rear view of the body support assembly shown in FIG. 22.
Figure 27:
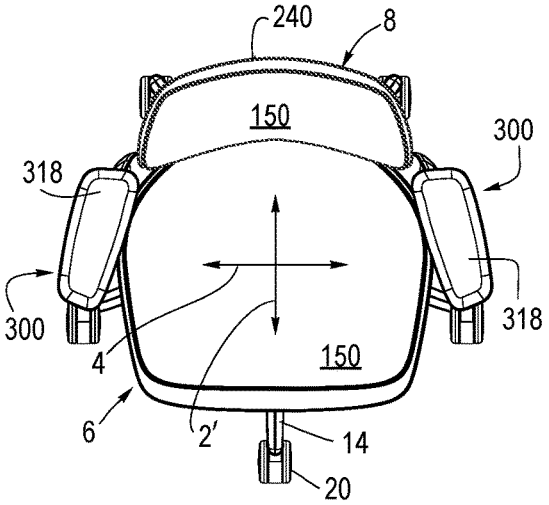
FIG. 27 is a top view of the body support assembly shown in FIG. 22.
Figure 28:
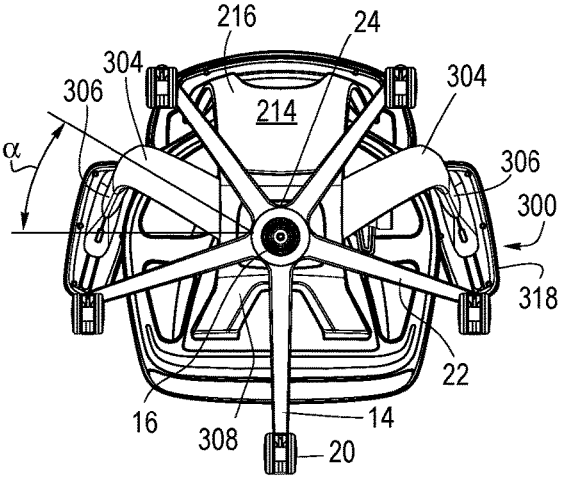
FIG. 28 is a bottom view of the body support member shown in FIG. 22.
Figure 29:
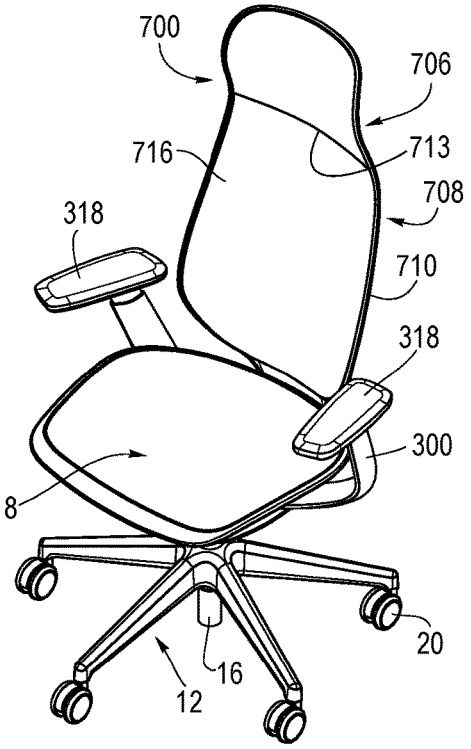
FIG. 29 is a front perspective view of a third embodiment of a body support assembly.
Figure 30:
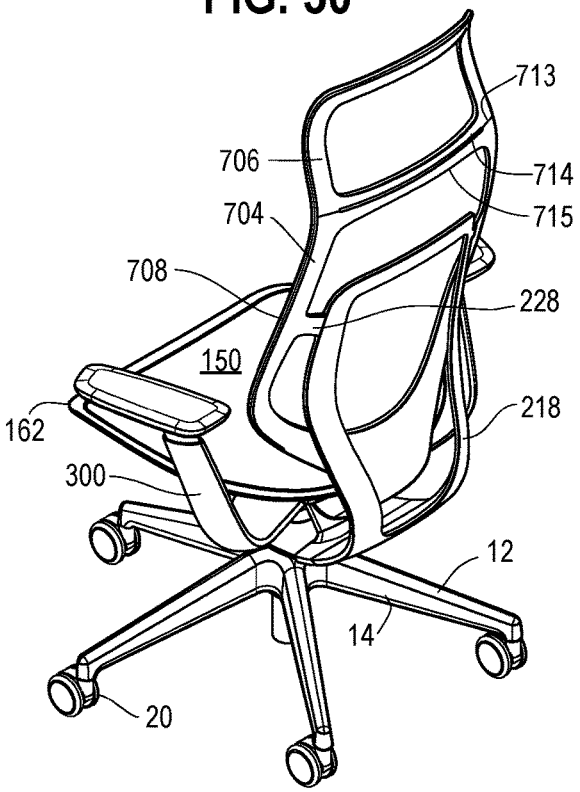
FIG. 30 is a rear perspective view of the body support assembly shown in FIG. 29.
Figure 31:
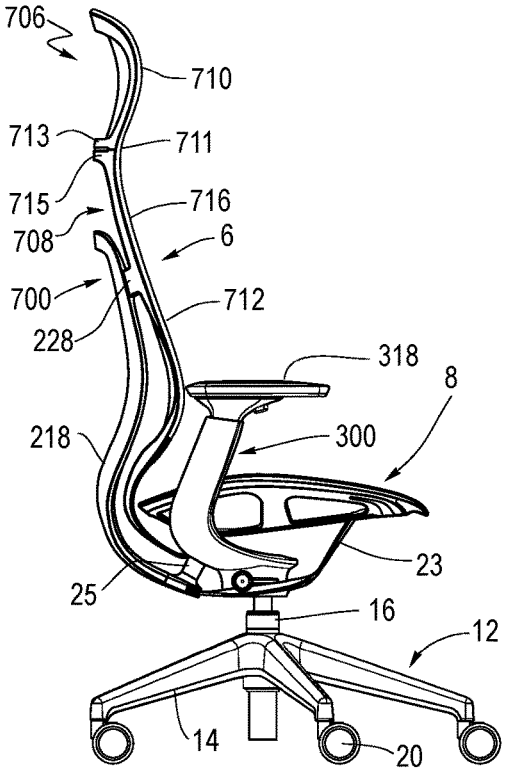
FIG. 31 is a right side view of the body support assembly shown in FIG. 29.
Figure 32:
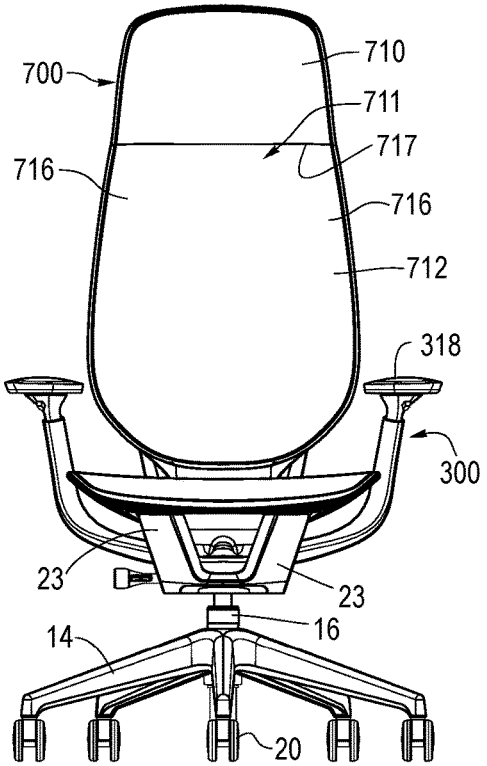
FIG. 32 is a front view of the body support assembly shown in FIG. 29.
Figure 33:
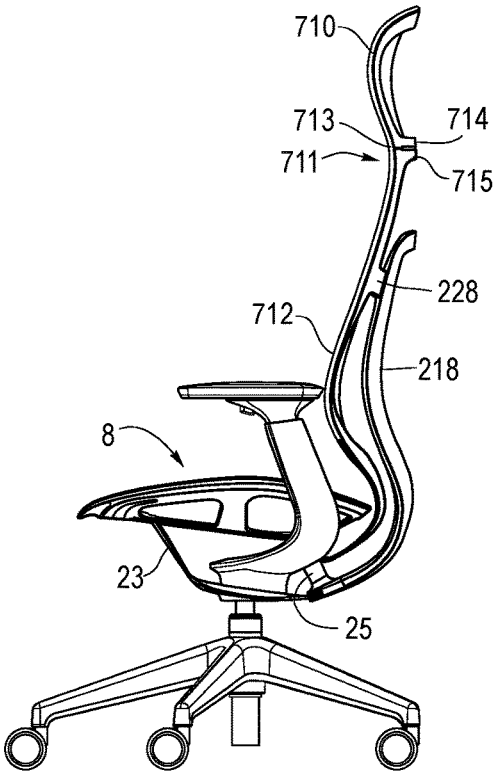
FIG. 33 is a left side view of the body support assembly shown in FIG. 29.
Figure 34:
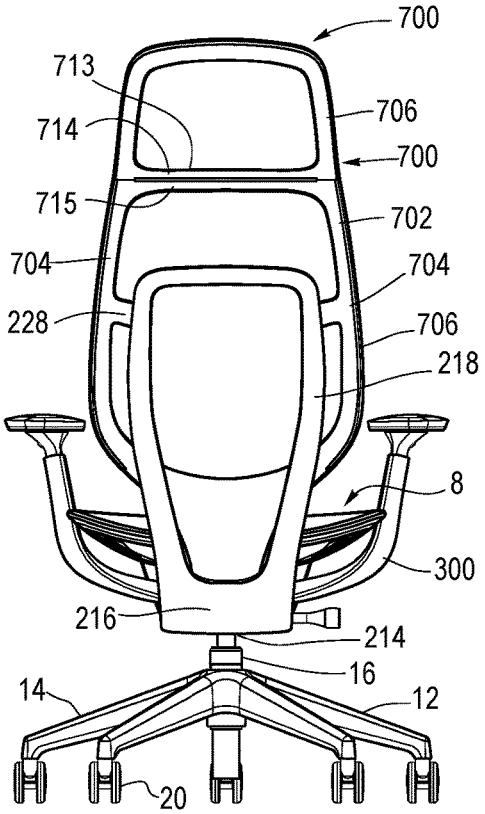
FIG. 34 is a rear view of the body support assembly shown in FIG. 29.
Figure 35:
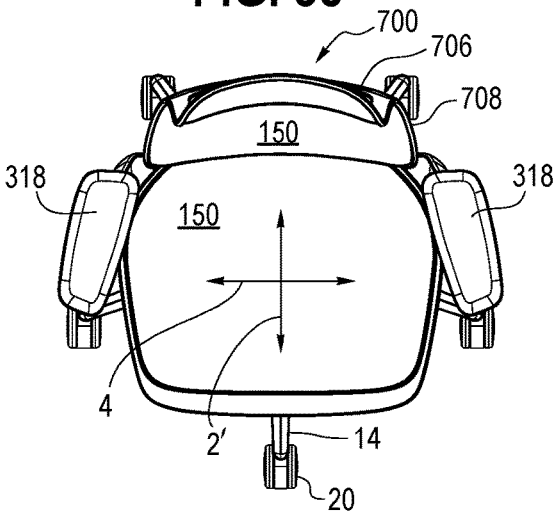
FIG. 35 is a top view of the body support assembly shown in FIG. 29.
Figure 36:
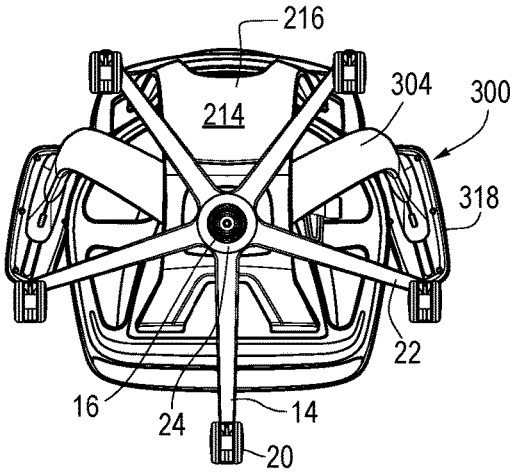
FIG. 36 is a bottom view of the body support member shown in FIG. 29.
Figure 73A:
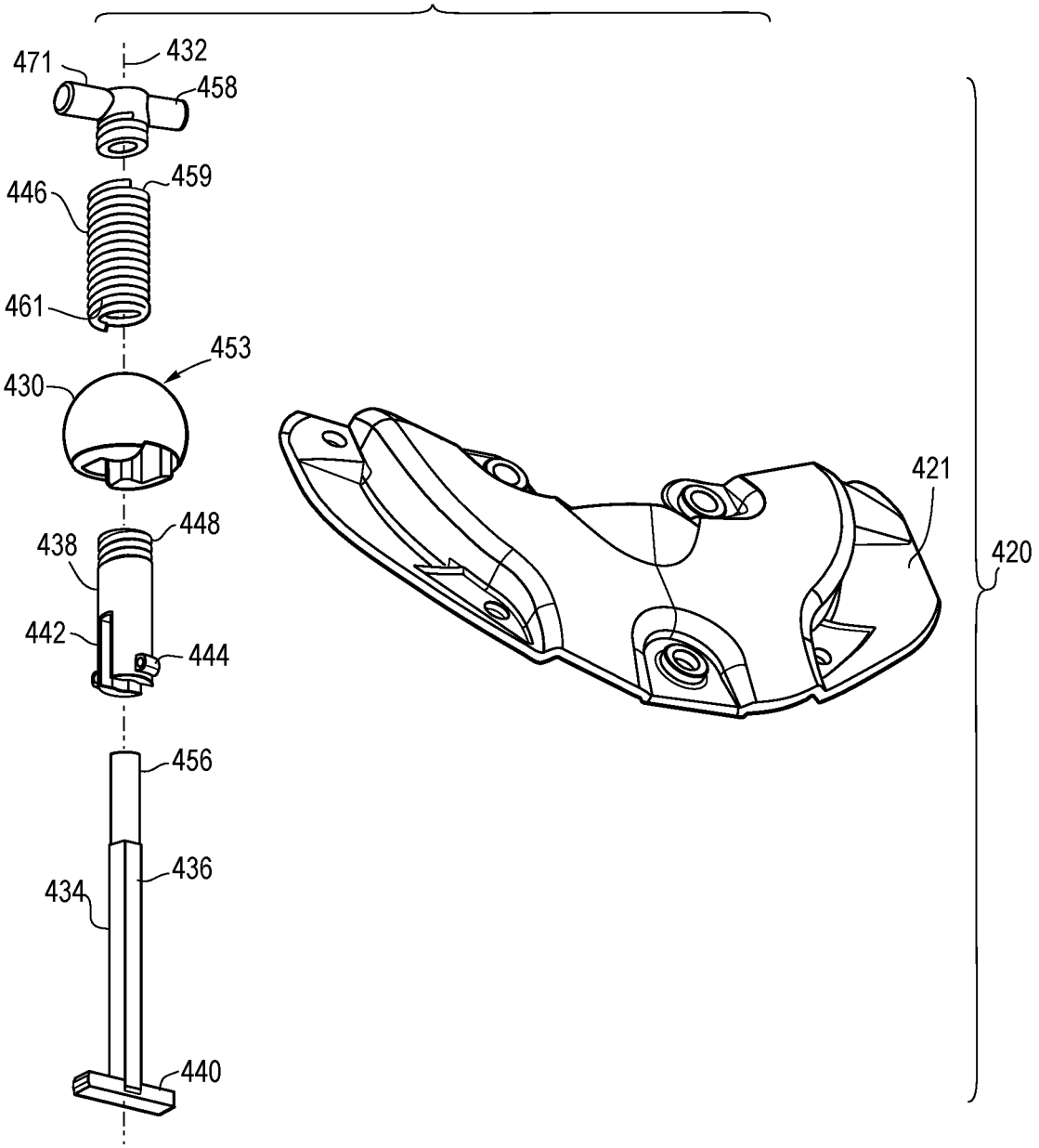
FIG. 73A-C are exploded partial views of the control assembly.
Figure 73B:
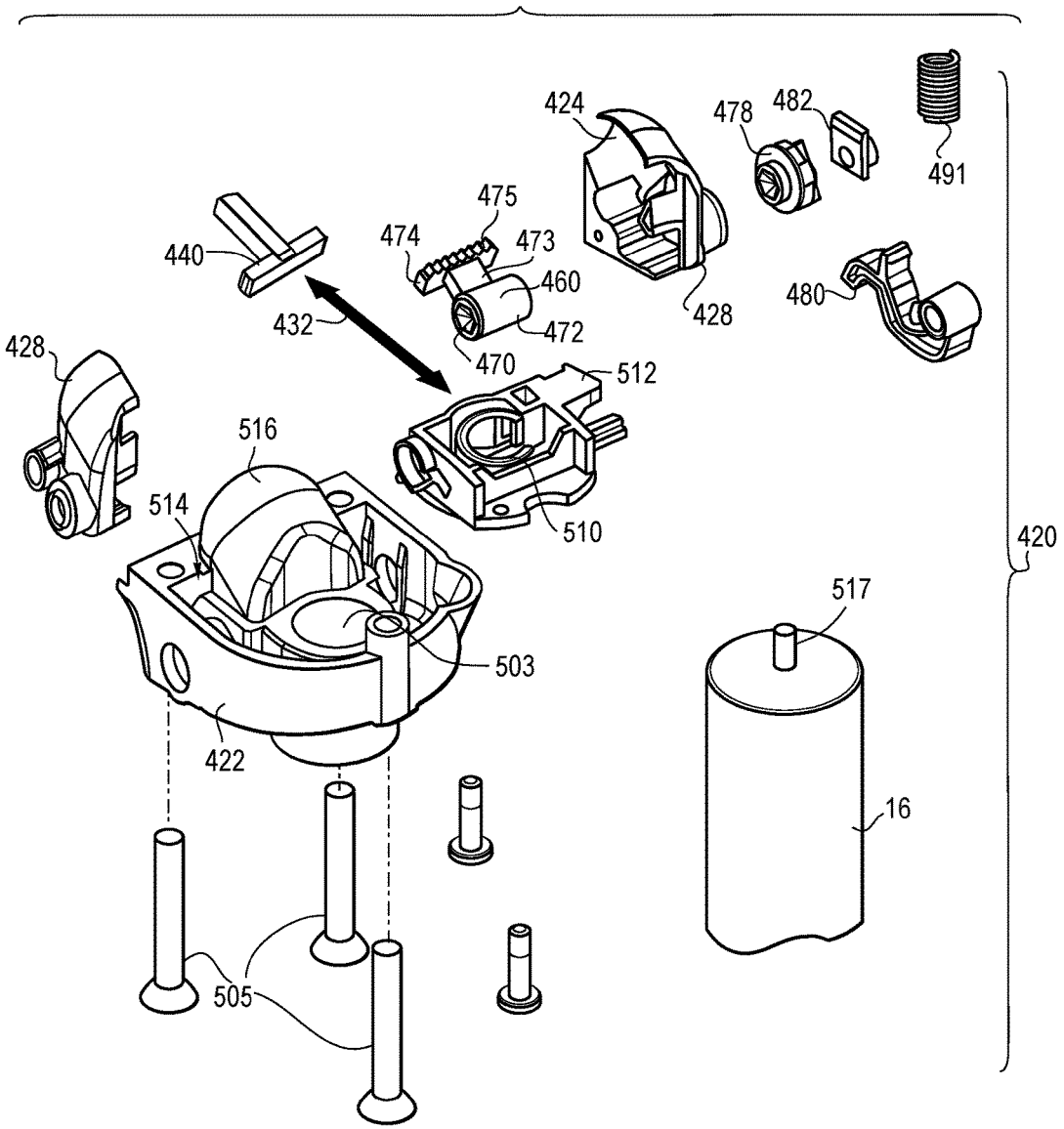
Figure 73C:
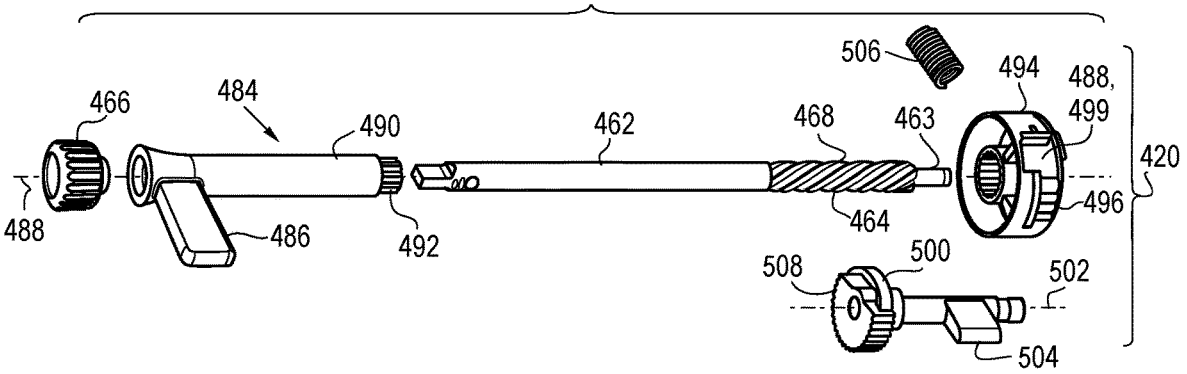

The base portion 302 includes a pair of laterally extending arms 304 disposed between and extending laterally outwardly (vector having portion along axis 4) and rearwardly (vector having portion along axis 2') from the lower support structure 18 and the seat assembly 8, including a seat support member 308, and defining an angle $\alpha$ relative to the lateral direction 4 as shown in FIG. 28. The base includes an upwardly protruding curved or flared portion 423, which overlies the housing 422 at the rear portion thereof. The armrest assembly further includes a pair of upright portions 306 connected to the laterally extending arms 304 and extending upwardly along opposite sides of the seat assembly 8 and seat support member 308 as shown in FIG. 28. The pair of laterally extending arms 304 in combination have a V-shaped configuration when viewed from above as shown in FIG. 28, while the armrest assembly 300 has a U-shape when viewed from the front or rear of the body support assembly as shown in FIGS. 24 and 26. The armrest assembly 300 is rotationally fixed relative to the base 12 about a lateral axis, but rotates with the seat assembly 8 about a vertical axis 310 and moves vertically with the support column 16. The armrest assembly 300 does not tilt with the seat and/or backrest assembly, which are moveable from an upright, nominal position to one or more reclined positions relative to the armrest assembly. It should be understood that the chair may be configured without any armrests on either side, as shown for example in FIGS. 37 and 38. If the armrest assembly is omitted, a cover 421, shown in FIG. 73A, may be bolted to the platform 402 over the housing 422 and cover 900.

Referring to FIGS. 22, 24, 25, 60-70 and 91B, the upright portions of the armrest assembly define an armrest support supporting a height adjustable upper arm 312 having an upper support platform 314. An actuation button 321 may be depressed to allow the upper arm 312 to move vertically relative to and within the upright portion 306. In an alternative embodiment shown in FIG. 91A, the armrest is not height adjustable, but rather has an upper arm 323 at is flush with and coupled to the upright portion 306. A pair of stops 316, shown as protuberances or posts, extend upwardly from the support platform 314 adjacent opposite sides of the platform 314, with an outboard stop 316 being longitudinally displaced rearwardly relative to an inboard stop such that the stops 316 are diagonally positioned along an axis 329 forming an angle ß relative to a longitudinal axis 317.

Figure 61:
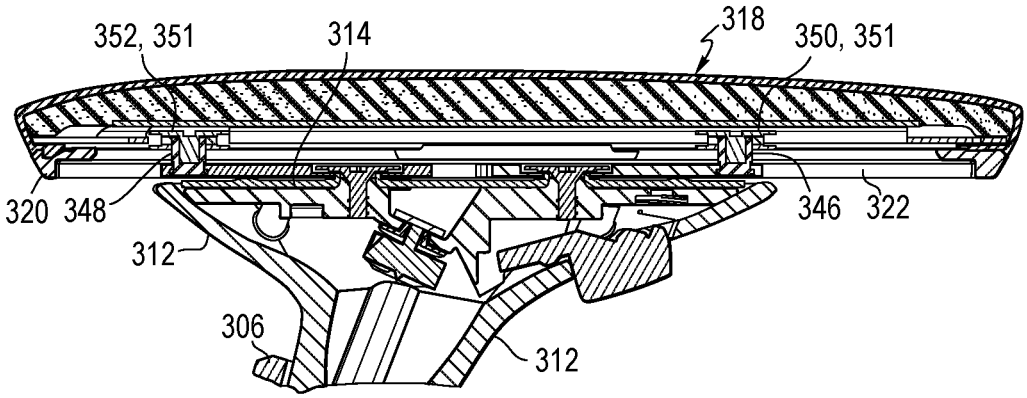
FIG. 61 is a partial, longitudinal cross-sectional view of the armrest assembly shown in FIG. 60.
Figure 62:
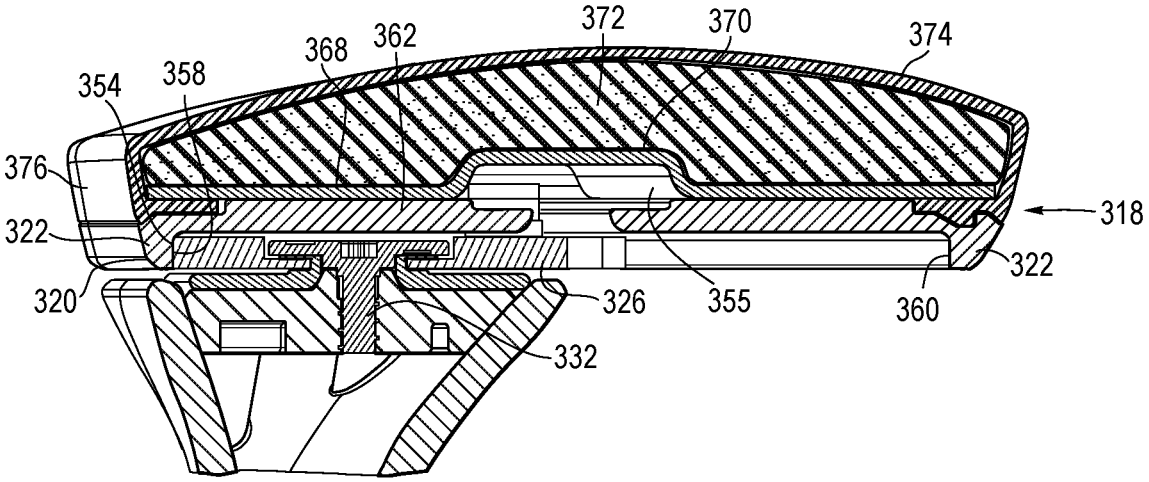
FIG. 62 is a partial, lateral cross-sectional view of the armrest assembly shown in FIG. 60.

An armrest pad 318 is adapted to support a person's arm is coupled to the support platform. The armrest pad 318 has a base 320 with laterally spaced and downwardly extending rim portions 322 positioned along opposite sides of the armrest pad. In one embodiment, the rim portion 322 extends around an entire periphery of the base 320. The base 320 is preferably configured as a plastic plate. A pair of swing arms 324, 326 are provided, with each swing arm having a first end 328, 330 pivotally connected to the upper support platform with a pair of fasteners 332, configured as a screws with washers, that engage openings at spaced apart first locations 334, 336. The locations are spaced apart along the longitudinal axis 317. The swing arms 324, 326 each have a second end 338, 340 pivotally and slidably connected to the armrest pad 318 with a pair of upwardly extending boss structures 342, 344, or studs, having ends engaged by fasteners 350, 352 at spaced apart second locations 346, 348, which move relative to the first locations. The second location 342 is spaced forwardly of the first location 334 while the second location 348 is space rearwardly of the first location 344 when the arm pad is in a nominal position as shown in FIG. 61. The swing arms 324, 326 adjustably support the armrest pad for independent longitudinal, lateral, and rotational adjustment, meaning the armrest pad may be moved along and/or transverse to the longitudinal axis 317, as well as rotated about an axis normal to the plane defined thereby as further explained below.

Figure 60:
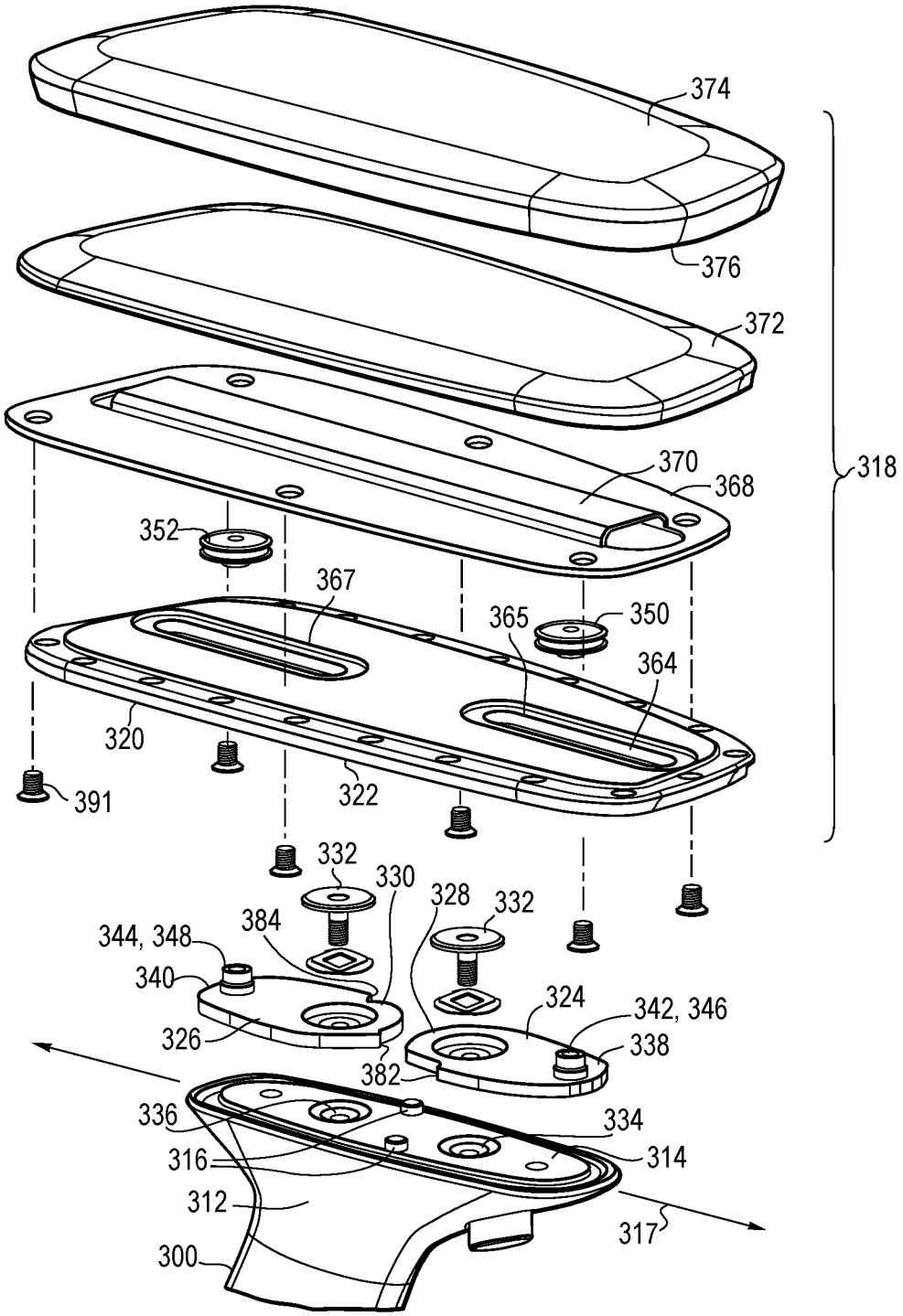
FIG. 60 is an exploded view of an armrest assembly.
Figure 63:
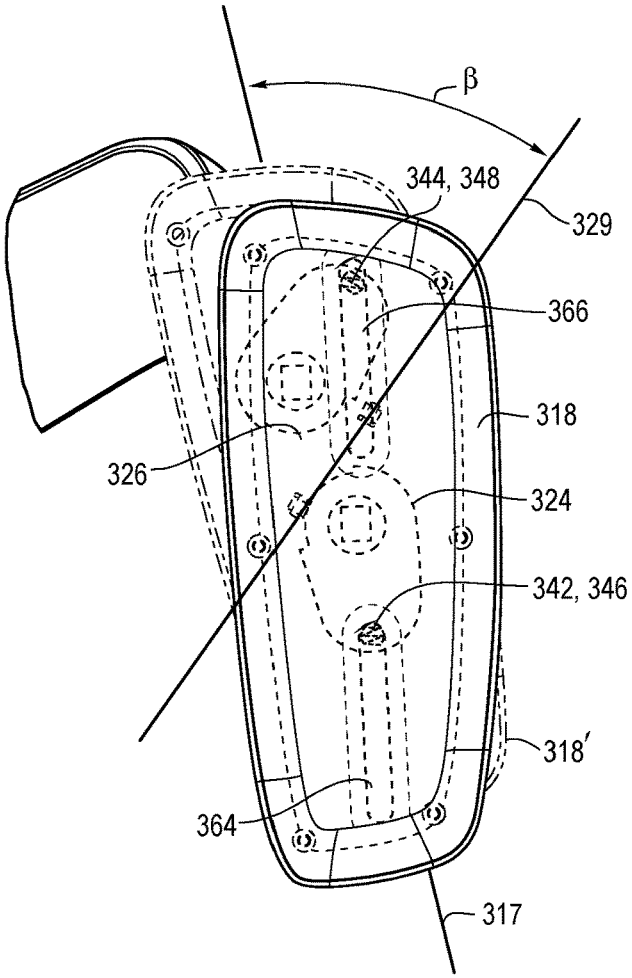
FIGS. 63 and 64 show maximum fore-aft adjustments of the armrest assembly shown in FIG. 60.
Figure 64:
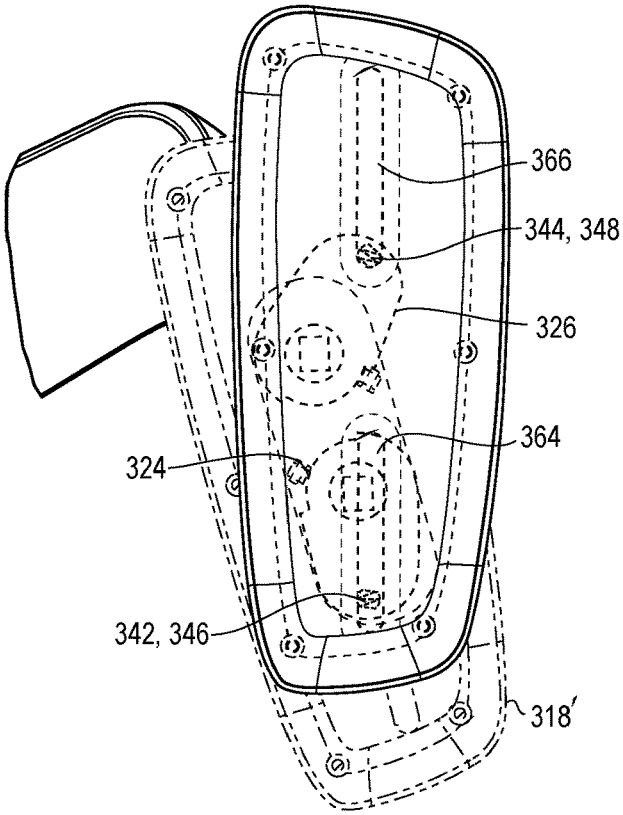

As shown in FIGS. 60, 61, 65 and 66, at least one of the side rim portions 322 has an inner side surface 358, 360 that engages the side surface 354, 356 of at least one of the swing arms 324, 326 to limit inboard and outboard lateral movement of the armrest pad 18 relative to the support platform 314. The pad base 320 has a pair of longitudinally spaced and longitudinally extending slots 364, 366, with the second ends of the pair of swing arms, and the boss structures 342, 344 in particular, disposed through the slots 364, 366. The boss structures 342, 344 are pivotally and translatably/slidably connected relative to the pad base 320 along the slots 364, 366. As shown in FIGS. 60, 63 and 64, the boss structures 342, 344 bottom out at the ends of the slots 364, 366 to limit the fore-aft travel of the armrest pad 318 relative to the support platform 314. The fasteners 350 have enlarged head portions, which function as a pair of guides 351 that are coupled to the second ends 338, 340 of the pair of swing arms and are disposed on top of the pad base within a recessed portion 365, 367 surrounding the periphery of the slots 364, 366, with the guides 351 providing for relative translation/sliding and rotation of the pad base 320 relative to the swing arms 324, 326.

The armrest pad includes a plate 368, preferably steel, having a longitudinal track 370 running along the bottom of the plate 368 and formed by a raised portion of the plate. The track 370 defines a channel overlying the fasteners 350, with a width and depth dimensioned to accommodate the fasteners 350 within the channel and thereby allowing slidable movement of the arm cap 318 in a longitudinal direction 317 as the bosses 342, 344 move in the slots 364, 366 and the fasteners 350 move in the track 370. The plate 368 is coupled to the base 320 with a plurality of fasteners 391, shown as six, with the fasteners 350 trapped between the base 320 and plate 368 and moveable in the recesses 365, 367 and the track 370. The interaction between the rotatable swing arms 324, 326 and the slideable/translatable armrest pad 318 allows the armrest pad 318 to be moved to a number of different positions relative to the support platform 314. In particular, the armrest pad 318 is moveable from a nominal position, designated as armrest pad 318', to an infinite number of positions, including: (1) maximum inwardly turned angles Θ, (e.g. 31.5 degrees in one embodiment) at rear and forward location (FIGS. 67 and 68), (2) maximum outwardly turned angle ϕ (e.g., 31.9 degrees in one embodiment) at a rear and forward locations (FIGS. 69 and 70), (3) nominal fore aft extremes (FIGS. 63 and 64), having a total travel of 62.52 mm in a longitudinal direction (47.24 mm rearward and 15.28 mm forward), and (4) side-to-side extremes (FIGS. 65 and 66), having a total travel of 46 mm (25 mm outboard and 21 mm inboard). The stops 316 engage stops 382, 384 formed on peripheral edge of the swing arms 324, 326 to limit the maximum inward and outward angular adjustments as shown in FIGS. 60 and 67-70.

In operation, the fasteners 350, or guides 351, are moveably disposed in the track 370 between the plate 368 and base 320, such that the plate 368 and base 320 are slidable relative to the support platform 314 as shown in FIGS. 63, 64 and 67-70. A foam pad 372 is disposed on top of the plate 368. A cover 374 is disposed over the foam pad and has a peripheral edge portion 376 surrounding the foam pad and plate to secure the foam pad 372 to the plate 368 and complete the assembly of the armrest pad 318. A lip 378, or insert portion, extends laterally and radially inwardly from the edge portion 376 and is disposed between the plate 368 and the pad base 320. In one embodiment, the cover 374 is made of a urethane material.

Figure 65:
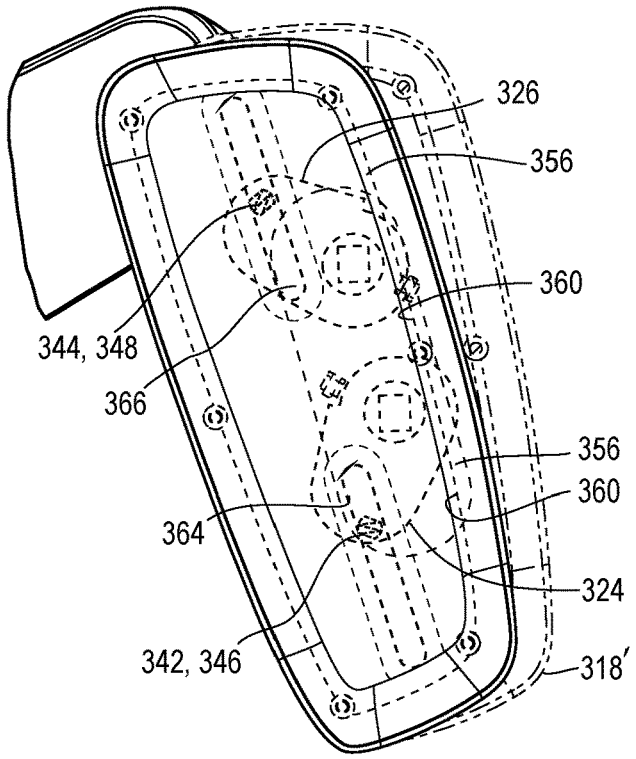
FIGS. 65 and 66 show maximum side-to-side adjustments of the armrest assembly shown in FIG. 60.
Figure 66:
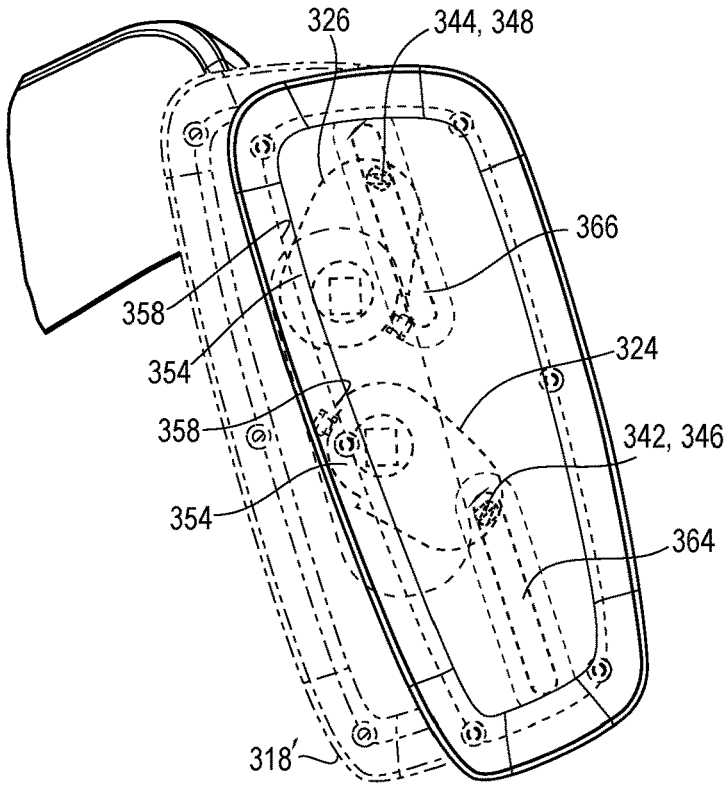
Figure 67:
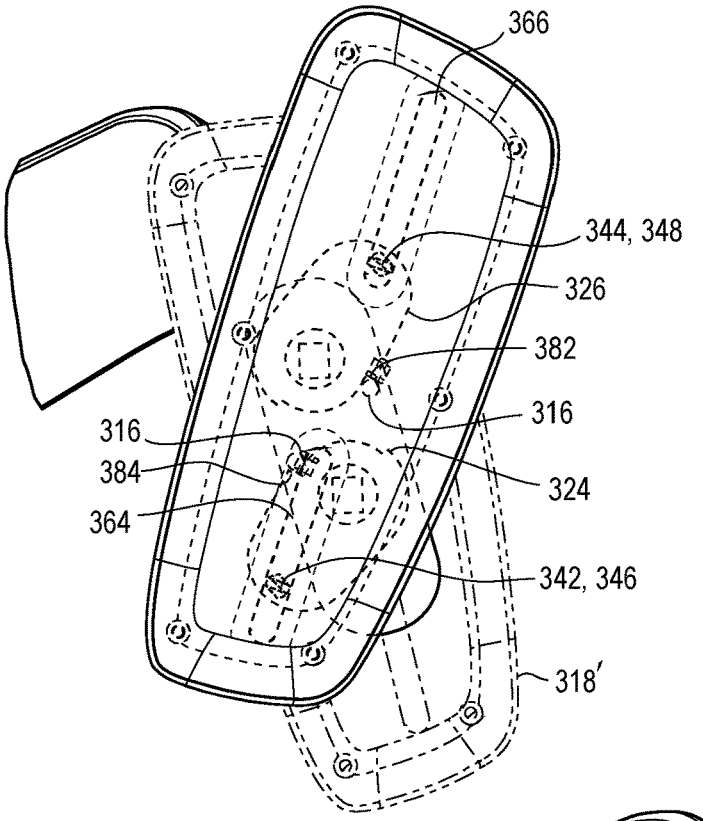
FIGS. 67 and 68 show maximum inward angular adjustments of the armrest at maximum fore-aft positions.
Figure 68:
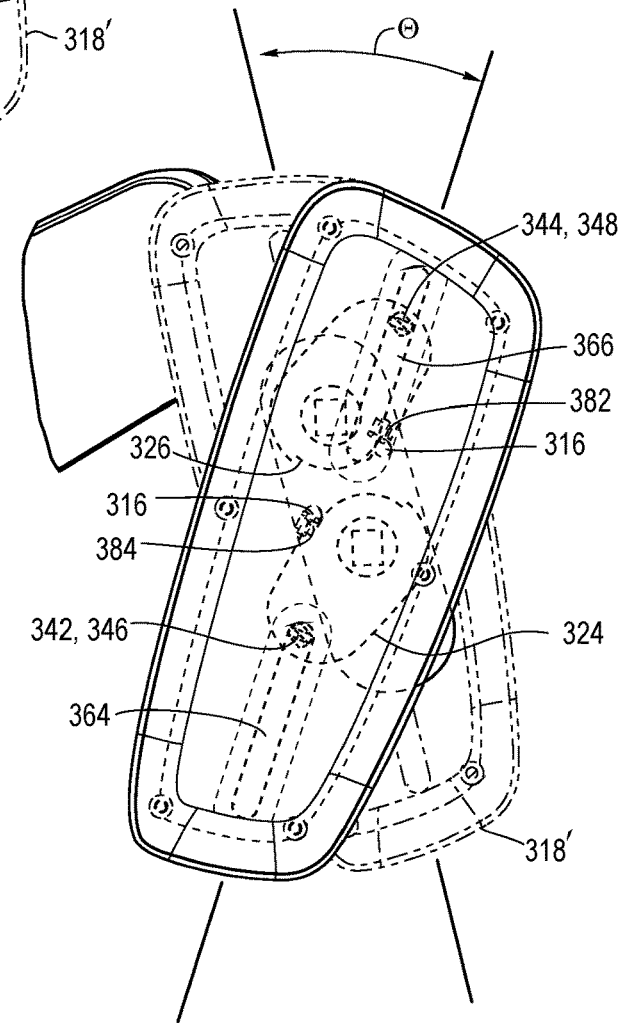
Figure 69:
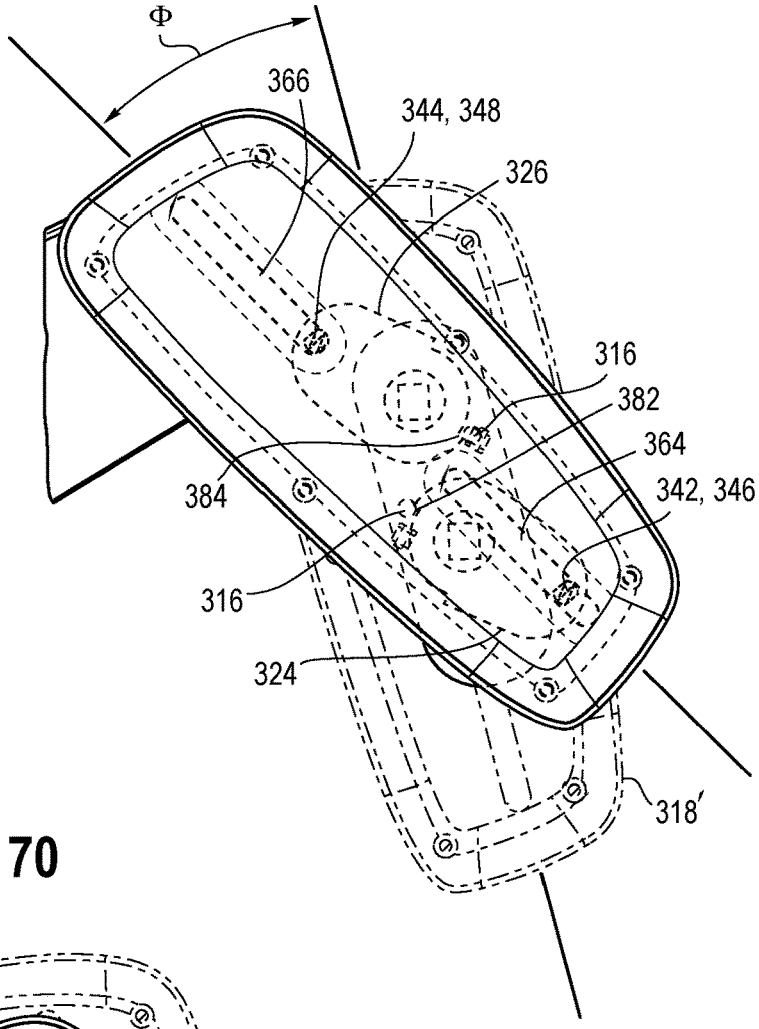
FIGS. 69 and 70 show maximum outward angular adjustments of the armrest at maximum fore-aft positions.
Figure 70:
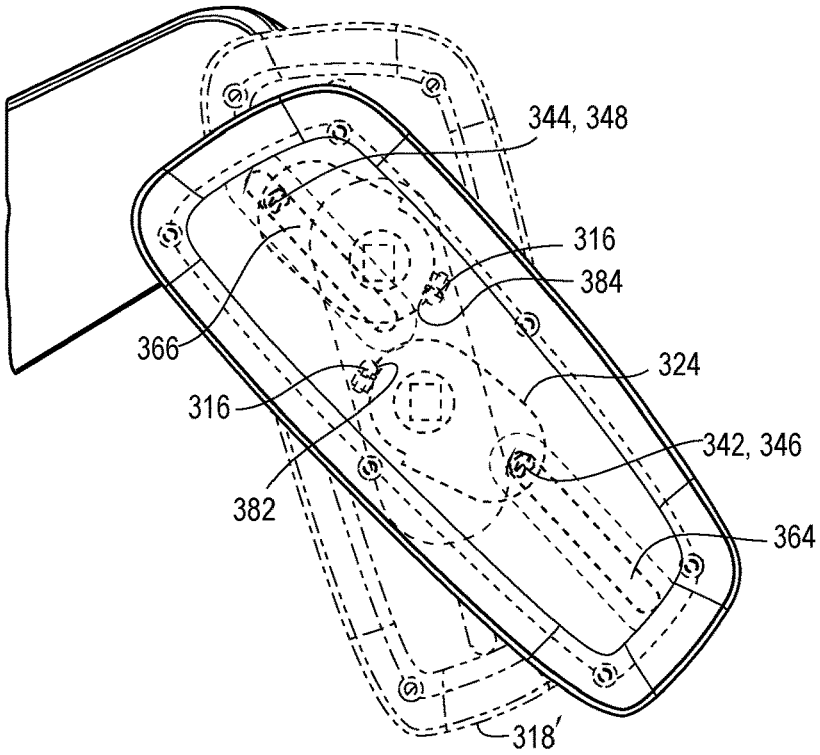
Figure 71:
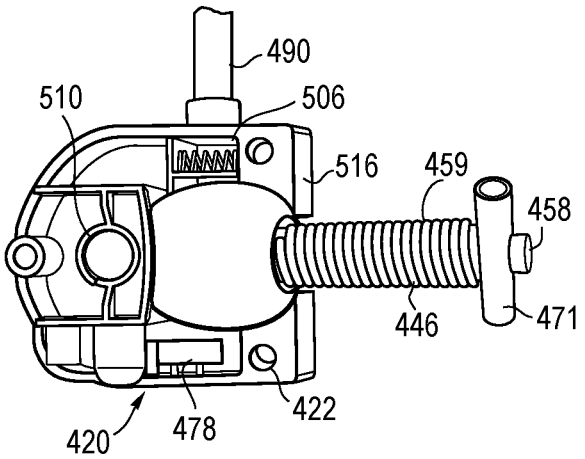
FIG. 71 is a top view of a control assembly.
Figure 72:
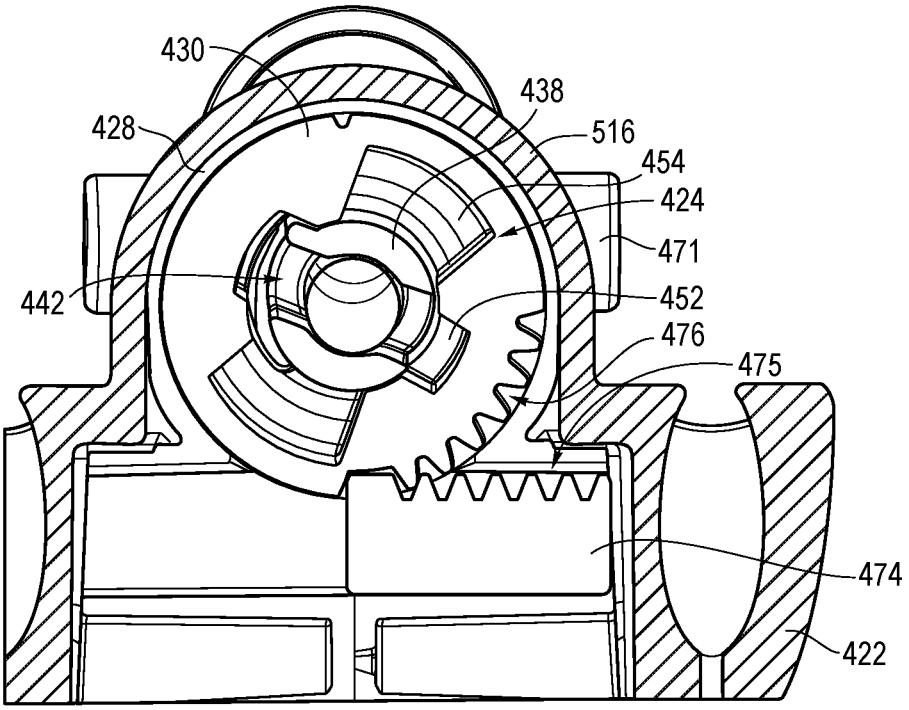
FIG. 72 is a cross-sectional view of a rotatable recline limiter engaged by a linear rack.

The downwardly extending rim 322, which acts as a stop that engages the sides 354, 356 of the swing arm(s) to limit the amount of side-to-side travel, prevents the platform 314 and swing arms 324, 326 from being exposed to view during use. As shown in FIGS. 65 and 66, the armrest pad 318 overlies and covers the upper surface of the support platform 314 in the maximum side-to-side extremes, and referring to FIGS. 63-70, overlies and covers the upper surface of the support platform 314 in virtually all positions of the armrest pad, including the side-to-side and front-to-back maximum extremes, with the exception of a small portion of the support platform being visible in a maximum in-turned positions at fore and aft locations as shown in FIGS. 67 and 68, and the out-turned position of FIG. 69.

Tilt Control Assembly:

Referring to FIGS. 1-6, 22-38, 43, 77, 78, and 83A-84D, the backrest and seat assemblies 6, 8 are operably coupled to the tilt control assembly 18, or lower support structure, which controls the movement thereof, for example during recline. One embodiment of a suitable tilt control assembly is disclosed in U.S. Pat. No. 9,826,839, entitled "Chair Assembly with Upholstery Covering," the entire disclosure of which is hereby incorporated herein by reference. The tilt control assembly may include a plurality of rigid control links, which may be mechanically connected, for example via pivot pins, to form a linkage assembly, including for example a four-bar linkage.

In other embodiments, the tilt control assembly include integrally formed links 23, 25, 33, configured for example with strategic deformable locations that allow for predetermined deformations and define "flex regions," otherwise referred to as "flex joints," or virtual pivot locations. The various configurations of the links and flex regions may be configured as shown and disclosed in U.S. Pub. No. 2016/0296026 A1, entitled "Seating Arrangement," and in U.S. Pub. No. 2018/0352961, entitled "Seating Arrangement and Method of Construction," the entire disclosures of which are hereby incorporated herein by reference.

Figure 21:
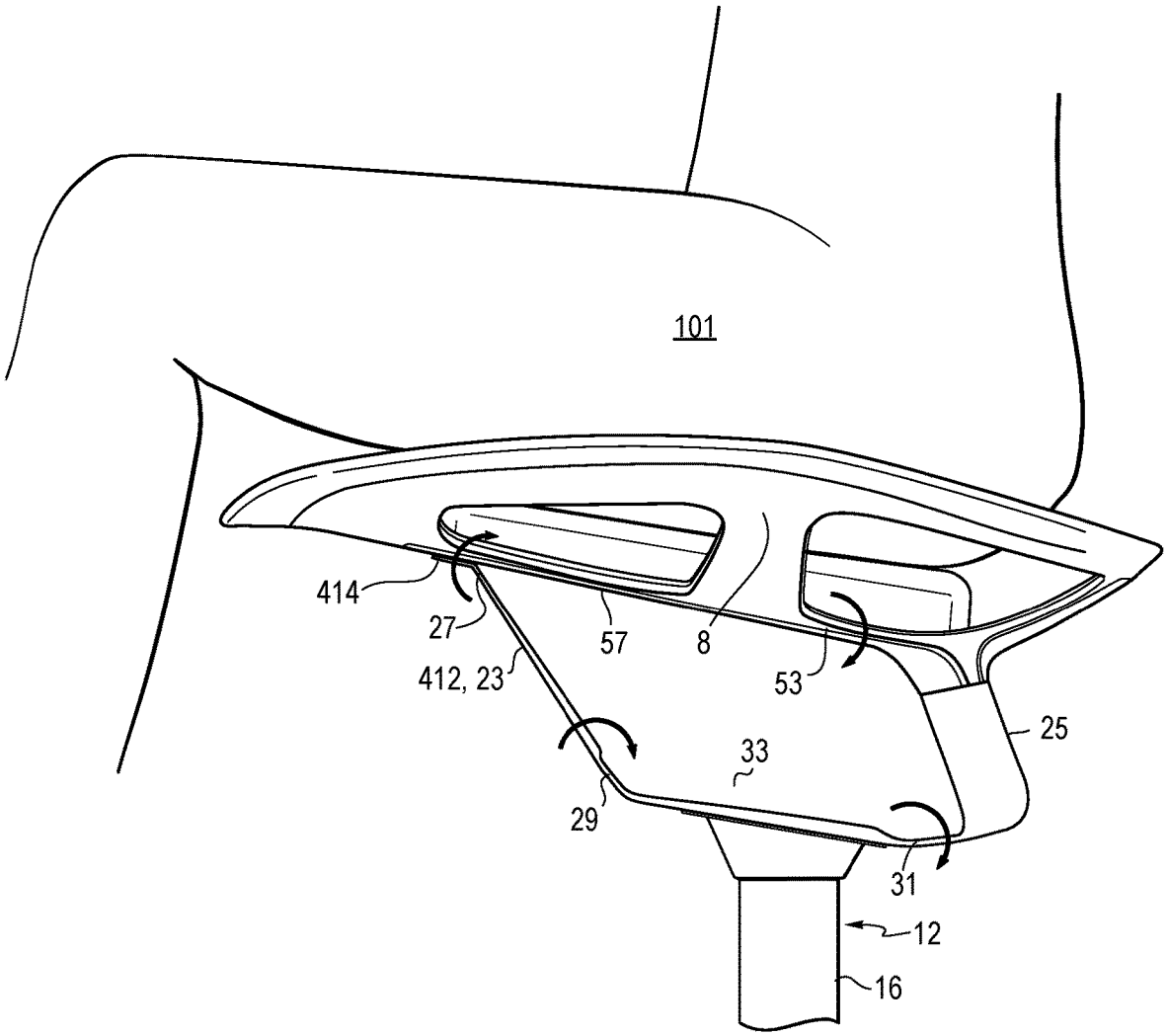
FIG. 21 is a schematic view showing a four-bar mechanism supporting a seat assembly.
Figure 22:
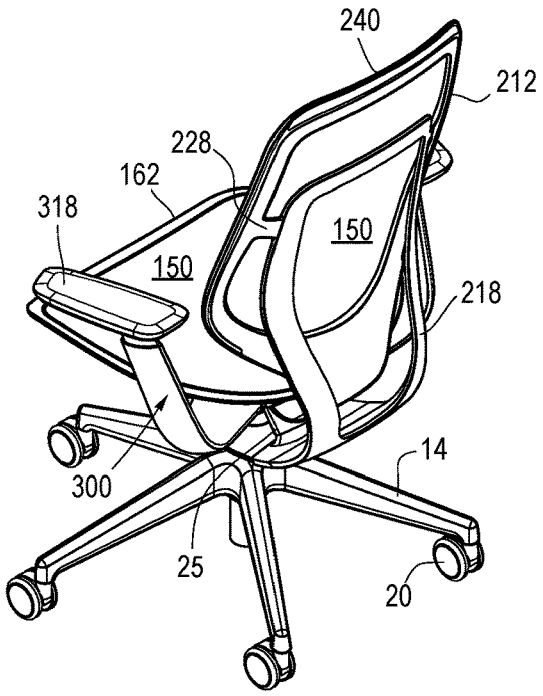
FIG. 22 is a rear perspective view of second embodiment of a body support assembly.
Figure 23:
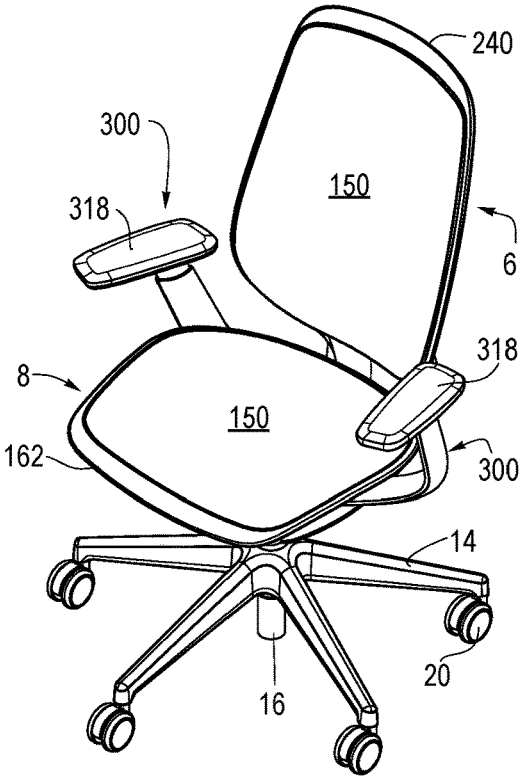
FIG. 23 is a front perspective view of the body support assembly shown in FIG. 22.
Figure 43:
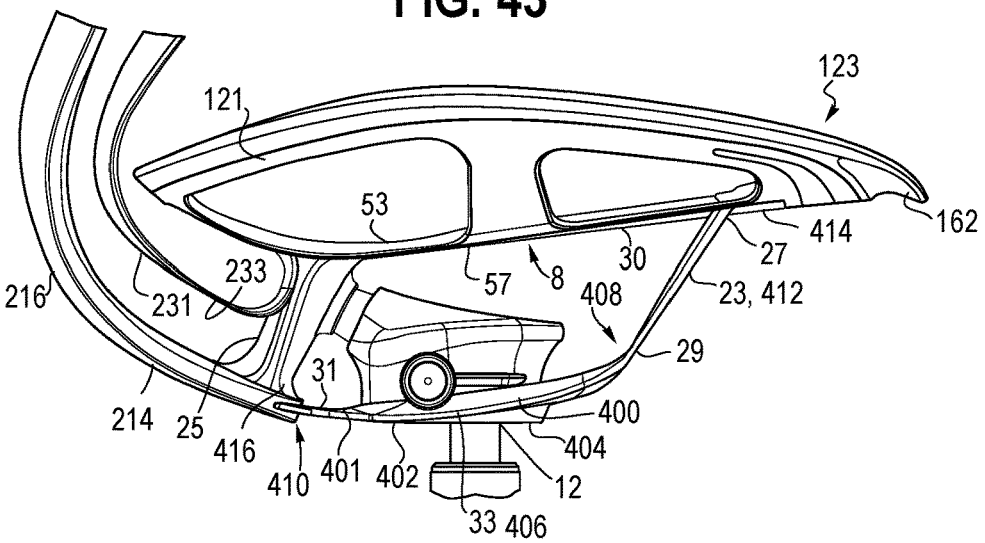
FIG. 43 is an enlarged, partial side view of the body support assembly shown in FIG. 37.

For example, the tilt control assembly 318 may be configured as a four-bar mechanism as shown in FIGS. 21 and 43, with a bottom, or base link 33 connected to the base structure 12 at a first location, and front and rear links 23, 25 connected between the base link and the seat assembly 8. The base, front and rear links 33, 23, 25 define the lower support structure. For example, the front and rear links 23, 25 may be pivotally or bendably connected to the base link 33 at flex regions 29, 31, whether integrally formed or otherwise. The front and rear links 23, 25 may also be pivotally, or bendably connected to the seat assembly 8 at flex regions 27, 53, with the portion 57 of the seat assembly extending between the flex regions 27, 53 defining a link of the four-bar mechanism. The flex region 53 is formed in the support platform 30 portion of the seat assembly as explained in more detail below. The various flex regions 27, 29, 31, 53 may be formed as living hinges, or thin flexible hinges made from the same material as the two more rigid pieces the living hinge connects, so as to provide for relative rotation or pivoting between the more rigid pieces by bending of the living hinge. It should be understood that in alternative embodiments, the links and bars of the mechanism may also be configured as rigid links and bars connected at fixed hinge points.

Figure 93:
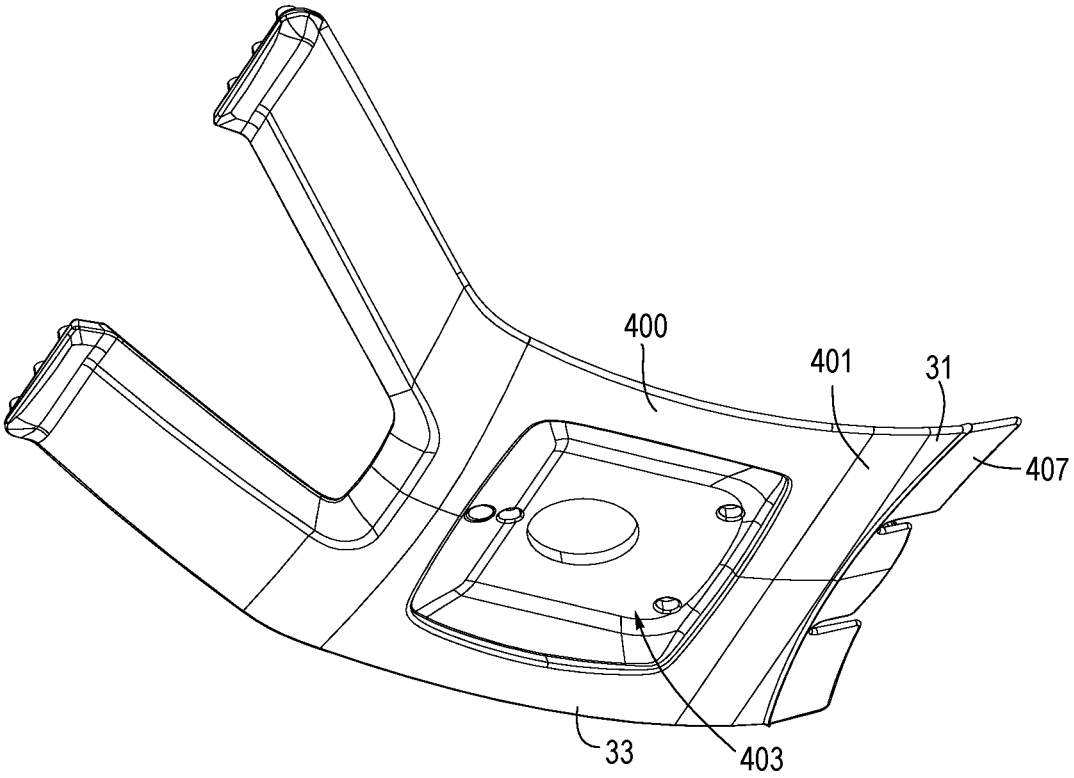
FIG. 93 is a bottom perspective view of a lower support structure.
Figure 94:
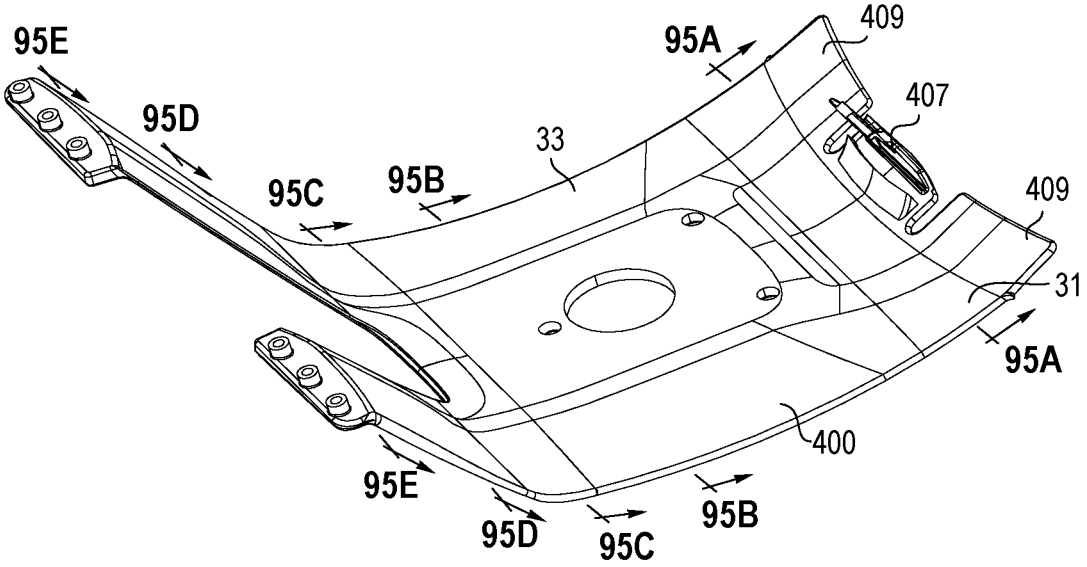
FIG. 94 is a top perspective view of the lower support structure shown in FIG. 93.

In one embodiment, and referring to FIGS. 37, 38, 43, 78, and 93-95E, the tilt control assembly 318, or lower support structure, includes a longitudinally extending portion 400 that extends fore aft along the longitudinal axis 2', and which defines the base link 33. The longitudinally extending portion 400 is supported by the platform 402, configured as a plate member, with an opening that receives the hub portion 405 of the housing 422, positioned at a first location 406. The hub is shaped to receive the upper end of the support column 16, which extends through the opening. The portion 400 has a recess 403 defined in the bottom thereof as shown in FIGS. 93 and 95B, with a thinner central portion 405 and thicker outboard portions 509, with the platform 402 disposed in the recess 403.

Figure 42:
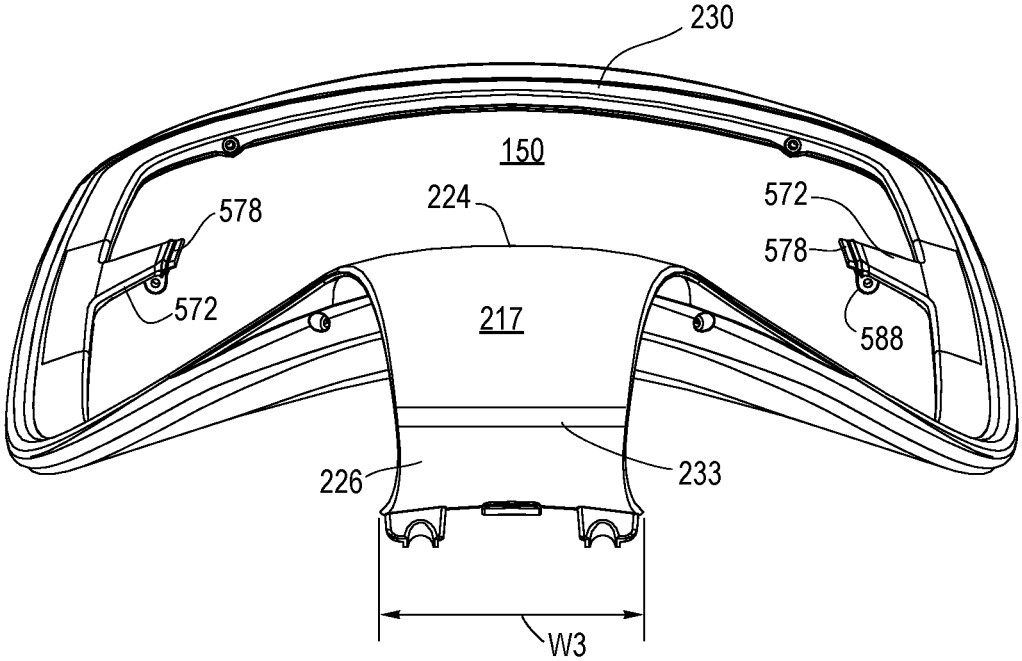
FIG. 42 is a bottom view of the back support shown in FIG. 39.

The pair of laterally spaced front links 23 extend upwardly and forwardly from the longitudinally extending portion 400 at a location 408 positioned forwardly of the first location 406. The front links 23 have a maximum lateral width (W1), defined by the laterally spaced outboard edges thereof, as shown in FIG. 24. The rear link 25 also extends upwardly and forwardly from the longitudinally extending portion 400, but at a location 410 positioned rearwardly of the first location 404. The rear link 25 has a maximum lateral width defined by the laterally spaced outboard surfaces thereof, which is substantially equal to the width (W3) of the lower support 226 of the back support 212, as shown in FIG. 42.

Figure 107:
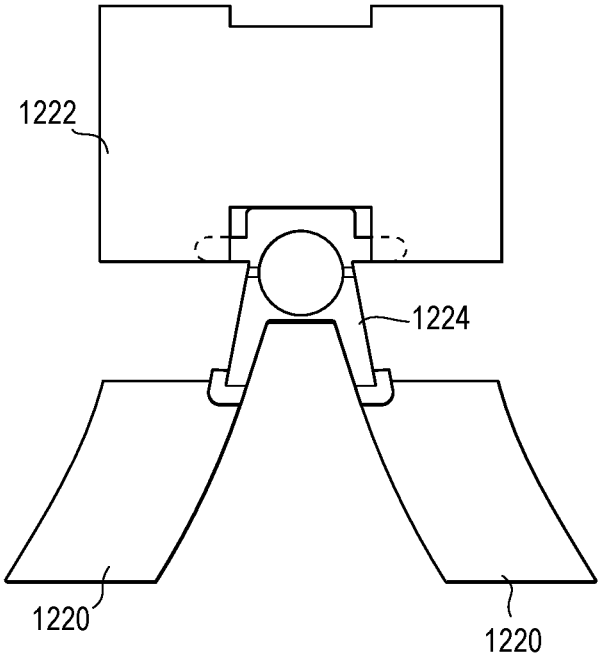
FIG. 107 is a top view of a tape configuration.

The lower support structure may be referred to as a lower shell, with the longitudinally extending portion 400, front link 23, and in one embodiment a portion of the rear link 25, defining an integrally formed structure, which define in turn two or three integrally formed bars (or portions thereof) of the four bar linkage. The lower support structure 400 has strategically positioned tensile substrates 1220, 1222 (shown in FIG. 107), made for example of glass reinforced tape, to accommodate bending and deformation of the structure at the flex regions 29, 31. Strategic locations on the lower support structure are provided with specific geometries that allow for predetermined deformations and define the flex regions 29, 31, otherwise referred to as "flex joints," or virtual pivot locations. As shown in FIG. 107, the tensile substrate 1222 has a "H" shape with elongated side portions having a greater longitudinal length than a central portion thereof. The "H" helps to ensure that the side portions may extend further along the curved transition portion. In one embodiment, the substrates 1220, 1222 are coupled to a central connector body 1224, as shown in FIG. 107, with the subassembly of the connector body 1224 and substrates 1220, 1222 then overmolded with an outer body to define the lower support structure 400, front links 23 and post 407. The substrates 1220 are in-molded along the bottom portion of the front feet of the central connector body, while the substrate 1222 is disposed on top of the rear feet of the connector body, such that the substrates are properly located to undergo tension during recline and use of the chair. The method of making the reinforced support structure further includes positioning a tape carrier having exposed first and second sections of glass fiber tape 1220, 1222 in a mold in a manner such that the first and second sections of tape are spaced apart in different planes within the mold, and molding a shell over the tape carrier and first and second sections of tape, wherein the first section of tape is positioned adjacent an upper surface of the shell and the second section of tape is positioned adjacent a lower surface of the shell. The various configurations of the links and flex regions may be configured as shown and disclosed in U.S. Pub. No. 2016/0296026 A1, entitled Seating Arrangement, and U.S. Pub. No. 2018/0295996A1, entitled Seating Arrangement, the entire disclosures of which are hereby incorporated herein by reference. The phrase "flex region" refers to a portion of the structure that allows for flexing or bending in the designated region, through elastic deformation, thereby allowing or providing for relative flexing movement (e.g., pivoting or bending) of the component or structure on opposite sides of the flex region, thereby defining a virtual pivot location, for example a horizontal pivot axis, with the understanding that the virtual pivot axis may move during the flexing, rather than being defined as a hard fixed axis.

Figure 95A:
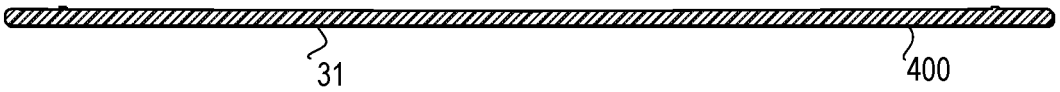
FIGS. 95A-E are cross-sectional views of the lower support structure taken along corresponding lines shown in FIG. 94.
Figure 95B:
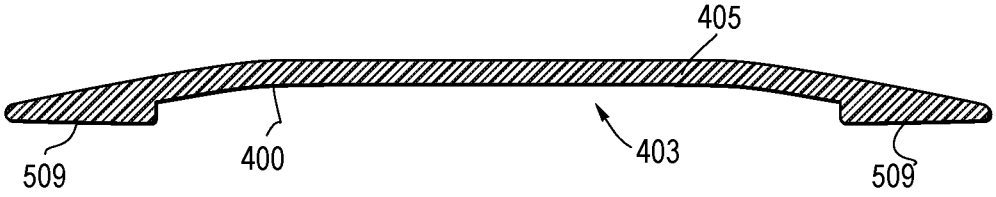
Figure 95C:
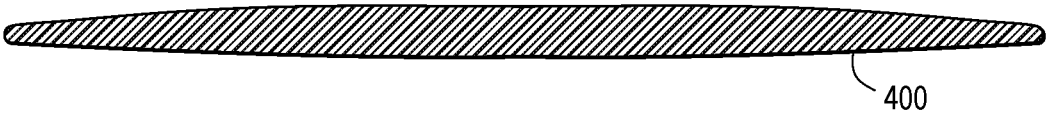
Figure 95D:
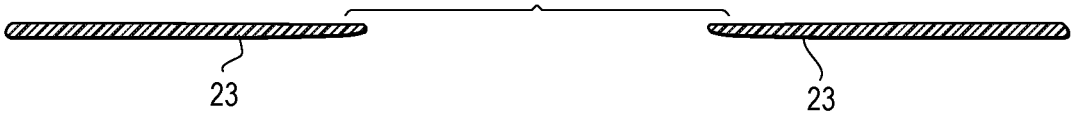
Figure 95E:
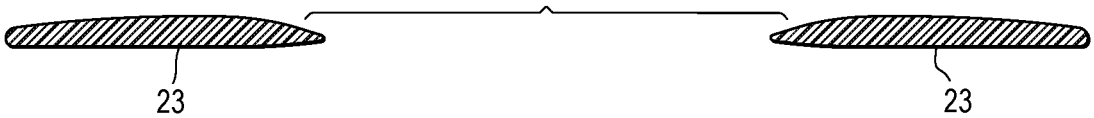

For example, as shown in FIGS. 21, 24, 25, 84A-D, 93, 94 and 95D and E, front links 23 may each be configured as a blade 412, having a lateral width and thickness, both of which may vary. In one embodiment, each of the blades has a greater thickness along a longitudinal centerline thereof, with the blade having an elliptical cross section. As shown in FIGS. 95D and E, the inboard edge of the blade may taper or be thinner, while the outer edges are curved. The front links have a general "S" shape, with an upper end portion 414 defining a flange with a plurality of boss structures or insert portions extending upwardly from the flange. A flex region 27 may be formed in the front links, in the longitudinally extending portion 57, or at the junction between the front link 23 and portion 57, or may be defined by any combination thereof. For example, in various embodiments, the front link 23 or the longitudinal portion may have a thinner cross-sectional area defining the flex region, thereby allowing the front link 23 to pivot relative to the longitudinally extending portion 57 of the seat, for example during recline. Tensile substrates 1220 may be positioned along a bottom of the longitudinally extending portion 400 extending forwardly from the first location 406 and along the bottom of the front links 23, with the bottom portions of those structures being put in tension during bending as the body support assembly reclines, and with the upper portions of those structures being put in compression. It should be understood that the front links 23 themselves may also bend and deform elastically during rearward recline of the body support assembly, but with the majority of the elastic deformation intentionally occurring at the flex regions. In one embodiment, the flex region 29 is formed by making the blade 412 thinner than the surrounding regions, and also making the blade flat or planar across the width of the blade at the flex region. For example, in one embodiment, flex region 29 has a length of about 25 mm and a depth of about 2.8 mm, with adjacent regions of the blade having a thickness of 2 to 3 times the thickness of the blade in the flex region 29. In other words, the flex region 29 is introduced by making the blade thin and flat. As such, the flex region has a lesser area moment of inertia, and is less capable of resisting bending, than the adjacent regions. The portion 400 is relatively thick between location 406 and the flex region 29, as shown in FIG. 95C, but may have a greater thickness along a longitudinal centerline thereof, with the portion 400 having a generally elliptical cross section.

The rear link 25 is relative rigid or stiff, meaning the rear link does not bend or deform elastically during rearward recline of the body support assembly. Rather, the longitudinally extending portion 400 has a thinner region defining a flex region 31 immediately adjacent to and in front of the rear link 25 and the location 410, but rearward of the first location 406. As with flex region 28, the flex region 31 is defined by a thin and flat cross section, shown in FIGS. 94 and 95A, having a length of about 25 mm in one embodiment and with the surrounding regions, for example the adjacent rear portion 401 of portion 400 of base link 33, having a thickness of 2-5 times greater than the thickness of the flex region 31. The rear portion 401 of the longitudinally extending portion 400 positioned between the first location 406 and the rear link 25 may have a tensile substrate 1222 positioned in an upper portion thereof, since that portion or upper surface will undergo a tensile loading during recline as bending forces are applied, and with the lower portion or surface experiencing compression loading.

Figure 77:
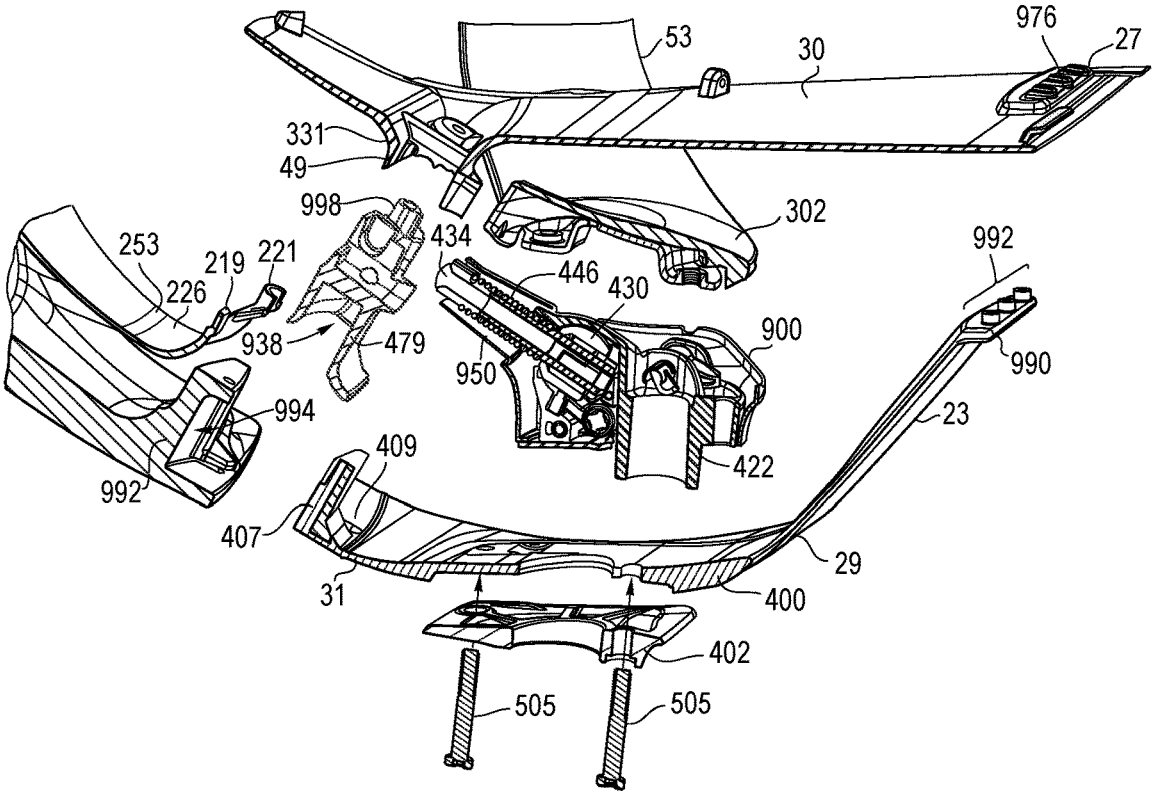
FIG. 77 is an exploded partial view of the tilt control assembly with a recline limiter, energy boost and height adjustment control.
Figure 78:
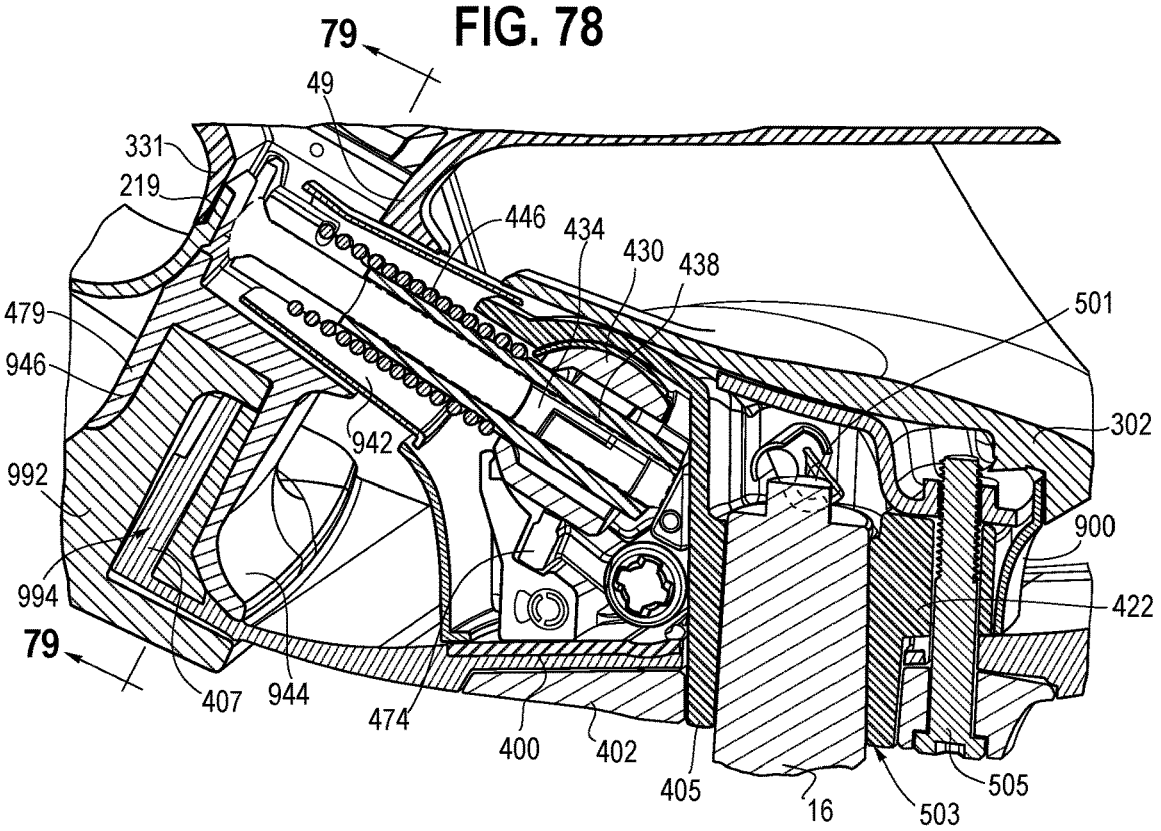
FIG. 78 is a cross-sectional view of the tilt control assembly, recline limiter, energy boost and height adjustment control.
Figure 103:
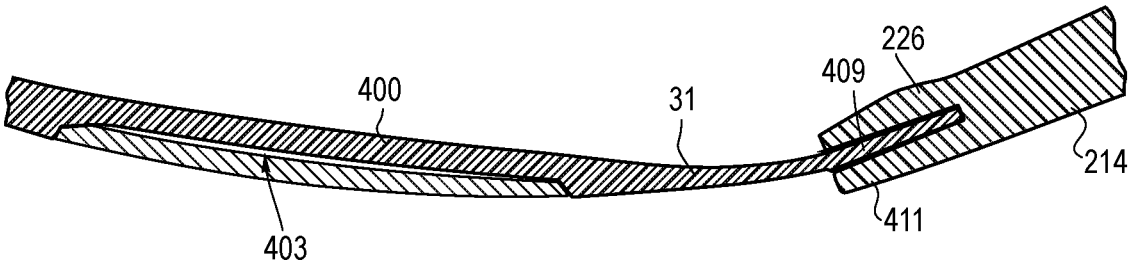
FIG. 103 is a partial cross-sectional view of the interface between a lower support and a back support.
Figure 104:
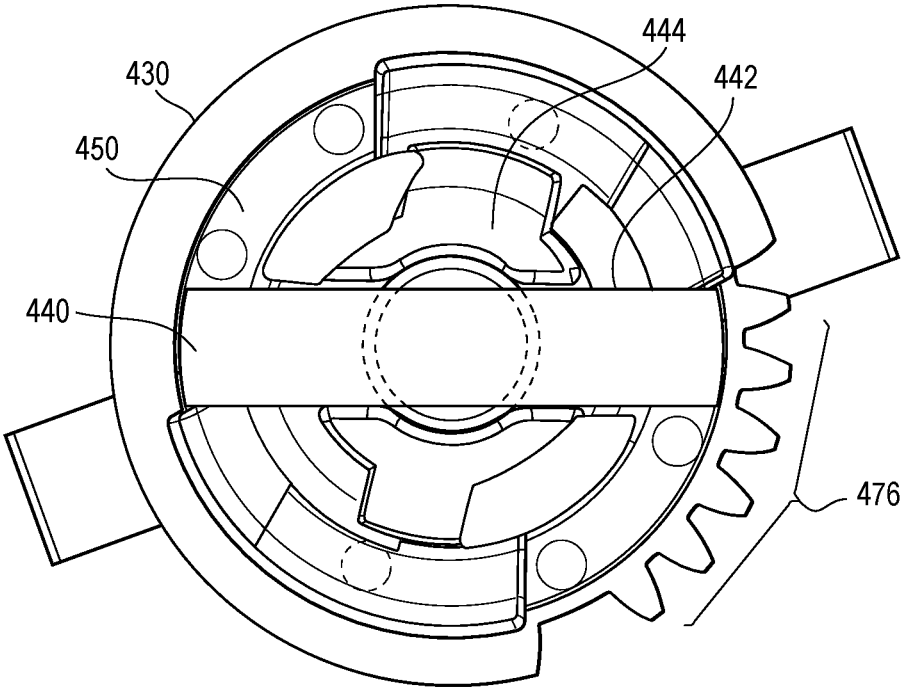
FIG. 104 is an end view of a recline limiter and energy boost limiter.

The rear portion 401 of the lower support structure 400 extends rearwardly from the first location 406 and includes an upwardly extending centrally located arm or post 407 defining in part the rear link 25, and a flange 409 on each side of the post defining a rear edge 416 as shown in FIGS. 43, 77 and 78. As explained in more detail below, a back frame 210 and a back support 212 also have feature defining in part the rear link 25, together with a connector 479 joining the various features. The back frame 210 and back support 212 therefore pivot about a common axis defined by the rear flex region 31. The flanges 409 are received in a groove 411 defined by a lower portion 214 of a back frame, with the groove having a opening with a wider mouth that is tapered rearwardly as shown in FIG. 103, such that the flanges 409 may pivot slightly relative to the lower portion and roll along the lower surface of the support defining the mouth of the groove 411 so as to reduce stress risers at the junction thereof.

In operation, a user can move or recline the backrest and seat assemblies 6, 8 from an upright position to a reclined position by flexing the four bar mechanism, including portions of the seat assembly. It is contemplated that the four-bar linkage arrangement as used and described herein is inclusive of linkage arrangements comprising additional linkage members, such as five-bar linkage arrangements, six-bar linkage arrangements, and the like. In various embodiments, the thickness of one or more links 23, 25, 33, 57, and especially the front, base and seat links 23, 33, 57, and predetermined flex regions thereof, may be located to achieve a desired performance characteristic, including for example, the flexibility of the link. Further, in certain embodiments, the thickness of a link may vary along the length and/or width of the link to achieve a desired flexibility or rigidity across the link or in a localized portion of the link, for example at flex regions 27, 28, 31 and 53. In addition, and for example, the front links and seat assembly link may be more flexible than the rear link 25 to achieve the desired flexibility of the four-bar linkage. In some embodiments, the various links may be more flexible in a particular portion or localized area of the link such that the links are generally flexible in the localized area and are generally not flexible or less flexible in any other area of the link. It is noted that the relative areas of reduced thickness may extend along a short distance or the majority of the length of the associated link depending upon the support and bending characteristics desired.

The spacing W1 between the outermost portions of the front links 23 support provides relative stability to the front portion of the seat, with the links 23 thereby resisting rotation or torsional movement about the longitudinal axis 2. In contrast, the centrally located rear link 25 having an overall width W3 is the only support for the rear of the seat assembly, which allows for a greater amount of rotation or torsional movement of the rear of the seat about the longitudinal axis 2 relative to the front of the seat, with the rotation or torsional movement of the front of the seat being restricted by the front links 23. In one embodiment, W1 is about 290-300 mm, while W3 is about 140 mm, with the ratio between W1 and W3 being about 2:1.

Recline Limiter and Energy Boost:

Referring to FIGS. 71-73C, 77-82D, 104 and 106A-D, a control module 420 limits the amount the seat and backrest assemblies 8, 6 may recline, while also providing supplemental energy to return the seat and back to an upright position. Because the front and rear links 23, 25 are oriented/angled forwardly, as the user reclines, the seat 8 is lifted, which provides an automatic resistance to recline (or weight activated mechanism). Specifically, the flex zone 27 is positioned forwardly of the flex zone 29 and the flex zone 53 is positioned forwardly of the flex zone 31 in a nominal, at-rest position. As such, the chair can resist recline without any auxiliary spring and will return to an upright position from a recline position when the user exits the chair. Likewise, due to the compliant nature of the tilt control mechanism 318, seat support and backrest, those components may bend or elastically deform in response to a load, thereby absorbing energy through elastic deformation. For some users, however, a supplemental energy system is helpful to boost resistance to recline. In one embodiment, the system may be adjusted to provide a no-recline stop, a mid-boost/mid-stop, a full-boost/full-recline stop, and a no-boost/full-recline stop.

Figure 105:
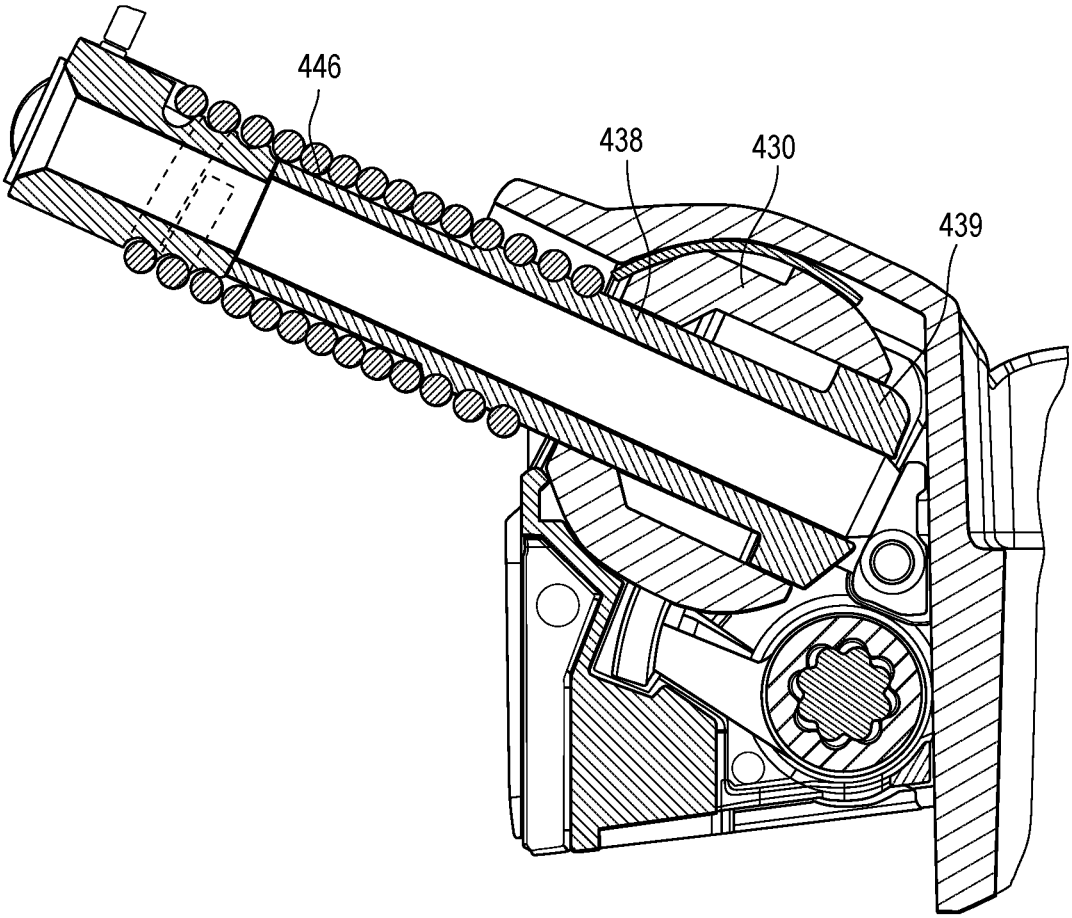
FIG. 105 is a cross-sectional view of the tilt control assembly, recline limiter, energy boost and height adjustment control.

The control module 420 includes a housing 422, having a base 426, made from a casting in one embodiment. A ball retainer housing 428 is made of two pieces, which are connected to defining a spherical interior socket 424. A cover 421, or base portion 302 of the armrest assembly, is secured to the top of the base 426 with fasteners 505 to further define the housing 422. The retainer housing 428 is inserted into the base 426 beneath a shroud 516 formed in the housing, wherein it is secured with a shaft 462. The housing 422, or hub portion 405 thereof, defines an opening 503 in a bottom wall thereof that receives a top of the support column 16, with the housing 422 fixedly secured to the platform 402, for example with fasteners 505. A ball shaped recline limiter 430, configured in one embodiment as a spherical bearing, is rotatably supported in the socket 424 of the ball retainer housing. The recline limiter 430 is rotatable relative to the housing 428 about a longitudinal axis 432. A recline stop member 434, configured with a rod 436, or portion of a T-shaft, being axially disposed through a spring bushing 438 and spring 446. A cross member 440 of the T-shaft moves in a longitudinal slot 442 formed in the side walls of the spring bushing. The ends of the cross member 440 extend radially outwardly from the sides of the spring bushing such that the ends are exposed for engagement with various stop surfaces of the recline limiter. The spring bushing 438 has a first end 448 coupled to a tension spring 446, for example with a threadable engagement. The spring bushing 438 includes a pair of tabs 444 extending radially outwardly from opposite sides thereof. In this way, the ends of the cross member 440 and the tabs 444 on the spring bushing define different stop members, which engage different stop surfaces 450, 452, 454 formed interiorly in, or along a forward end/front surface of, the spherical bearing, or recline limiter. The surfaces 450, 452 and 454 are spaced apart in a longitudinal direction, with the surface 450 being a forwardmost surface and the stop surface 454 being a rearwardmost surface. The surface 452 may be defined as the forward end surface of the ball shaped recline limiter, or may be spaced longitudinally reawardly of such a surface so as to provide contact with the tabs 444 of the spring bushing 438 during all operations of the limiter. The recline limiter 430 includes a through opening 453, with the spring bushing 438 and stop member rod 436 extending through the opening, and with the rod 436 extending through a longitudinal center of the spring bushing 438 and spring 446, which are disposed around the rod 436. In the embodiment shown in FIGS. 104 and 105, the recline limiter 430 is supported at both ends by the spring bushing 438, which includes radially extending tabs 444 or feet that support the recline limiter 430 during rotation. In this embodiment, the tabs 444 extend further in the longitudinal direction, and also have a greater circumferential length, i.e., extend a greater circumferential distance around the spring bushing 438. The outer surface of the tabs 444 or feet engage and support the inner bore of the recline limiter 430 in all positions of the recline limiter such that the recline limiter is more stable. An opposite end 456 of the rod is fixedly connected to a T-shaped bushing 458 by way of interior threads on the bushing 458 and external threads on the end of the rod. Cross members 471 of the bushing 458 engage the rear link 25 of the four-bar linkage, and in particular are received in a pair of hubs 477, or housing defining axle receiving cavities, formed on the connector 479. The spring 446 has opposite ends 459, 461 screwed onto exterior threads of the T-bushing 458 and the spring bushing 438 respectively, with the spring 446 configured as an extensible tension spring that extends in the longitudinal direction 432. It should be understood that the rod and spring may be secured to the bushing with other fasteners, including adhesives, friction fit, set screws, snap fit, detents and the like. A tubular shroud 950 surrounds the rod 436 and spring bushing 438 and provides an aesthetic cover while avoiding pinch points. The shroud 950 is pivotally connected to the housing 516 with a pair of axles received in tabs, allowing the shroud 950 to rotate about an axis 956 defined by the axles 952, which allows the shroud to move and rotate with the rod and spring bushing during recline.

In operation, the recline limiter 430 is rotated at 30 degree increments about the longitudinal axis 432 defined by the spring bushing 438, spring 446 and T-rod 436 to present the different stop surfaces 450, 452, 454 to the ends of the cross member 440 and/or tabs 444 of the spring bushing. In one embodiment, an actuator component 460 includes a hub portion 472 having a through opening engaged by a shaft 462 having a lead screw 464 with threads 481. As shown in FIGS. 82A-D and 106A-D, the cross member 440 and tabs 444 do not rotate about an axis, but rather remain stationary as the recline limiter 430 rotates. As the lead screw 464 is rotated by a handle or knob 466, the rack (slider) 460 is moved laterally and axially along the lead screw 464 by way of interfacing/meshing teeth 468, 470 defined by the external threads 481 of the lead screw and internal thread 483 of the hub portion 472. The threads may be four start or eight start. The actuator further includes a linear rack 474 protruding from the hub portion 472 and secured thereto with an arm 473. The rack 474 is moved laterally by rotation of the lead screw 464, which may be rotated in either a clockwise or counterclockwise direction to move the rack side-to-side in a lateral direction 4. The rack includes a row of teeth 475 that mesh with teeth defined by a circumferential rack 476 disposed around an exterior surface of the spherical recline limiter 430, with the intermeshing racks 474, 476 rotating the spherical bushing 430 about the longitudinal axis 432 within the socket to different angular positions within the ball retainer housing 428. A detent 478 is coupled to an end of the lead screw, with the detent having a plurality of surfaces or recesses engaged by a resilient engagement member 480, formed as the end of a cantilever and biased by a spring 491 in one embodiment, which releasably engages one or more of the surfaces so as to ensure that the lead screw is rotated specific angular amounts, corresponding to the 30 degree rotations of the spherical bushing. The end 463 of the shaft 462 is rotatably supported by a bushing 482 coupled to the housing 428.

Figure 82A:
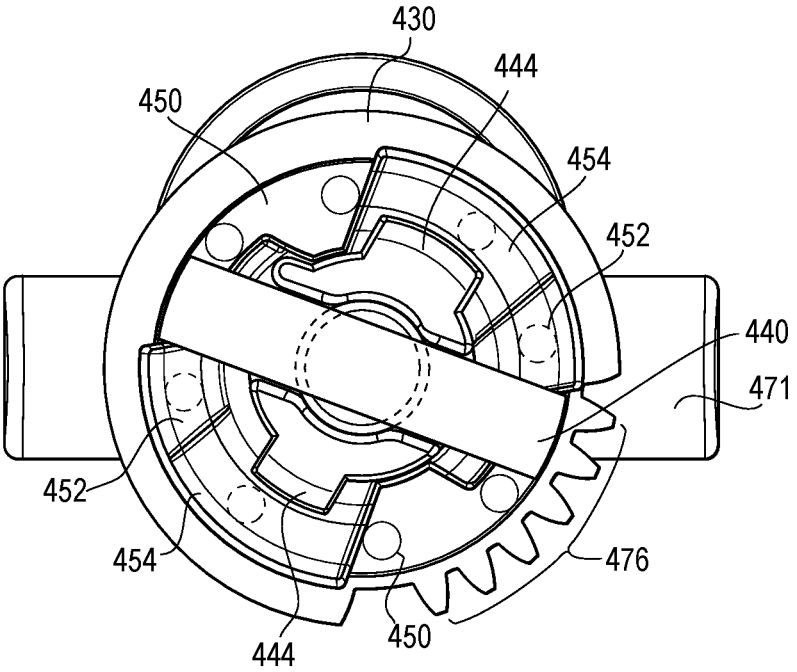
FIGS. 82A-D are end views of the recline limiter and energy boost in a no-recline position, a mid-recline/mid-boost position, a full recline/full boost position, and a full recline/no boost position respectively.
Figure 82B:
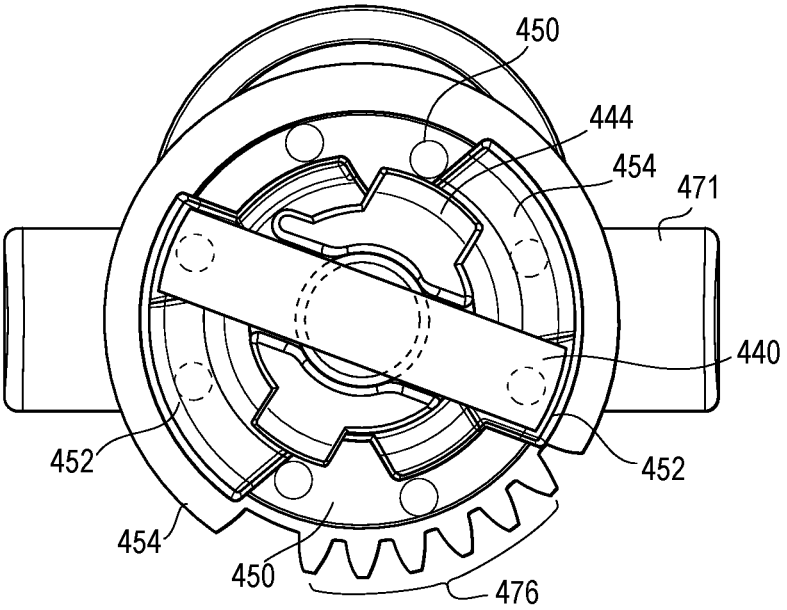
Figure 82C:
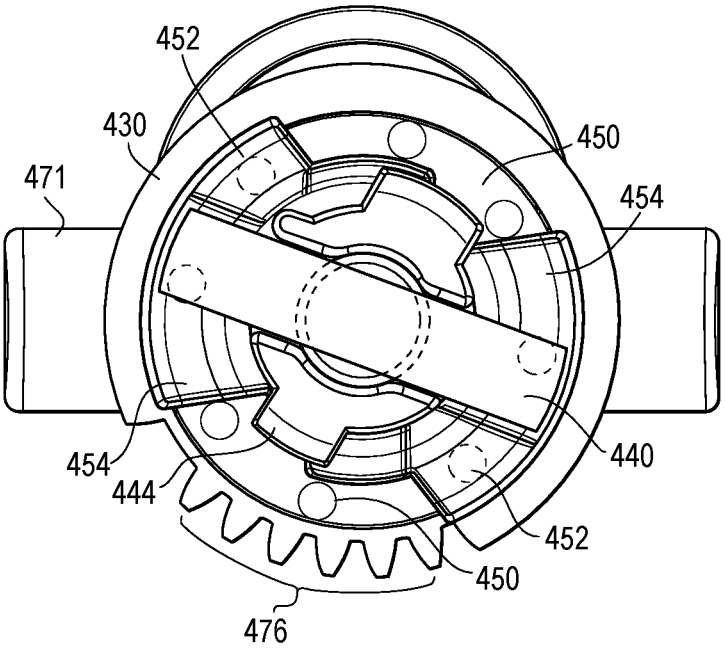
Figure 106A:
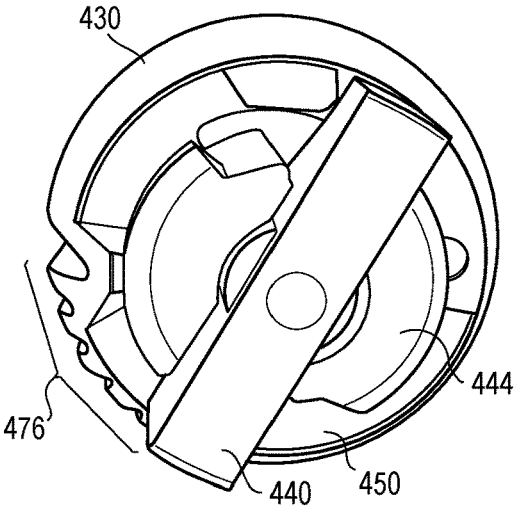
FIGS. 106A-D are end views of the recline limiter and energy boost in a no-recline position, a mid-recline/mid-boost position, a full recline/full boost position, and a full recline/no boost position respectively.
Figure 106B:
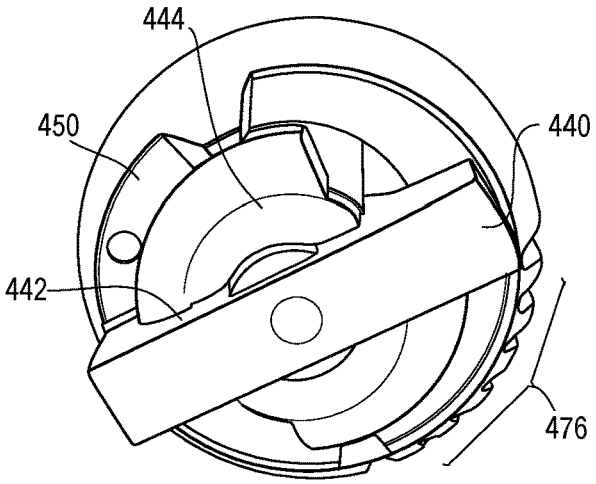
Figure 106C:
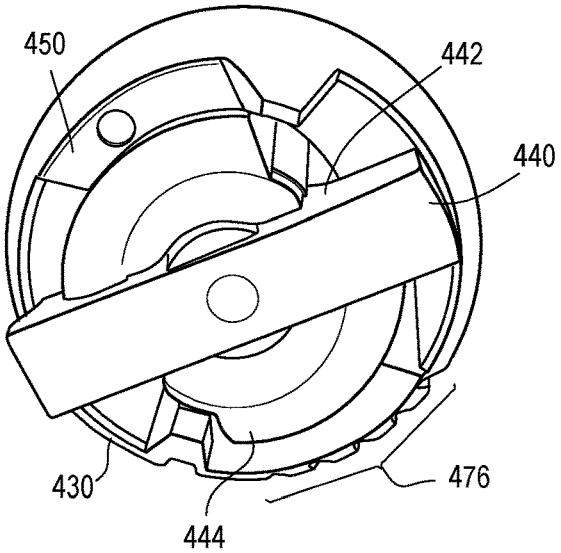

In a full recline/full boost position, shown in FIGS. 82C and 106C, the tabs 444 of the spring bushing engage a forward stop surface 450 defined by the forward face of the spherical bushing, preventing the spring bushing 438 from moving axially/rearwardly during recline. The cross member 440 of the rod, however, is free to move in the slot 442 of the spring bushing. Accordingly, during recline, the rear link 25 engages the T-shaped bushing 458, which pulls the rod 436 rearwardly as the cross member 440 moves in the slot 442 of the spring bushing. Since the spring bushing 438 is immobilized, the spring 446 (which is fixed to the spring bushing and T-shaped bushing) is stretched or put in tension, thereby applying a return force to the rear link 25. When the cross member encounters the stop surface 454, recline is arrested (full stop).

In a no-recline stop position, shown in FIGS. 82A and 106A, the ends of the cross member 440 of the rod 436 engage the forward stop surface 450 defined by the spherical bushing, preventing the rod, attached T-shaped bushing and rear link 25 from moving rearwardly.

Figure 82D:
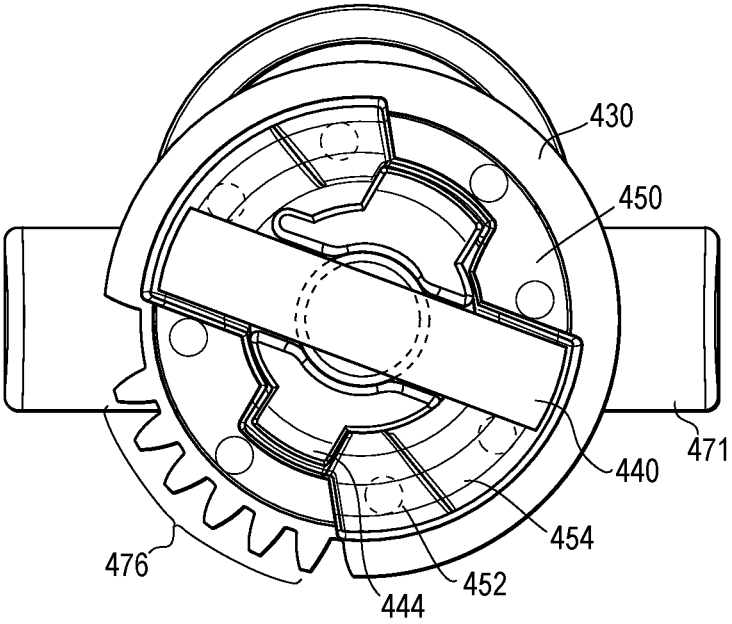
Figure 83A:
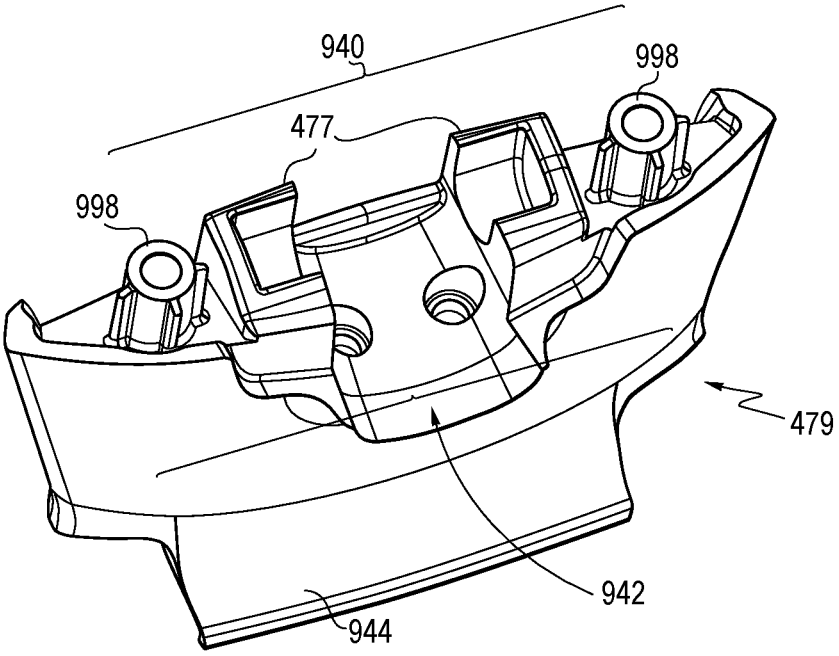
FIGS. 83A and B are top and bottom perspective views of a rear link connector.
Figure 83B:
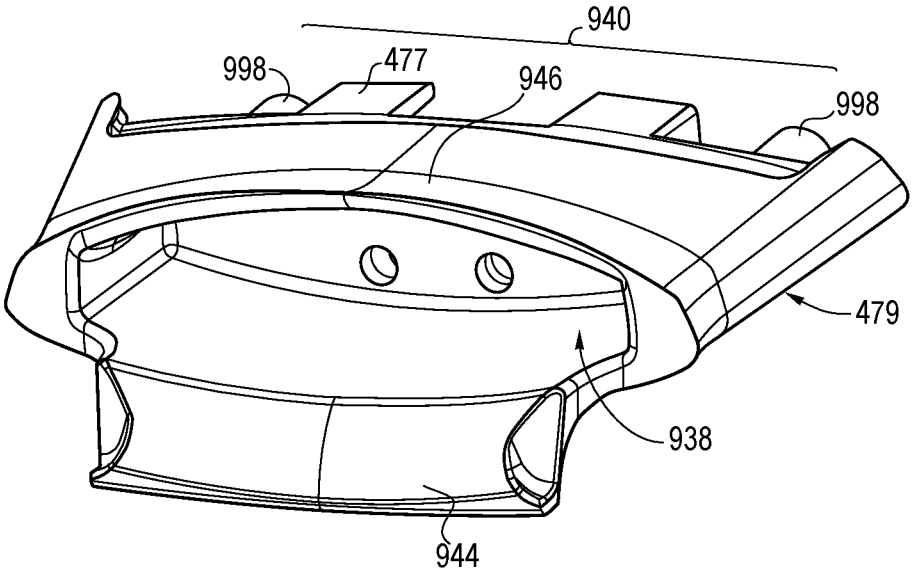
Figure 84A:
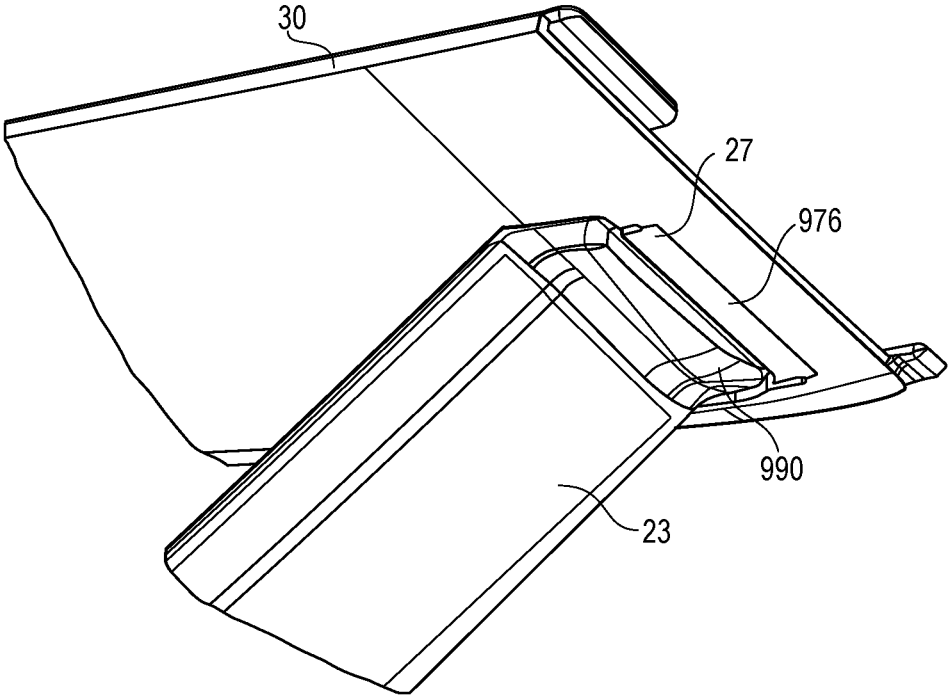
FIGS. 84A-D are a bottom, top, exploded and enlarged cross-sectional views showing the connection between a front link and the seat assembly.
Figure 84B:
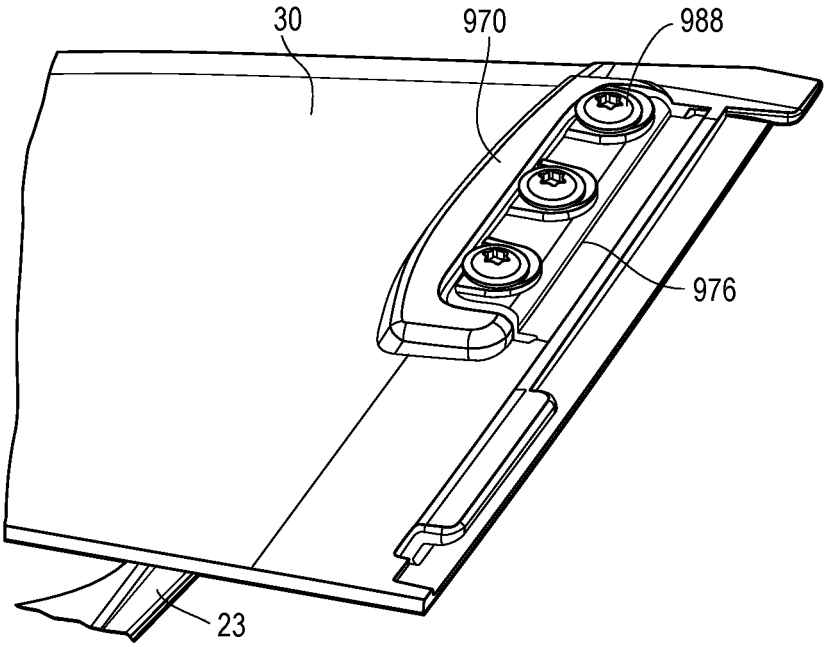
Figure 84C:
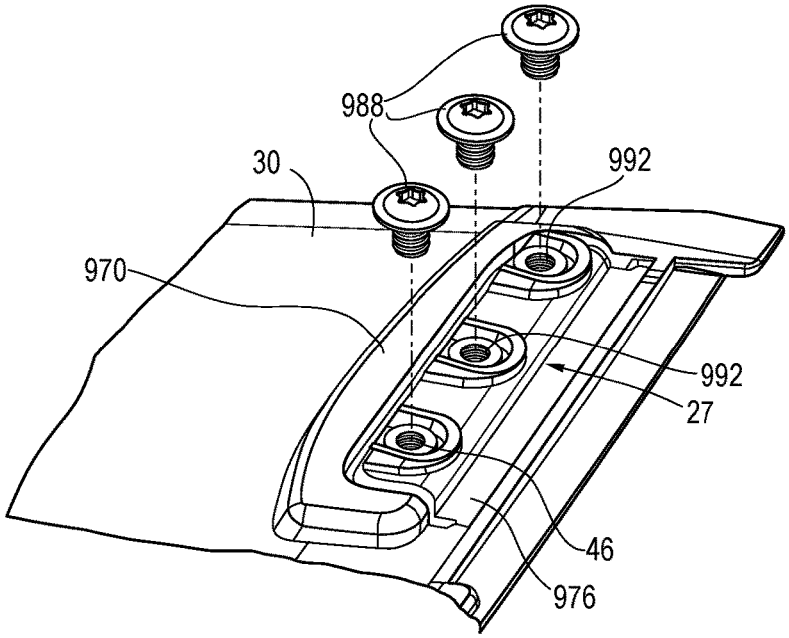
Figure 84D:
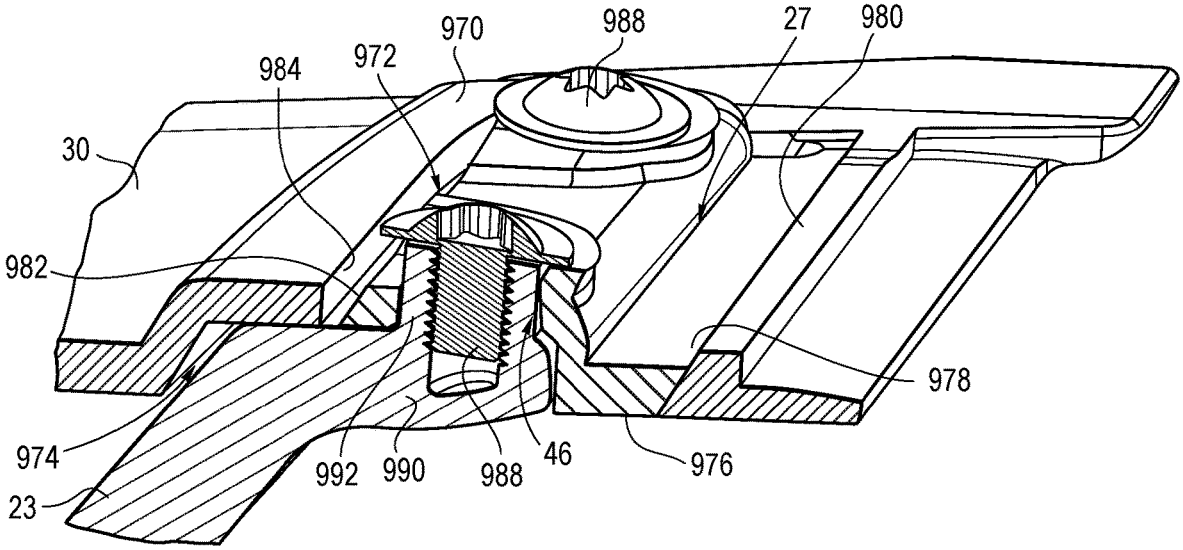
Figure 106D:
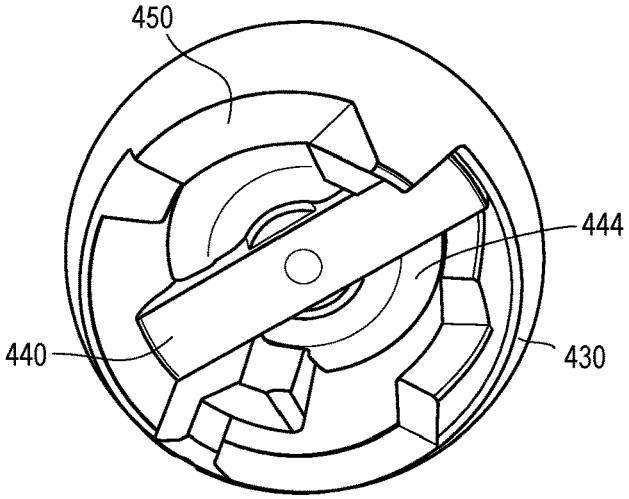

In a full recline/no boost position, shown in FIGS. 82D and 106D, the spring bushing 438 and rod 436 are free to move in the spherical bushing until the rod 436 is engaged with the rear stop surface 454 thereof at full recline, but with the spring 446 not being extended.

In a mid-recline/mid-boost position, shown in FIGS. 82B and 106B, the tabs 444 of the spring bushing 438 engage a forward stop surface 450 of the spherical bushing, preventing the spring bushing from moving axially/rearwardly during recline. The cross member 440 of the rod, however, is free to move in the slot 442 of the spring bushing to a mid-stop position, wherein the ends engage an intermediate stop surface 452 in the spherical bushing spaced longitudinally rearwardly from the forward stop surface 450 but forwardly of the rear stop surface 454. Accordingly, during recline, the rear link 25 engages the T-shaped bushing 458, which pulls the rod 436 rearwardly as the cross member 440 moves in the slot 442 of the spring bushing. Since the spring bushing is immobilized, the spring (which is fixed to the spring bushing and T-shaped bushing) is stretched or put in tension, thereby applying a return force to the rear link 24.

Importantly, the interface between the socket 424 of the ball retainer housing 428 and the outer spherical surface of the recline limiter 430 allows the position of the recline limiter 430 to be adjusted to the different stop/boost positions, but also allows for some play/rotation to accommodate the rotation of the rod and other components during recline. For example, the intermeshing racks 474, 476, and teeth defined thereby, are oriented such that the recline limiter 430 may rotate about a lateral, horizontal axis. In one embodiment, the recline limiter, or spherical bushing, has at least two rotational degrees of freedom, including for example rotation of the recline limiter about the longitudinal axis 432 and also about the lateral axis, so as to allow the recline limiter to float relative to the base and thereby accommodate the flexing of the four bar mechanism about a lateral axis and any inherent flexing of the seat and back about a longitudinal axis without being bound up in the housing 428. The recline limiter may also have a rotational degree of freedom allowing rotation about an axis orthogonal to the longitudinal and lateral axis, for example an axis extending upwardly, such that the rod 436 may rotate side-to-side to accommodate movement, i.e., bending and twisting, of the four bar mechanism during use.

As noted, the recline limiter assembly interfaces between a body support member, e.g., seat and/or backrest, and the base to limit the recline of the body support member relative to the base. For example, the recline limiter assembly may interface between the rear link 25 and the base 12, with the rear link coupled to both the seat and backrest and controlling the recline of both components through the rear link 25. In other embodiments, the recline limiter may be directly coupled to, or interface directly with, either the seat or backrest assemblies 8, 6.

Height Adjustment Control:

The control module may also include an actuator 484 coupled to the housing 422 for moving an actuator button 501 extending from a top of support column 16. The actuator button may be depressed by the actuator 484, thereby allowing the support column 16 to extend, or to be compressed under load. Referring to FIGS. 73A-C and 87A and B, the actuator 484 includes a handle 486 rotatably mounted about a lateral axis 488 and having a hollow shaft 490, through which the rod 462 and lead screw 468 extends. The end 492 of the shaft 490 engages and rotates a drive gear 494, 1494, with a bushing 833 supporting the end in the housing 422. In one embodiment, the drive gear 1494 is configured with a radially extending arm 1495 having a plurality of teeth 1496 (shown as four teeth) defining a rack 1497. In one embodiment, the rack is a linear rack, with the teeth are arranged along a tangent to a curve having a radius defined by the length of the arm. In other embodiments, the rack may be a partial, circumferential rack. In another embodiment, the drive gear may be configured as a segment gear, with a pair of radii sides and an outer circumferential arc having a plurality of teeth positioned around the periphery thereof. The drive gear 494 also has a plurality of teeth 496 positioned around a portion of the circumference thereof, and an adjacent circumferential portion 498 with no teeth, or in other words the drive gear 494 has an outer surface 499 disposed radially inwardly relative to the plurality of teeth 496 so as to define a circumferential recess. The drive gear 494, 1494 is rotatable about the lateral axis 488 from a non-engaged position to an engaged position.

An actuator with a driven gear 500, 1500 is positioned adjacent the drive gear and is rotatable about a lateral axis 502 spaced from the lateral axis 488. A bushing or cover 847 surrounds an axle 841 extending from the driven gear 1500, which is supported by a pair of lugs 853 formed on the housing 422. The engagement member rotates about the axle 841 and/or cover 847 between the lugs. In one embodiment, the driven gear 1500 is configured as a gear segment, with a pair of radii sides 1502 and an outer circumferential arc 1504 having a plurality of teeth 1506 positioned around the periphery thereof. The actuator includes a tab or lever 504 extending radially from the axle overlying the actuation button of the support column. A compression spring 506 biases the drive gear 494 such that the no-teeth portion 498, or surface 499, typically overlies the driven gear. The driven gear 500 includes a plurality of teeth 508 disposed around at least a portion of the circumference of the driven gear, with the recess 498 or surface 499 overlying the plurality of teeth 508 when the drive gear is in the non-engaged position. The drive gear 494 is rotatable to the engaged position such that the plurality of teeth 496 are brought into engagement with the plurality of teeth 508 after a first predetermined amount of rotation of the handle 486 about the lateral axis 488. The driven gear 500 is thereby rotated from a non-actuated position to an actuation position about the lateral axis 502 when the drive gear is in the engaged position. The user rotates the handle 486 against the biasing force of the compression spring 506 until the teeth 496 of the drive gear rotate into engagement with the teeth 508 of the driven gear, thereby rotating the actuator lever 504 extending from the shaft of the driven gear and actuating the button 517 on the top of the support column 16. An integrated spring 510 is formed in a carrier bracket to provide a slight-preload to the button. The driven gear 500 is rotatably supported by a bracket 512 coupled to the top of the housing over the top of the support column, with the drive gear and driven gear interfacing in recess 514 formed in the housing.

Figure 80:
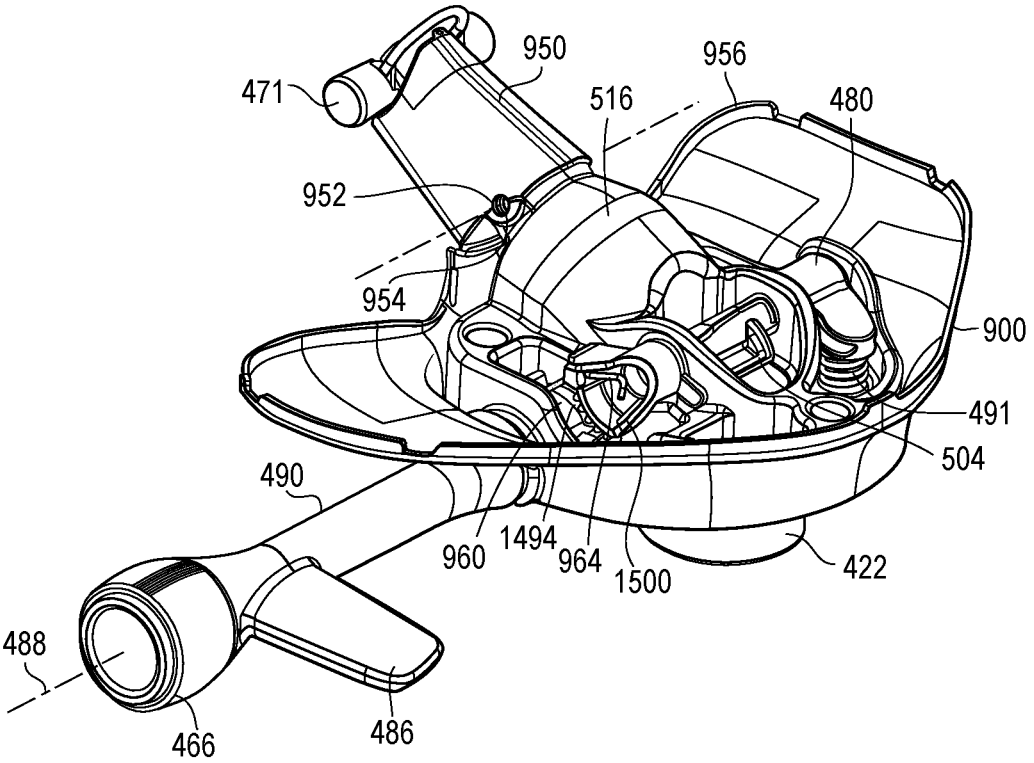
FIG. 80 is a perspective view of the recline limiter, energy boost and height adjustment control assembly.
Figure 81:
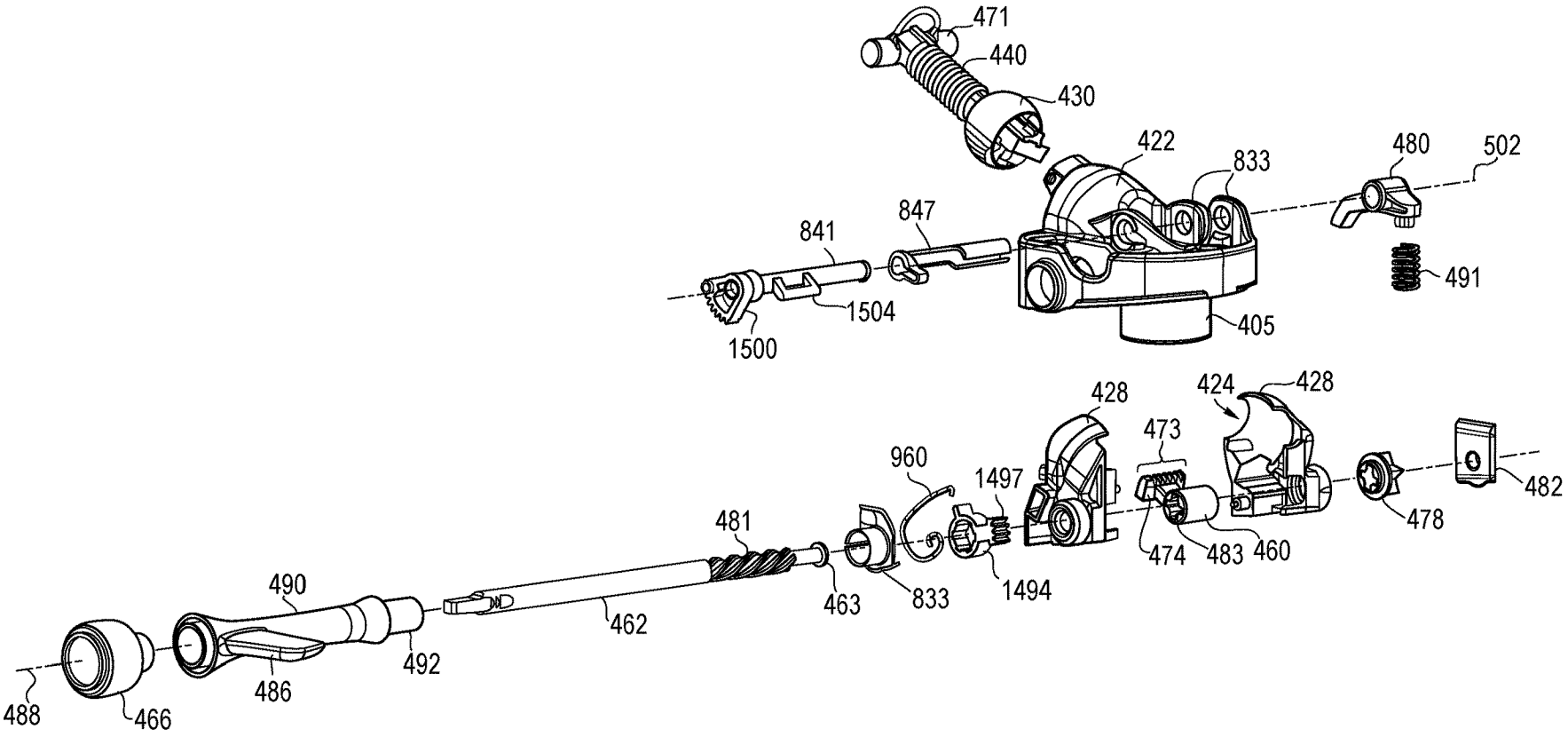
FIG. 81 is an exploded view of the recline limiter, energy boost and height adjustment control assembly.
Figure 87A:
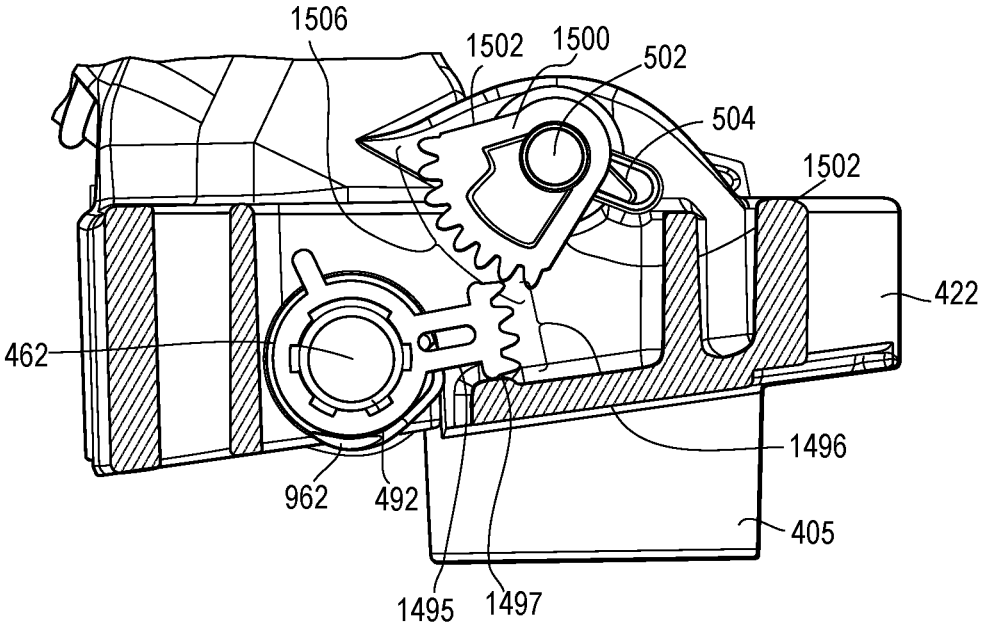
FIGS. 87A and B are views showing a drive gear and driven gear in non-engaged and engaged positions respectively.
Figure 87B:
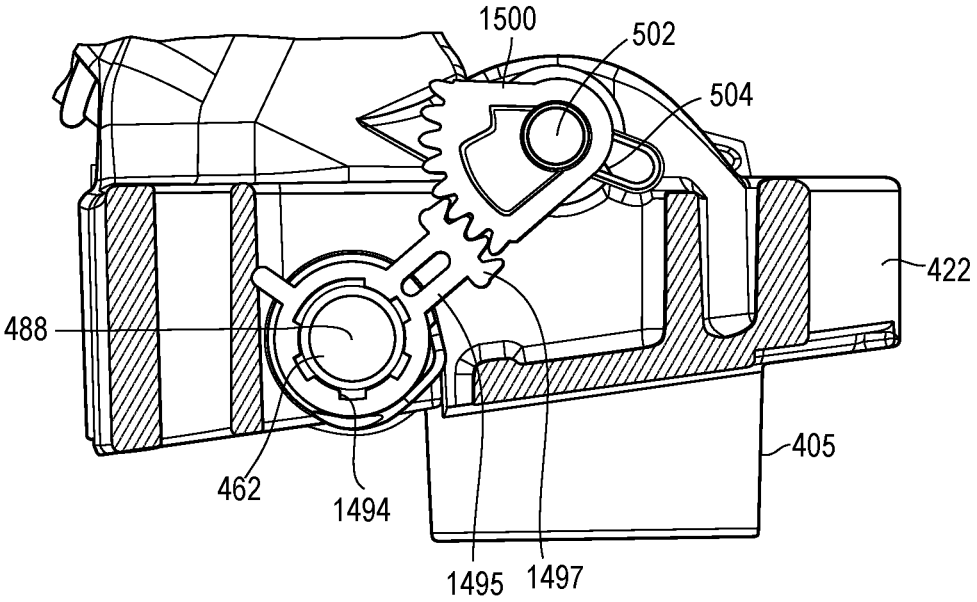

Referring to the embodiment of FIGS. 80, 81 and 87A and B, a spring 960 has a first end 962 that biases the drive gear 1494 to a disengaged position such that that the teeth 1496 are disposed below and not engaged or intermeshed with the teeth 1506 of the driven gear. The spring 960 has an opposite end 964 that biases the driven gear 1500 and lever 504 toward the button 517. In this way, the driven gear 1500 may be rotated a sufficient amount such that the lever 504 is engaged with the button, regardless of the rotation of the drive gear, for example to accommodate different support columns having different length or size buttons, or wherein tolerance buildup has resulted in a different position of the button. In other words, the starting position of the driven gear may vary depending on the type and configuration of the support column and button, prior to engagement by the drive gear, but with the drive gear thereafter engaging and rotating the driven gear.

The drive gear 1494 is rotatable to the engaged position such that the plurality of teeth 1496 are brought into engagement and intermeshed with the plurality of teeth 1506 after a first predetermined amount of rotation of the handle 486 about the lateral axis 488. The driven gear 1500 is thereby rotated from a non-actuated position to an actuation position about the lateral axis 502 when the drive gear is in the engaged position. The user rotates the handle 486 against the biasing force of the spring 960 until the teeth 1496 of the drive gear rotate into engagement with the teeth 1506 of the driven gear, thereby rotating the actuator lever 504 extending from the shaft of the driven gear and actuating the button 517 on the top of the support column 16.

Figure 13:
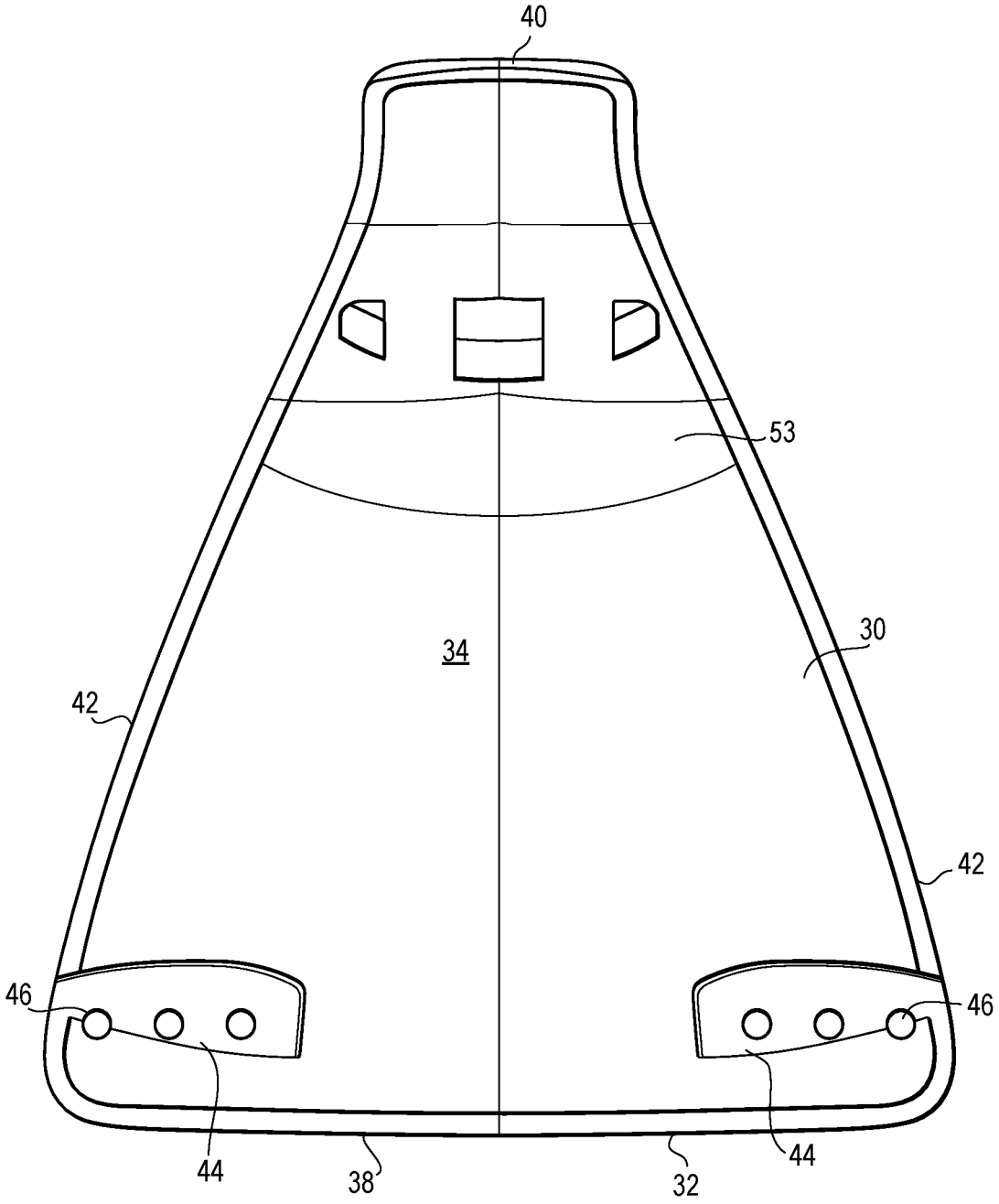
FIG. 13 is a top view of the support platform shown in FIG. 10.
Figure 14:
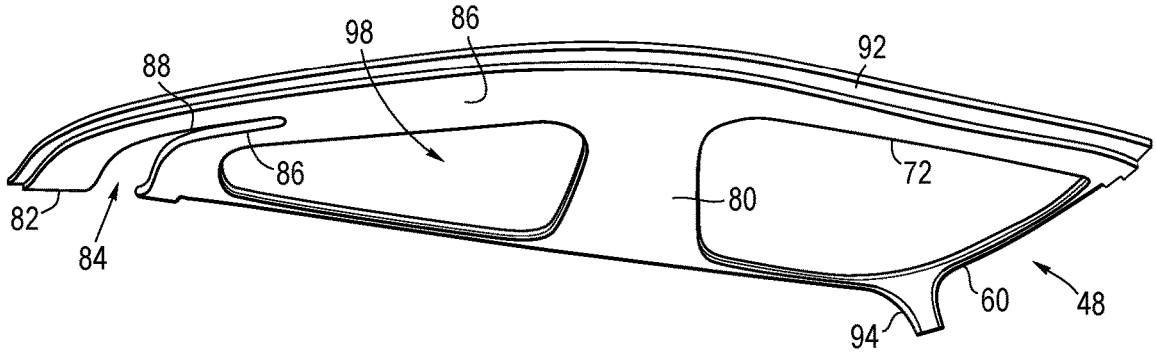
FIG. 14 is a left side view of one embodiment of a support ring, with a right side view being a mirror image thereof.
Figure 15:
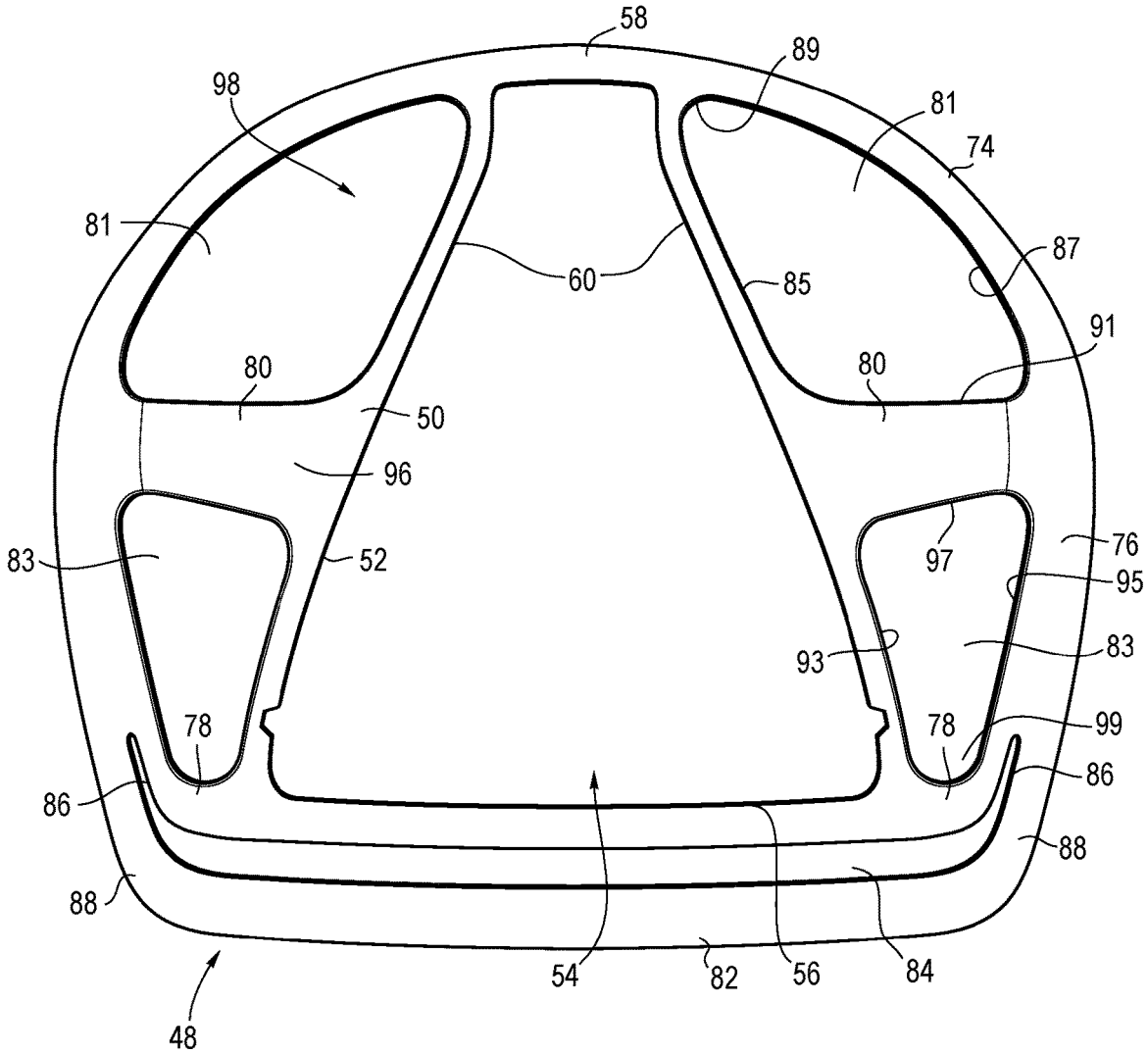
FIG. 15 is a top view of the support ring shown in FIG. 14.
Figure 16:
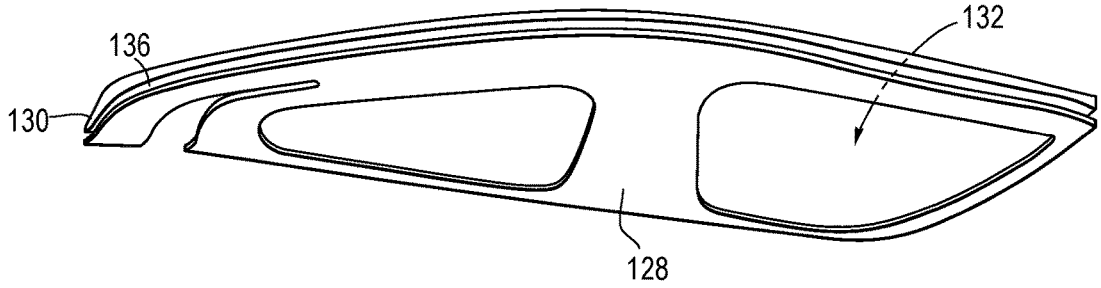
FIG. 16 is a side view of one embodiment of an upper seat shell.
Figure 17:
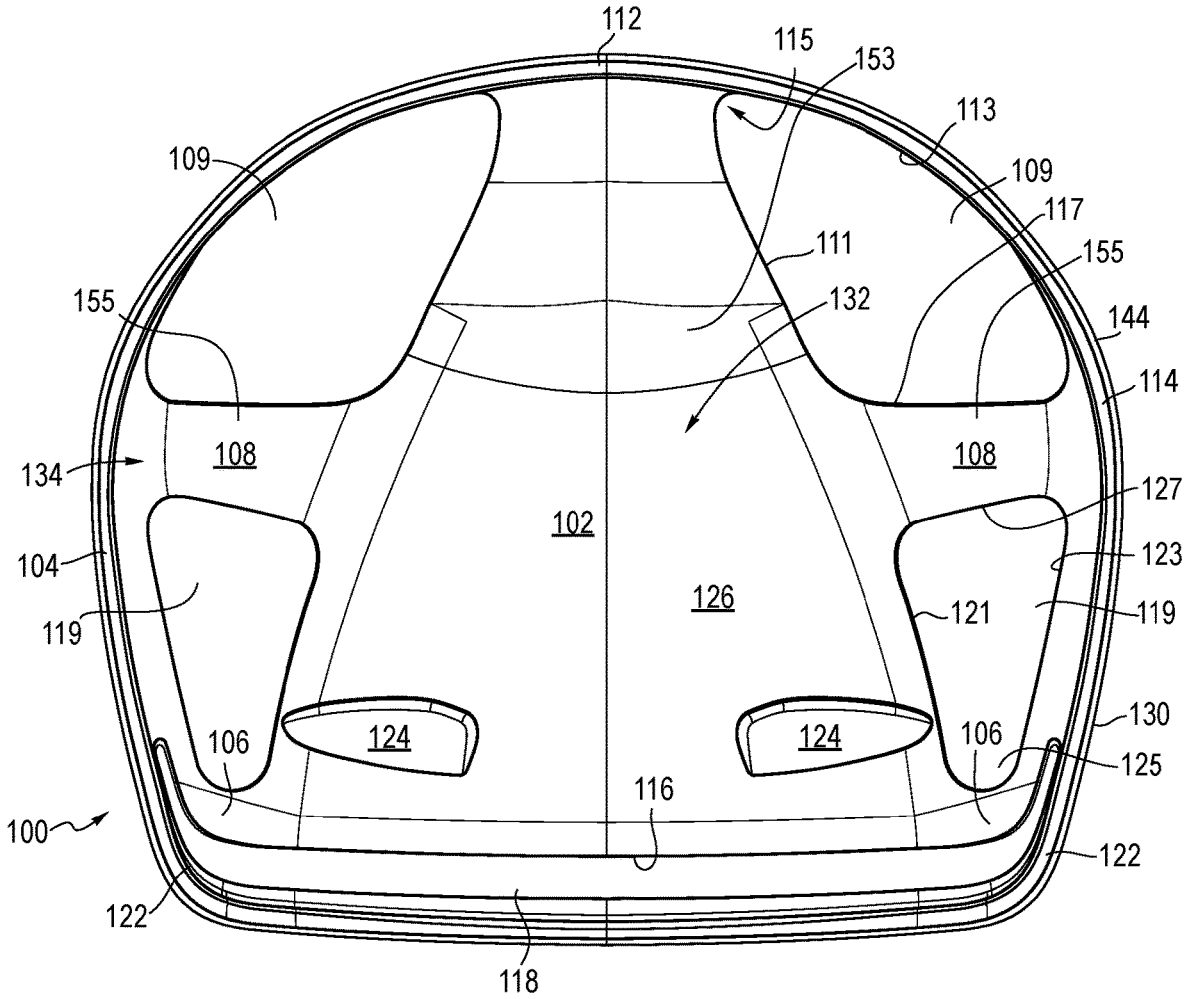
FIG. 17 is a top view of the upper shell shown in FIG. 16.

Seat Assembly:

Referring to FIGS. 1-7C, 8-20 and 84A-D, the seat assembly 8 is operably coupled to the tilt control assembly 18 and supports a seating surface 28. The seat has opposite sides spaced apart in a lateral direction and a front and rear spaced apart in a first longitudinal direction. The seat assembly includes a lower support platform 30 having a peripheral edge 32, an upper surface 34 and a lower surface 36. In one embodiment, the lower support platform has a generally isosceles trapezoidal shape in plan view (see FIG. 13) with a front edge 38, rear edge 40 and side edges 42 joining the front and rear edges. The rear edge is shorter than the front edge. The peripheral edge 32 may be stepped, meaning a peripheral edge portion 66 thereof is thinner than a central portion 68 thereof.

The support platform 30 has a pair of laterally spaced pads 44 positioned at a forward portion of the support platform. As shown in FIGS. 84A-D, the platform 30 includes a raised portion 970 defining a recess 974 and an opening 972. The pads are each defined as a hinge portion 976 with a front edge 978 secured to a front edge 980 of the platform defining the opening 972 in the platform. The hinge portion may be formed by overmolding a more flexible material to the support platform. The hinge portion 976 extends rearwardly in the opening with a rear edge 982 spaced apart from a rear edge 984 of the platform defining the opening 972. Each of the pads 44 includes at least one mounting component, shown as openings 46 shaped and dimensioned to receive mounting members (e.g. fasteners or studs 988) for securing the platform to the tilt control assembly, which may include a flange 990 extending forwardly from the link 23 to support the platforms. The flange 990 is received in the recess 972 and includes bosses extending upwardly into the openings 46 such that the flange 990 may be secured to a bottom surface of the pad, and hinge portion 976 in particular, with the plurality of fasteners 988. The flexible hinge portion 976 defines the flex region 27 in this embodiment. The mounting component, and connection to the link 23, allows for pivoting of the support platform and the front link 23 relative to the base link 33 about a flex region 29, and for pivoting of the seat assembly 8 relative to the front link 23 about flex region 27, executed in both cases for example by elastic deformation or bending of portions of the front links at the flex regions 27, 29, or alternatively by bending or flexing of the pads or hinge portion 976. At the same time, the spacing W1 between the pads, and front links, provides relative stability to the front portion of the seat, which resists rotation or torsional movement about a longitudinal axis. A boss structure 49 extends downwardly from a rear portion of the support platform. The boss structure 49 defines at least one mounting component that is connected to the tilt control assembly 18, and/or defines a portion of a rear link 25 forming in part the tilt control assembly and allows for pivoting of the support platform and the rear link 25 relative to the base link 33 about a flex region 31, which may be executed for example by elastic deformation or bending of portions of the base link 33 at flex region 31. In one embodiment, the boss structure 49 has a tubular configuration defining a cavity that surrounds or receives an insert portion of the rear link 25, configured with features from the connector 479, the 219. The centrally located rear link, which is the only support for the rear of the seat, allows for rotation or torsional movement of the rear of the seat relative to the front of the seat about a longitudinal axis, with the rotation or torsional movement of the front being restricted as previously explained. The support platform 30 has a generally concave upper surface 34, with front and rear portions 35, 37 extending upwardly from the boss structure.

The support platform may be made of a flexibly resilient polymer material such as any thermoplastic, including, for example, nylon, glass-filled nylon polypropylene, acetyl, or polycarbonate; any thermal set material, including, for example, epoxies; or any resin-based composites, including, for example, carbon fiber or fiberglass, thereby allowing the support platform to conform and move in response to forces exerted by a user. Other suitable materials may be also be utilized, such as metals, including, for example, steel or titanium, plywood; or composite material including plastics, resin-based composites, metals and/or plywood. The support platform may have strategically positioned tensile substrates 1220, 1222, made for example of glass reinforced tape, to accommodate bending and deformation of the structure, with the tape being put in tension during such bending and deformation. Strategic locations on the lower support platform also are provided with specific geometries that allow for predetermined deformations and define "flex regions," otherwise referred to as "flex joints," or virtual pivot locations.

For example, the support platform may include an area of reduced thickness defining a laterally extending flex region or flexing zone 53 located in front of the boss structure 49, which divides or bifurcates the support platform into front and rear portions, which may have different lengths or dimensions, with the rear portion being downwardly deflectable relative to the front portion during recline as the flex region bends. The portion of the support platform extending between the flex region 53 and the flex region 27 defines a link of a four-bar mechanism, while a portion of the support platform rearward of the flex region 53 defines in part a portion of the rear link 25. It is noted that the relative areas of reduced thickness may extend along a short distance or the majority of the width of the support platform depending upon the support and bending characteristics desired. The phrase "flex region" refers to a portion of the structure that allows for flexing or bending in the designated region, thereby allowing or providing for relative movement (e.g., pivoting) of the component or structure on opposite sides of the flex region, thereby defining a virtual pivot location, for example a horizontal pivot axis, with the understanding that the virtual pivot axis may move during the flexing, rather than being defined as a hard fixed axis. The various configurations and materials of the support platform may correspond to the configuration and materials of various components as shown and disclosed in U.S. Pub. No. 2016/0296026 A1, entitled "Seating Arrangement," and in U.S. Pub. No. 2018/0352961, entitled "Seating Arrangement and Method of Construction," the entire disclosures of which are hereby incorporated herein by reference.

Figure 7A:
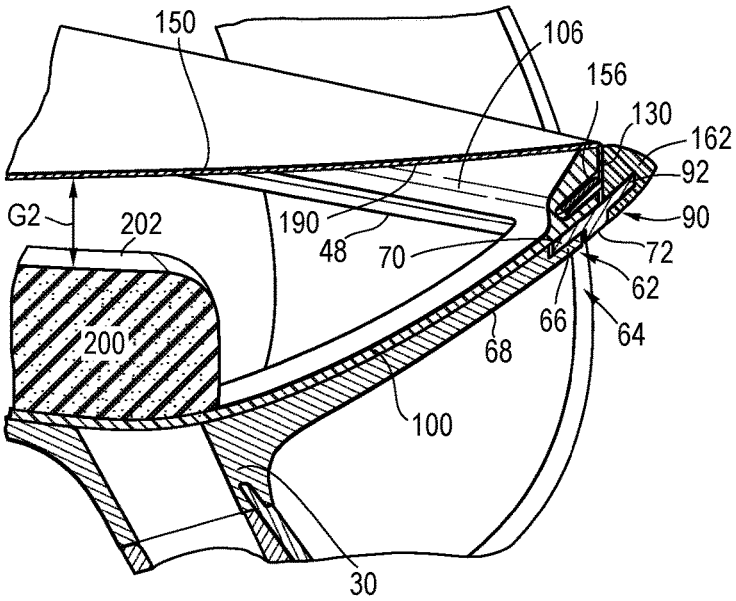
FIGS. 7A, B and C are partial cross-sectional views of a body support member.

A support ring 48 has an inner ring 50 with an interior peripheral edge 52 that defines a central opening 54. The interior peripheral edge 52 surrounds and is coupled to the outer peripheral edge 32 of the support platform, namely the rear edge 40, front edge 38 and side edges 42, of the support platform 30, which is received in the opening 54. The inner ring 50 has a trapezoidal shape defined by a front member 56, a rear member 58 and a pair of side members 60 defining the opening 54. The interior peripheral edge 52 may be stepped, meaning a peripheral edge portion 70 thereof is thinner than a central portion 72 thereof, with the edge portion 70 overlapping and mating with the edge portion 66 of the lower support platform. As shown in FIG. 7A, the edge portion 70 is positioned above the edge portion 66, with an upper surface of the peripheral edge 52 lying flush with the upper surface of the support platform 30. The edge portions 70, 66 may be secured with fasteners, such as screws and/or adhesive. It should be understood that the support platform 30 and support ring 48 in combination define a support frame 62.

In one embodiment, the support ring 48 further includes an outer ring 74 with side members 76 joined to side members 60 of the inner ring with a pair of front connectors 78 and a pair of intermediate connectors 80. A pair of rear three-sided openings 81 are defined between an inner edge of the outer ring 74, an edge of the side member and the edges of the connectors 80. The openings 81 each have an inner side 85, a longer, outer curved side 87, with the sides 87 and 85 converging along the rear of the opening 81 to define a nose 89, and a third side 91 extending along and defining the connector 80 and joining the sides 85, 87. A pair of front three-sided openings 83 are defined between an inner edge of the outer ring 74, an edge of the side member 60 and the edges of the connectors 80. The openings 83 each have an inner side 93, a longer, outer curved side 95, with the sides 93, 95 converging along the front of the opening 83 to define a nose 99, and a third side 97 extending along and defining the connector 80 and joining the sides 93, 95.

It should be understood that in one embodiment, the intermediate connectors 80 may be omitted. The outer ring has a front cross member 82 and a rear member 58, which it shares with the inner ring, and which are connected to the side members 76. The front cross member 82 is spaced apart from the front member 56, which define an elongated and laterally extending U-shaped opening 84 therebetween. A flexible membrane 55 covers the opening 84, is connected to the support ring around the perimeter of the opening, and maintains the spacing between the cross member 82 and front member 56 when the cross member 82 flexes relative to the front member 56, for example when undergoing a load applied by a user's thighs. The membrane 55 may also serve as a limiter by limiting the amount of deflection of the cross member 82 when the load is applied thereto. The membrane 55 may be made of urethane, and may be over molded on the support ring 48 to cover the opening 84. Side slots 86 allow for front portions 88 of the side members 76 to flex or bend such that the front member 82 may deflect when loaded by the user's legs, while the connectors 78, 80 provide greater rigidity to the outer ring 74. An outer peripheral edge 90 is stepped, meaning a peripheral edge portion 92 thereof is thinner than the central portion 72 thereof. A pair of lugs 94 extend downwardly from the inner ring and are disposed along the sides of the boss structure, where they are supported by the tilt control assembly 18. The support ring 48 extends radially outwardly from the lower support platform 30. The support ring, including the outer ring, the inner ring and connectors, defines an upper surface 96 and a concave cavity 98. The support ring 48 is made of a compliant flexible material, which is configured to position and hold the flexible edge member 162, described in more detail below. The support ring 48 is less stiff than the support platform, and has a modulus of elasticity that is less than a modulus of elasticity of the support platform. The support ring may be made, for example, of polyester urethane, or a thermoplastic polyester elastomer.

An upper shell, also referred to as a carrier frame 100, has a central portion 102 overlying the inner ring 52 of the support ring and the lower support platform 30, and an outer ring 104 overlying the outer ring 74 of the support ring and the upper surface 34 of the support platform. The outer ring 104 and central portion 102 of the upper shell are coupled with at least two connectors, including a pair of front connectors 106 and a pair of intermediate connectors 108, which are curved with an upwardly facing concave curvature such that is rigid and resists outward/downward deflection/deformation.

A pair of rear three-sided openings 109 are defined between an inner edge of the outer ring 104, an edge of the central portion 102 and the edges of the connectors 108. The openings 109 each have an inner side 111, a longer, outer curved side 113, with the sides 111, 113 converging along the rear of the opening 109 to define a nose 115, and a third side 117 extending along and defining the connector 108 and joining the sides 111, 113. A pair of front three-sided openings 119 are defined between an inner edge of the outer ring 104, an edge of the central portion 102 and the edges of the connectors 108. The openings 119 each have an inner side 121, a longer, outer curved side 123, with the sides 121, 123 converging along the front of the opening 119 to define a nose 125, and a third side 127 extending along and defining the connector 108 and joining the sides 121, 123.

The outer ring 104 has a front cross member 110 and a rear member 112 that are connected to side members 114. The outer ring has a peripheral length defined around the perimeter thereof, with the length being fixed or maintained as a relative constant during recline of the seat. In other words, in one embodiment, the outer ring 104, defined by the side members 114, front cross member 110 and rear member 112, does not elongate during recline, or does not undergo elastic deformation along a tangent or length thereof in response to tensile forces, although the outer ring 104 is capable of bending or flexing as described in more detail below. The front cross member 110 is spaced apart from a front edge 116 of the central portion 102, which define an elongated and laterally extending U-shaped opening 118 therebetween. Side slots 120 allow for front portions 122 of the side members 114 to flex or bend such that the front cross member 110 may deflect when loaded by the user's legs, while the connectors 106, 108 provide greater rigidity to the outer ring 104. The connectors 106, 108 overlie the connectors 78, 80, with openings 84 and 118, along with membrane 53, being aligned. The upper shell includes pads 124 that overlie the pads 46. The upper shell 100 is secured to the support platform with fasteners, including for example hooks and screws.

The upper shell, or carrier frame 100, is flexible, but stiffer than the support ring 48, and has a modulus of elasticity that is greater than the modulus of elasticity of the support ring, but the carrier frame is less stiff than, and has a modulus of elasticity less than a modulus of elasticity of the support platform 30. The upper shell, or carrier frame 100, may be made of a flexibly resilient polymer material such as any thermoplastic, including, for example, nylon, glass-filled nylon, polypropylene, acetyl, or polycarbonate; any thermal set material, including, for example, epoxies; or any resin-based composites, including, for example, carbon fiber or fiberglass, thereby allowing the support platform to conform and move in response to forces exerted by a user. Other suitable materials may be also be utilized, such as metals, including, for example, steel or titanium; plywood; or composite material including plastics, resin-based composites, metals and/or plywood.

The intermediate connectors 108 of the upper shell 100 may include an area of reduced thickness defining flex regions or flexing zones 155. The upper shell 100 also may have an area of reduced thickness defining a flex region or flexing zone 153 that overlies the flex region 53 of the underlying support platform, located front of the boss structure 48.

The upper shell, or carrier frame 100, has a body facing upper surface 126, a lower surface 128 opposite the upper surface 126 and a peripheral edge surface 130, or side edge face, extending between the first and second surfaces 126, 128. In one embodiment, the peripheral edge surface 130 is substantially planar and has a vertical orientation, although it should be understood that the edge surface may be curved, curvilinear, or non-planar, and/or may be oriented at angles other than a vertical plane. The carrier frame 100 defines a concave cavity 132 with the outer ring defining a central opening 134.

Figure 7B:
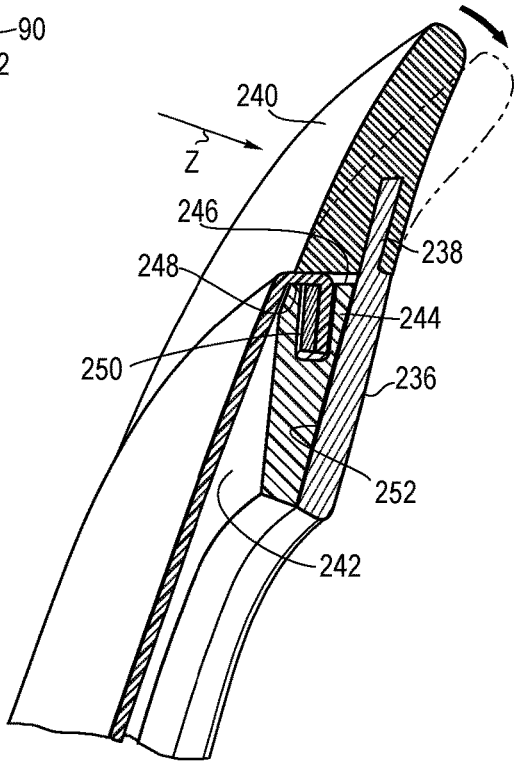
Figure 7C:
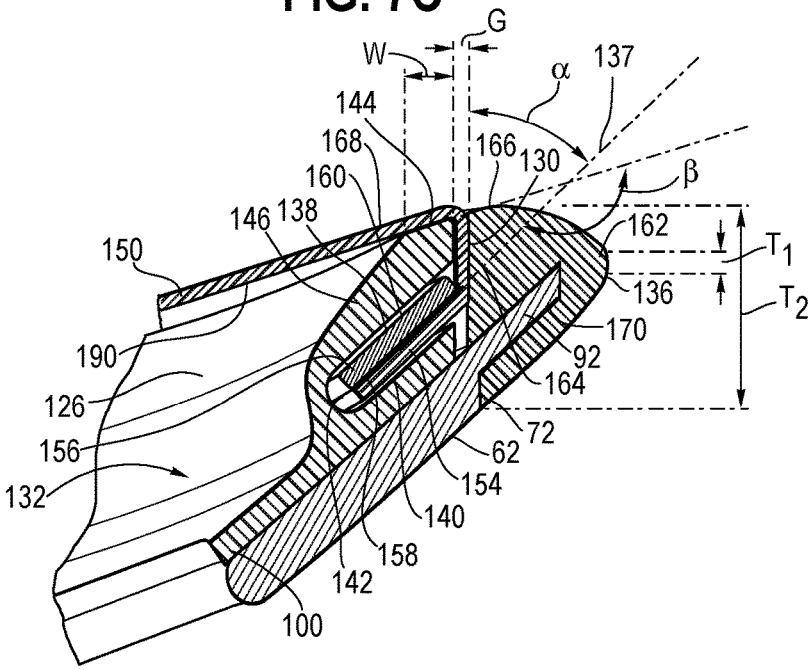
Figure 8:
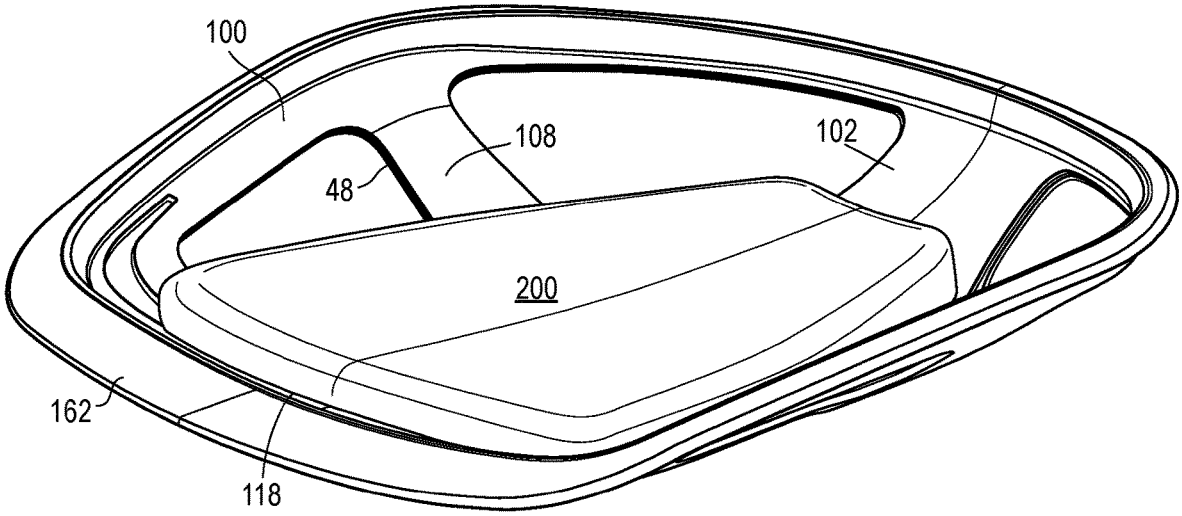
FIG. 8 is a partial perspective view of a seat without the textile material shown for the sake of illustrating the underlying components.
Figure 9:
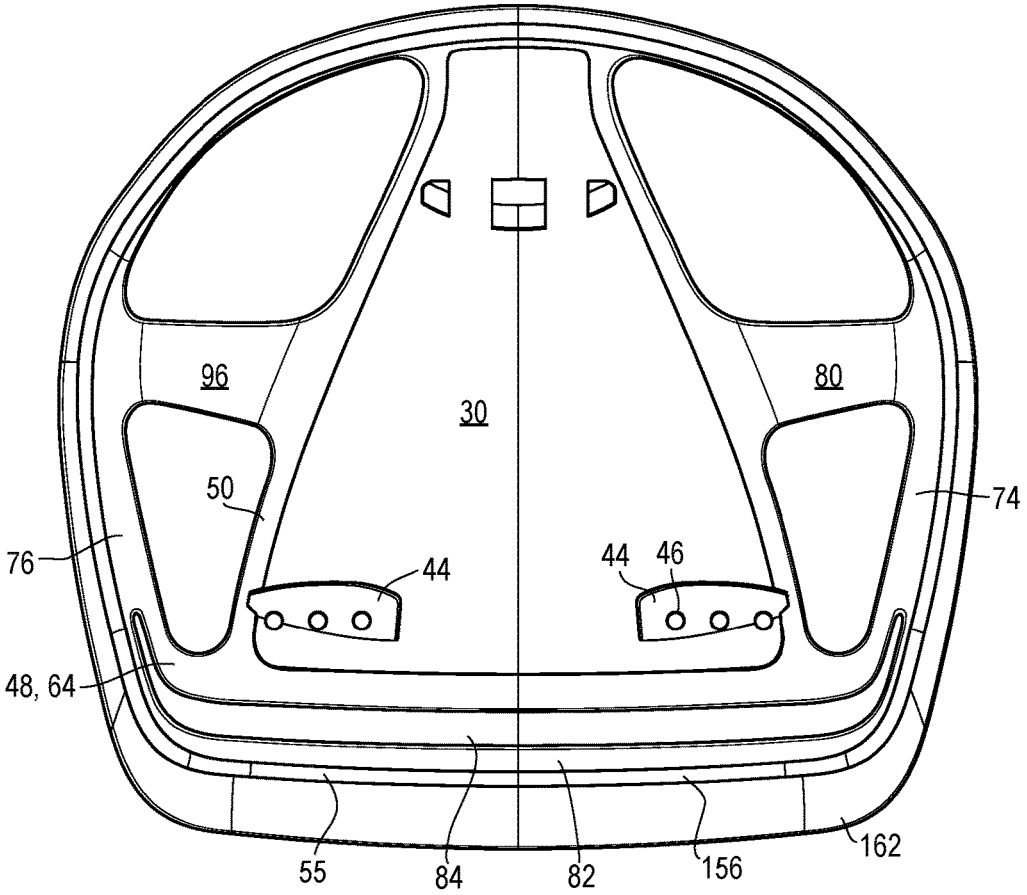
FIG. 9 is a top view of one embodiment of a seat support structure without the textile material or carrier frame shown for the sake of illustrating the underlying components.
Figure 10:
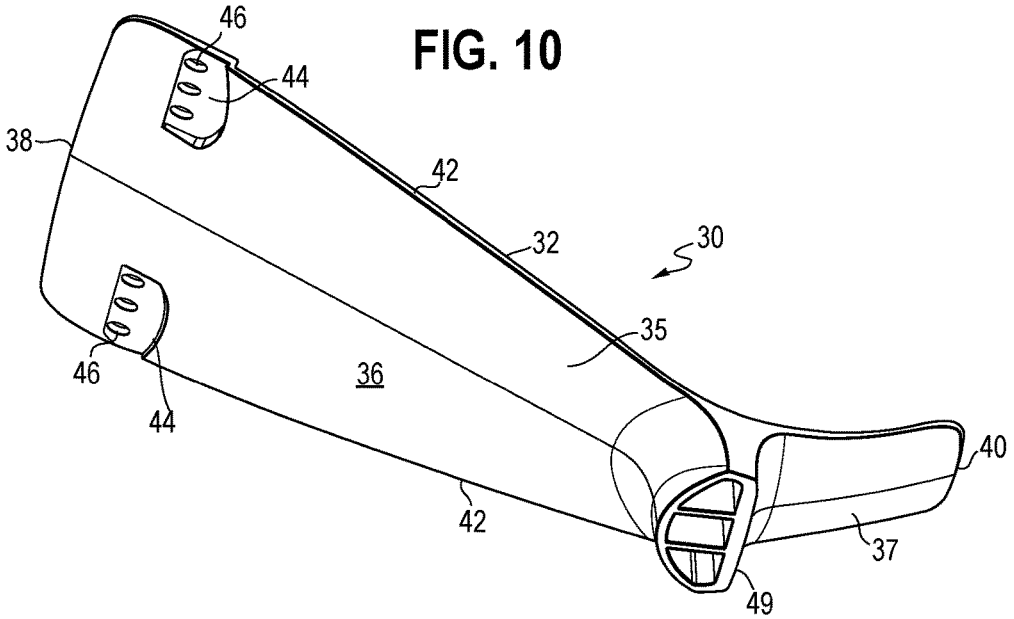
FIG. 10 is a bottom perspective view of one embodiment of a lower seat support platform.
Figure 11:
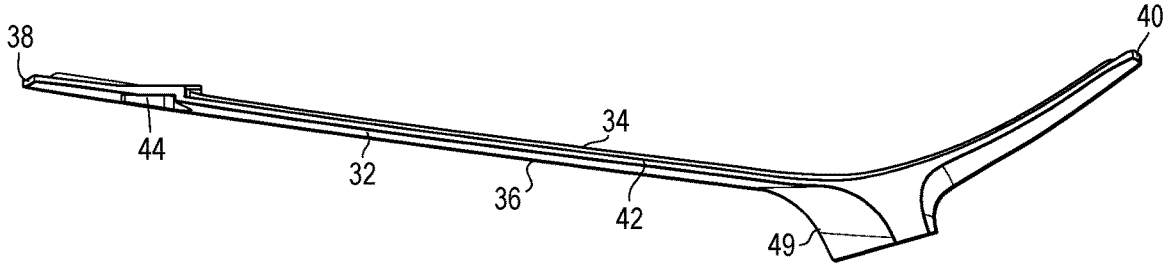
FIG. 11 is a right side view of the support platform shown in FIG. 10 with a left side view being a mirror image thereof.
Figure 12:
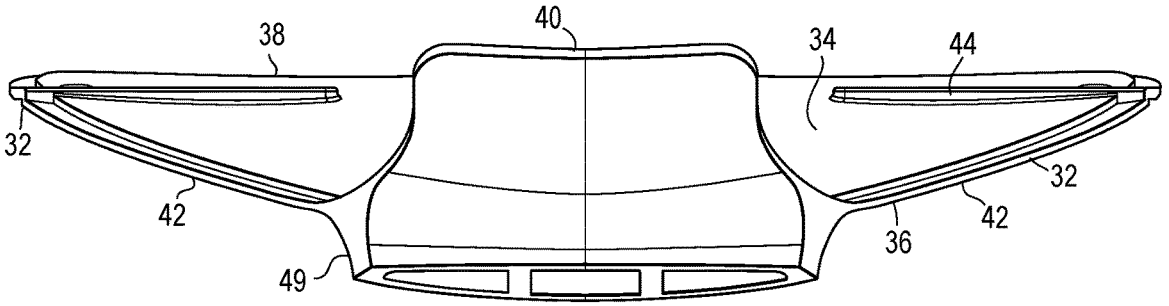
FIG. 12 is a rear view of the support platform shown in FIG. 10.
Figure 92:
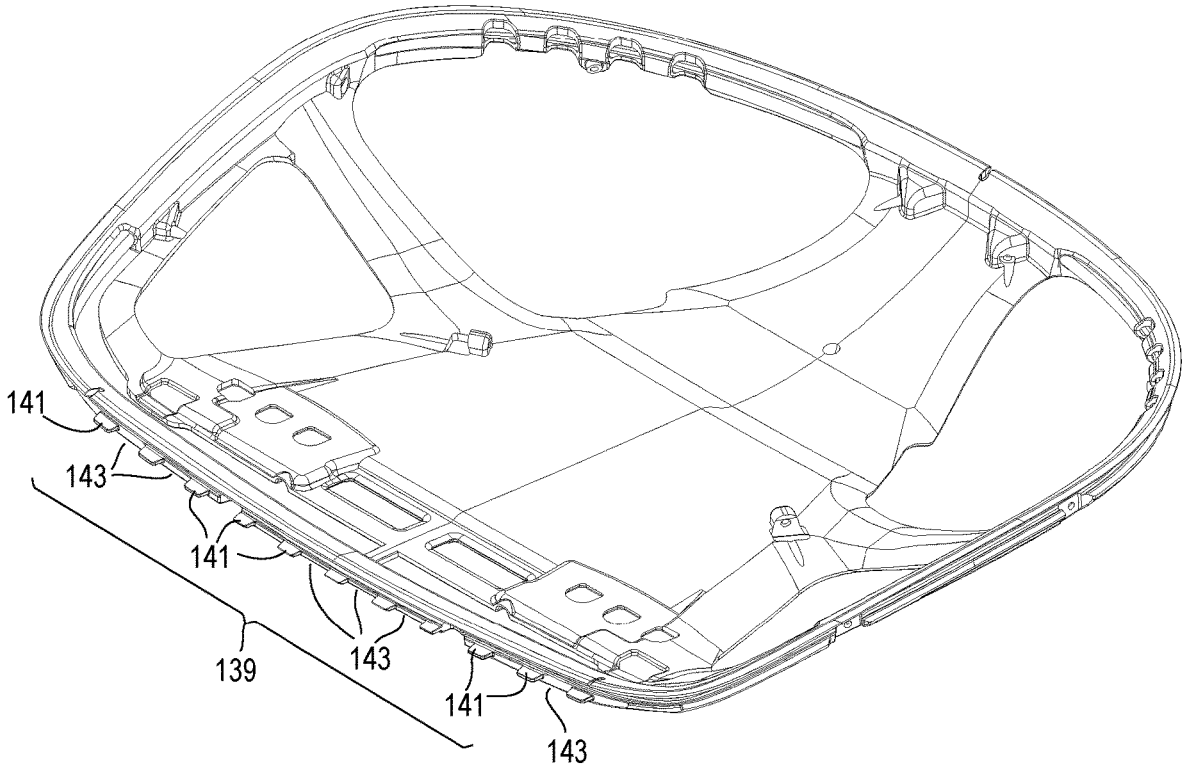
FIG. 92 is a perspective view of an alternative embodiment of a carrier frame.

A peripheral groove 136 is formed in and opens outwardly from the peripheral edge surface 130 or face. The groove 136 extends around at least a portion of the carrier frame, and in one embodiment, extends continuously around the entire periphery of the carrier frame 100. The peripheral edge portion 92 of the support frame 62 extends outwardly beyond the face 130 of the carrier frame as shown in FIGS. 7A-C. The peripheral groove 136 defines an insertion plane 137 oriented at an angle $\alpha$ relative to the peripheral edge surface 130, and relative to a gap G adjacent thereto. In various embodiments, $\alpha$ is greater than 0 degrees and less than 180 degrees, and is preferably between 30 and 120 degrees, and more preferably between 45 and 90 degrees. Defined another way, the insertion plane 137 is preferably oriented relative to a landing portion 144, or tangent of a textile material 150 supported thereby, such that the insertion plane is parallel to the landing portion and tangent, or forms an angle ß that is preferably between 135 and 180 degrees. The peripheral groove 136 has a pair of spaced apart surfaces, e.g., upper and lower surfaces 138, 140, and a bottom 142 connecting the surfaces 138, 140. The upper surface 126 of the upper shell has a landing portion 144, which is substantially horizontal, and an angled portion 146 that extends away from the landing portion and defines the cavity. The landing portion 144 may have a width (W) approaching 0, with the landing portion defined simply by an upper corner of the edge surface 130. In one embodiment, shown in FIG. 92, a lip portion 139 running along the front of the carrier frame defines in part the groove 136. The lip portion 139 has a plurality of tabs 141 separated by notches 143, which increase the flexibility of the carrier frame, but provide sufficient rigidity to retain the stay.

A textile material 150 is secured to the carrier frame 100 across the central opening 134 such that it covers the concave cavity 132. The textile material may be a suspension material, or may cover a cushion supported by the support and/or carrier frames 64, 100. The textile material covers the upper surface 126 of the upper shell, and engages the landing portion 144. The textile material 150 wraps around and engages a portion of the outer peripheral edge surface 130, and in particular an upper portion 152 of the peripheral edge surface extending between the groove 136 and the upper surface 126, or landing portion 144 thereof. A peripheral edge portion 154 of the textile material 150 is coupled to the peripheral edge of the upper shell, for example with the edge portion 154 of the textile material being disposed in the groove 136. In one embodiment, a stay 156 (shown in FIG. 20 without the textile material), formed for example by a ring (e.g., a plastic or polyester), may be secured to the edge portion of the textile material, for example with adhesives, sewing/stitching, fasteners and other devices, or by forming a loop disposed around the stay. In one embodiment, the stay has one surface 158 facing and engaged with the textile material and an opposite surface 160 that remains uncovered. The stay 156 and edge portion 154 of the textile material, which is configured as a suspension material, are disposed in the groove 136 to secure the suspension material in tension across the opening. In one embodiment, the stay 156 is formed as a continuous ring having a fixed length, with the stay 156 being relatively inelastic and resistant to elongation along a length thereof, but which may be flexible and bendable so as to move with the side members 114 and outer ring 104 during recline of the seat. In one embodiment, as shown in FIGS. 7A-7C, the exposed or uncovered surface 160 of the stay 156 directly engages the surface 138 of the groove, without any textile material or other substrate disposed therebetween. The angular orientation of the groove 136 and stay 156 relative to the edge surface helps to ensure that the stay 156 does not become dislodged from the groove. In one embodiment, the stay 156 and textile material 150 are inserted into the groove 136 without any auxiliary fastening systems, such as adhesive or mechanical fasteners, but rather are engaged only by friction as the textile/suspension material is put in tension as explained hereinafter.

Figure 44:
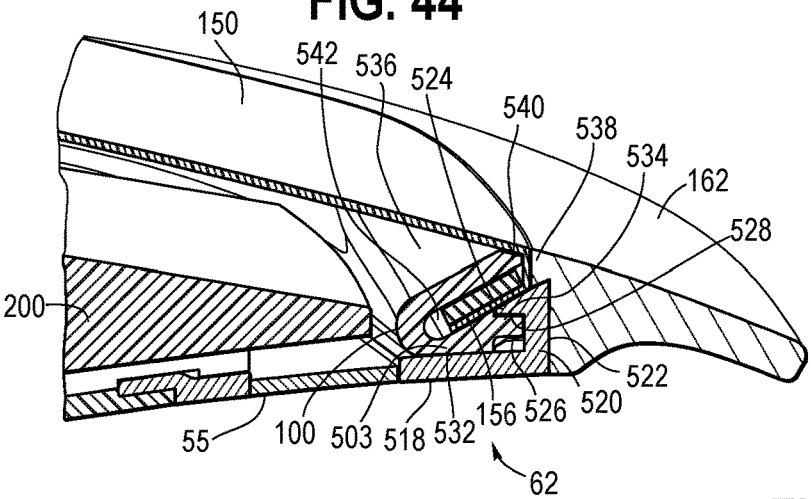
FIG. 44 is a partial, cross-sectional view of a front portion of a seat assembly.
Figure 45:
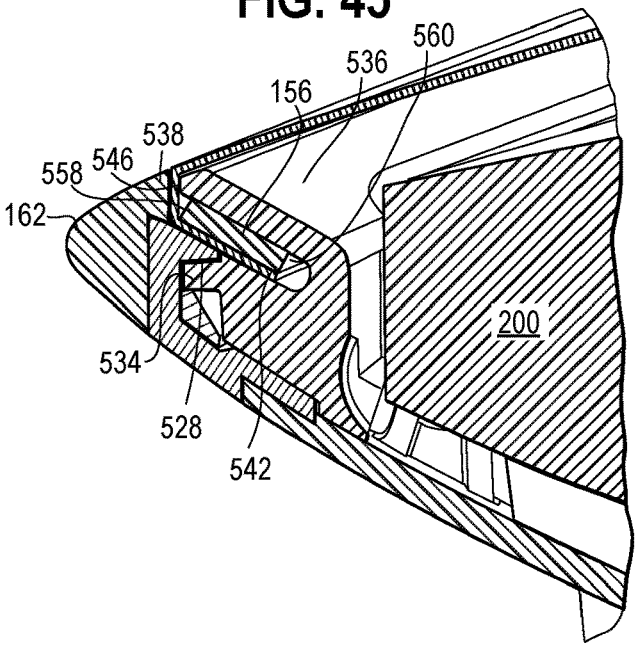
FIG. 45 is a partial, cross-sectional view of a side portion of a seat assembly.
Figure 46:
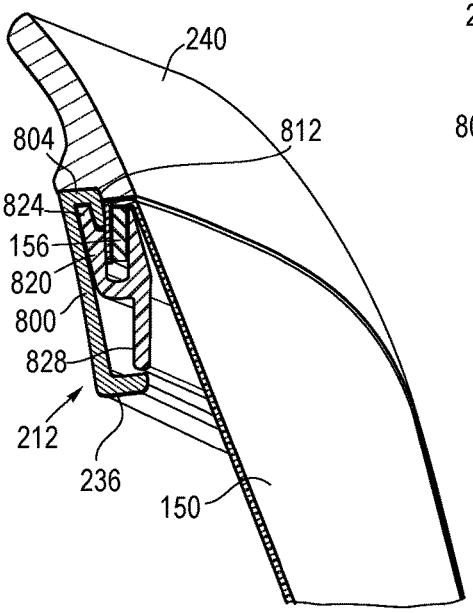
FIG. 46 is a partial, cross-sectional view of a top portion of a back support.
Figure 47:
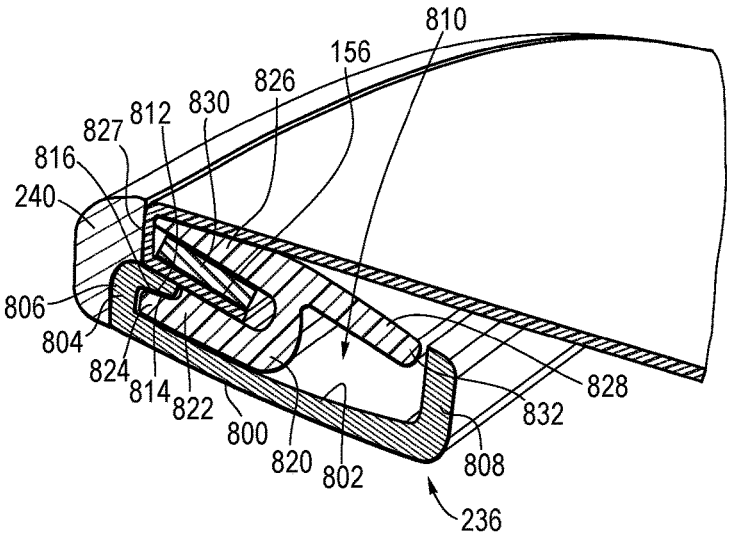
FIG. 47 is a partial, cross-sectional view of a side portion of a back support.
Figure 48:
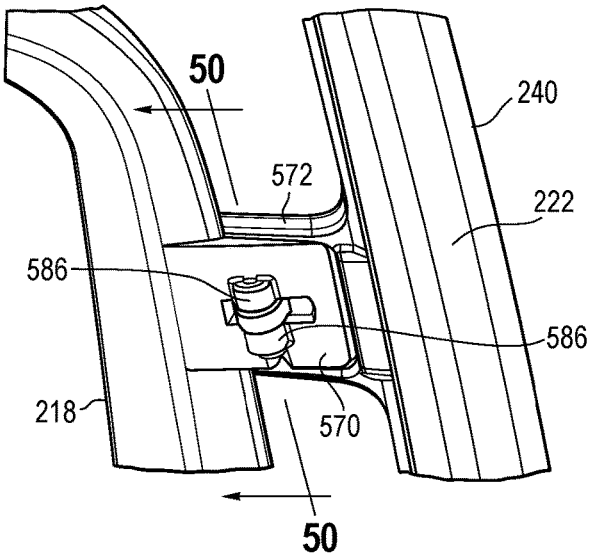
FIG. 48 is a partial front view of a connection between the back frame and the back support.

In another embodiment, and referring to FIGS. 44 and 45, the support frame 62 includes a bottom wall 518 defining a body facing surface and a peripheral edge wall 520 having an outer surface 522. A lip 524, or catch, defined in one embodiment by a tab, extends laterally inwardly from the peripheral edge wall 520 and defines a channel 526 with the bottom wall. Along a side portion of the seat, shown in FIG. 45, the lip or catch has an engagement surface 528 that angles upwardly and inwardly from the peripheral edge wall while an upper surface of the wall is substantially horizontal. Along a front portion of the seat, shown in FIG. 44, the upper surface of the lip is angled downwardly and inwardly, while the engagement surface 528 is substantially horizontal.

A carrier frame 100 has a body portion 530 with a bottom surface 532 overlying and engaging the bottom wall and an insert portion 534 that is received in the channel 526 and engages the engagement surface 528. As shown in FIG. 44, the carrier frame has an upper surface 536 that is angled downwardly and inwardly, matching the top surface of the lip or catch, such that suspension material may deform against the angled surface. As shown in FIG. 45, the insert portion 534 is angled downwardly and outwardly so as to mate with the engagement surface. The orientation of the insert portion 534 facilitates installation as the insert portion may be more easily inserted into the channel when oriented at an angle such that the insert portion is underlying the lip 524. Tension applied by the textile material 150, configured as a suspension material in one embodiment, thereafter applies a moment to the carrier frame causing it to bear up against the bottom surface of the support frame and the engagement surface 528. A flexible edge member 162 is coupled to the outer surface 522 of the peripheral edge wall of the support frame, with a lip portion 538 overlying a top surface of the support frame. The flexible edge member 162 has an inner surface spaced apart from and facing inwardly toward the peripheral edge wall of the carrier frame, with the inner surface and the peripheral edge wall of the carrier frame defining a gap therebetween. A portion of the textile material is disposed in the gap, with the textile material covering the body facing surface of the carrier frame. The carrier frame has a peripheral edge 540 facing outwardly, and includes a groove 542 opening laterally outwardly therefrom. The peripheral edge of the textile material is secured to a stay 156, with the edge portion of the textile material and the stay disposed in the groove 542.

Suspension Material:

In one embodiment, the textile material is made of an elastomeric woven or knitted material, and may be configured as a suspension material having heat-shrinkable yarns and heat shrinkable elastomeric monofilaments, which shrink in response to the application of energy, for example heat, whether applied by radiation or convection. Various suitable suspension materials are disclosed in U.S. Pat. No. 7,851,390, entitled "Two-Dimensional Textile Material, Especially Textile Fabric, Having Shrink Properties and Products Manufacture Therefrom," the entire disclosure of which is hereby incorporated herein by reference. One commercially suitable heat-shrink suspension material is a SHRINX fabric available from Krall+Roth, Germany.

Figure 56:
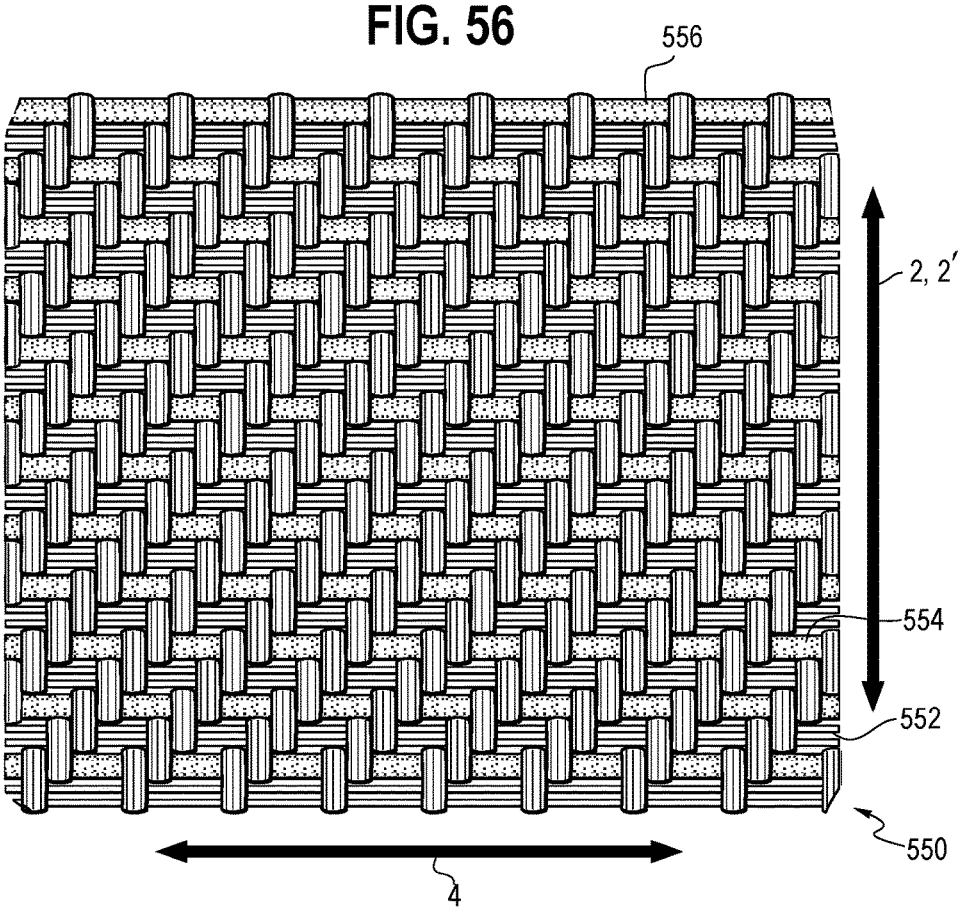
FIG. 56 is a partial, plan view of a textile material installed on the seat assembly and back support.

Referring to FIG. 56, in one embodiment, the suspension material is made from a fabric blank 500 having a plurality of heat shrinkable, elastic (elastomeric) threads 552, configured as monofilaments in one embodiment, running in a first, lateral direction 4, or warp direction, and a plurality of non-extensible threads 554, configured as yarns or monofilaments in various embodiments, running in the same lateral/warp direction 4. It should be understood that the heat shrinkable, elastic threads (e.g., monofilaments) and non-extensible threads (e.g., monofilaments) may also run in the longitudinal direction 2, 2'. In one embodiment, the heat shrinkable, elastic threads 552 and the plurality of non-extensible threads 554 alternate 1:1 or 2:1, or are disposed side-by-side as shown in FIG. 56, with various embodiments having a weave density of 4-10 elastic threads/cm, more preferably 7-9 elastic threads/cm, and a weave density of 8 elastic threads/cm in one embodiment. In other embodiments, the ratio of threads may be altered, with more or less elastomeric threads than non-extensible threads. In one embodiment, the elastic threads are about 0.40 mm in diameter, with the understanding that the elastic threads may be made thicker or thinner depending on the desired spring rate. It should be understood that more or less elastic threads may be used depending on the cross-sectional area of the thread. For example, the weave density may be defined by a total cross-sectional area of the combined elastic thread(s) per cm (measured longitudinally), including for example elastic thread(s) having a combined cross-sectional area (whether a single thread or a plurality of threads) between 0.502 $mm^2$/cm and 1.256 $mm^2$/cm in various embodiments, more preferably between 0.879 $mm^2$/cm and 1.130 $mm^2$/cm, and a combined cross-sectional area of 1.005 $mm^2$/cm in one embodiment.

A plurality of yarn strands 556 are interwoven with the elastomeric and non-extensible threads 552, 554 in the weft direction, or longitudinal direction 2, 2' in one embodiment. The non-extensible threads 554 and the yarn strands 556 do not shrink when exposed to heat or energy, and are not elastomeric. Rather, the yarn strands 556 provide shape control to the overall suspension material in a final configuration after heat shrinking. The yarn strands 556 may be made of various colors, e.g., blue, to provide color to the textile material. The overall color of the blank is thereby easily changed simply by introducing different yarns in the weft direction. In contrast, the elastomeric threads are preferably transparent or black.

Figure 55:
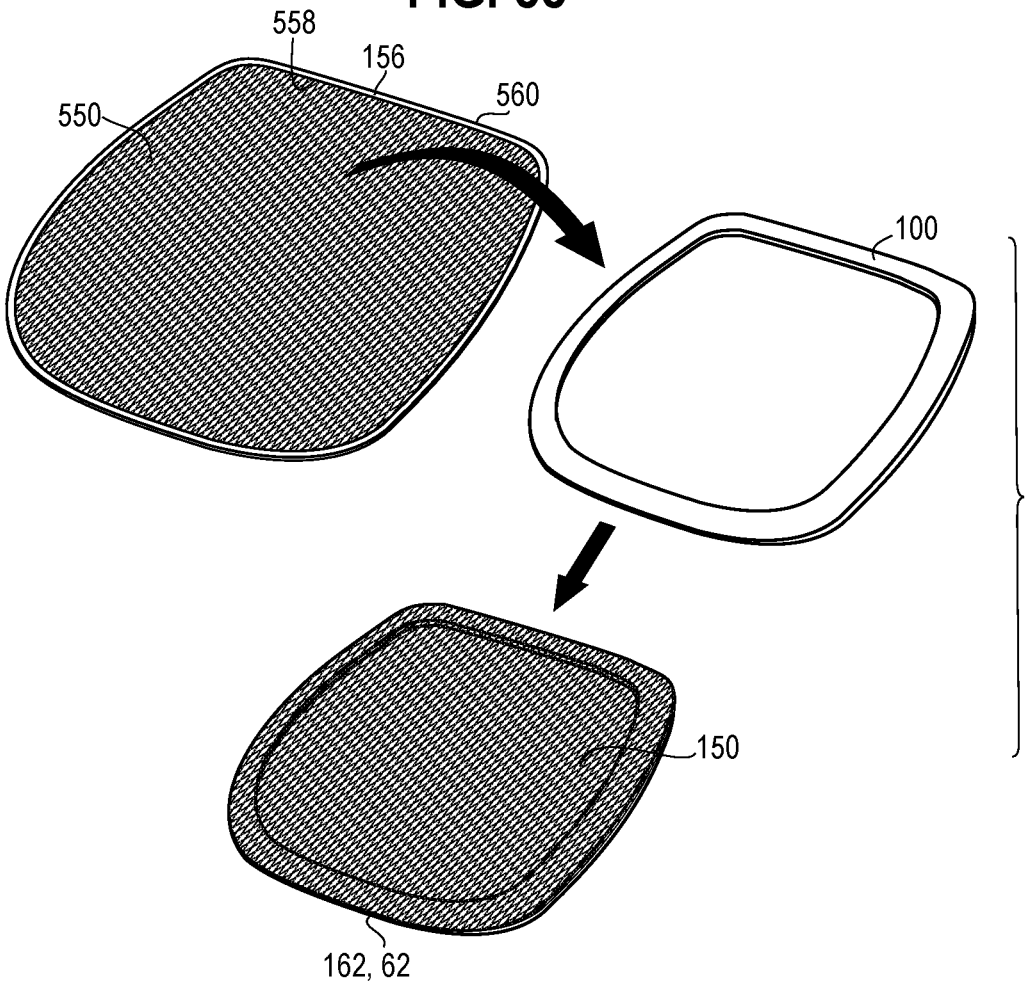
FIG. 55 is a flow diagram illustrating the assembly of the seat assembly.
Figure 85:
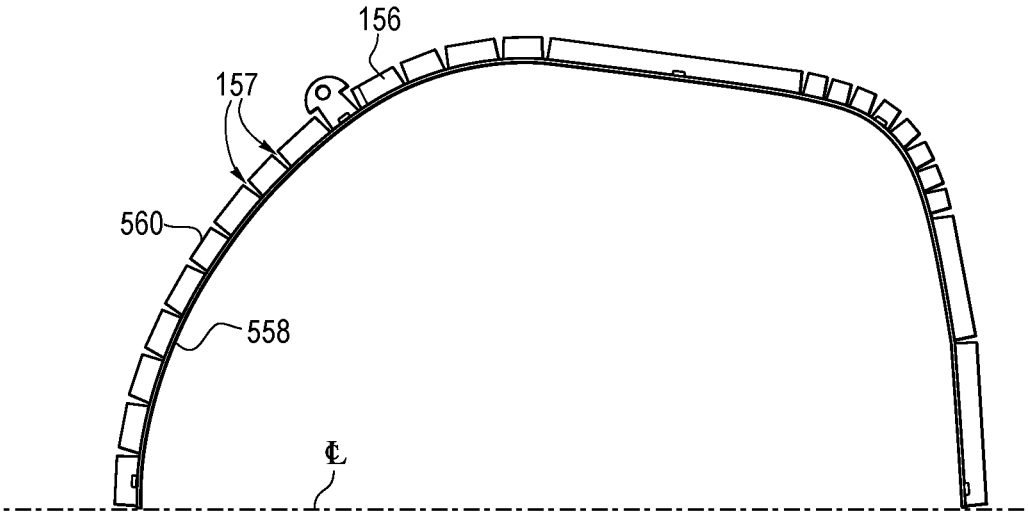
FIG. 85 is a partial view of one embodiment of a stay.
Figure 86:
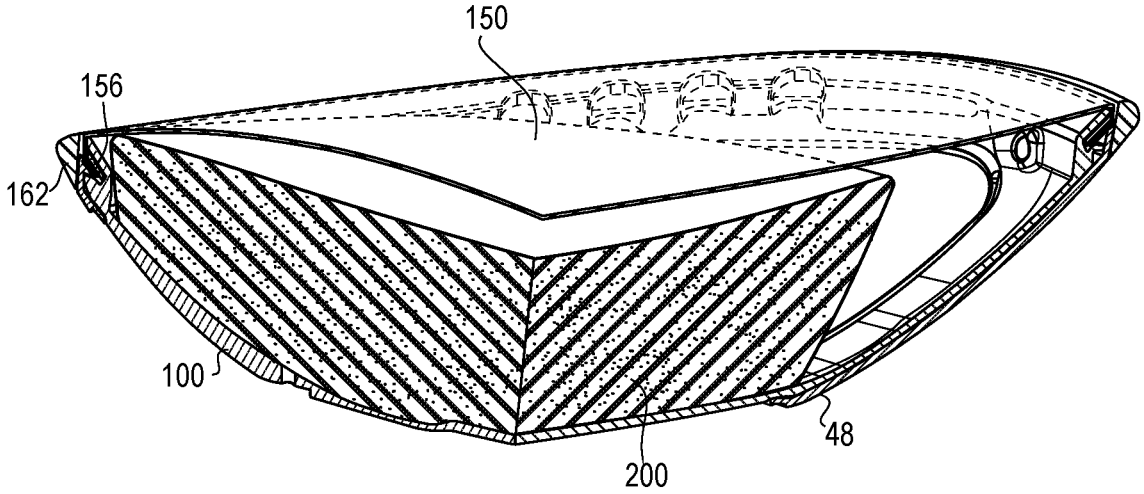
FIG. 86 is a partial cut-away view of a seat assembly.

Referring to FIGS. 55 and 85, an annular stay 156 is secured to the fabric blank for example by sewing or with staples or other fastening systems, with the annular stay having first and second annular edges 558, 560. The annular stay is rotatable 180 degrees between a first configuration, wherein the first annular edge 558 is disposed radially inwardly from the second annular edge 560, and a second configuration, wherein the first annular edge 558 is disposed radially outwardly from the second annular edge 560 as shown in FIGS. 44 and 45. The first annular edge 558 on opposite sides of the stay define first and second dimensions therebetween in the first lateral direction 2, 2' when the stay is in the first and second configurations, wherein the first and second dimensions are substantially the same in one embodiment, meaning as the stay is rotated, the first annular edge remains stationary, albeit rotated 180 degrees. The stay 156 includes open notches 157 in the second annular edge, which close and allow for the stay to be rotated from the first to second configurations. The fabric blank 500 is initially configured with pockets of extra material at the corners to accommodate the rotation of the stays at those corners. After rotation, the stay 156 may be installed in the carrier frame 100, with the carrier frame and fabric then installed or coupled to the support frame 62, with the flexible edge 162 connected to the support frame 62 and disposed around the periphery of the textile material.

Energy, such as heat, may be applied to the fabric blank from an energy source, causing the heat shrinkable elastomeric threads 552 to shrink. In other embodiments, the textile material is wrapped around or covers a cushion or underlying substrate such as a plastic or metal web, which supports the user, with the edge of the textile material secured to the carrier frame as described herein. In those embodiments, the textile material 150 may be, but is not necessarily, put in tension around the cushion or across the opening 134.

The flexible edge member 162 is configured as a ring surrounding and coupled to the peripheral edge 92 of the support frame. It should be understood that the ring may be continuous, or that the flexible edge member may extend only partially around the periphery of the carrier frame 100. The flexible edge member 162 extends upwardly from the support frame 64 and has an inner peripheral surface 164, or face, facing inwardly toward, and spaced apart from, the peripheral edge surface 130 of the carrier frame so as to form a gap G, for example and without limitation having a width of between 0.50 to 1.00 mm that is communication with the groove 136, meaning the groove and gap form a continuous, but non-linear slotted opening or pathway that receives the textile material 150. In one embodiment, the inner surface 164 is substantially planar and has a vertical orientation and extends in the Z direction, although it should be understood that the edge surface may be curved, curvilinear, or non-planar, and/or may be oriented at angles other than a vertical plane. In one embodiment, the inner surface 164 has substantially the same shape as the peripheral edge surface 130 such that the gap G is maintained constant, regardless of whether either surface or the gap G is linear. In one embodiment, the gap G is the same or slightly larger than the thickness of the textile material, which may have a thickness of about 0.75 to 1.00 mm, while in other embodiments, there is no gap (i.e. G=0), or the gap G is less than the thickness of the textile material, with the surfaces 130, 164 abutting, and/or squeezing or slightly compressing the textile material 150 therebetween. The inner surface 164 faces and covers the groove 136 and textile material 150. In addition, the flexible edge member 162 further entraps the stay 156 and textile material 150, thereby further helping to ensure that the stay 156 does not become dislodged from the groove 136.

The flexible edge member 162 is made of a thermoplastic olefin or thermoplastic elastomer, and may be made of the same material as the membrane 53, such that the flexible edge member may be compressed, for example if impacted. The flexible edge member 162 has a greater resilience, or is more flexible and has a substantially lower modulus of elasticity less than the support frame 62, with a durometer in the shore D range, with one embodiment having a durometer of 80-90. The flexible edge member 162 protects the textile material 150 from inadvertent impact and wear and has an upper surface 166 substantially flush with, or slightly lower than, an upper surface 168 of the textile material 150, thereby preventing snags and providing a pleasing appearance. As mentioned, the flexible edge member 162 abuts, or is slightly spaced from, the portion of the textile material 150 disposed between the flexible edge member 162 and carrier frame 100. The flexible edge member has a groove 170, with the peripheral edge 92 of the support ring being disposed in the groove 170. In one embodiment, the flexible edge member 162 is over molded onto the peripheral edge 92 of the support frame 62, or support ring, and may be made of the same material as the membrane 53. In other embodiments, the flexible edge member may be secured to the support frame by friction, or with adhesives, mechanical fasteners, such as staples or screws, or combinations thereof. The geometry of the flexible edge member 162 further promotes the protective and elastic properties thereof. For example, the flexible edge member 162 may be tapered from a first thickness T1 along the inner surface 164 to a second thickness T2 at an outermost peripheral edge thereof, with the thickness being measured parallel to the inner surface 164, or in substantially the Z direction. In one embodiment, the nose tapers to a point where T2=0. In one embodiment, the flexible edge member 162 in cross-section has a rounded nose shape. The flexible edge member 162 may be compressed in response to a load applied in the X and/or Y directions, or may deflect in response to a load applied in the Z direction as shown in FIG. 7B.

Figure 20:
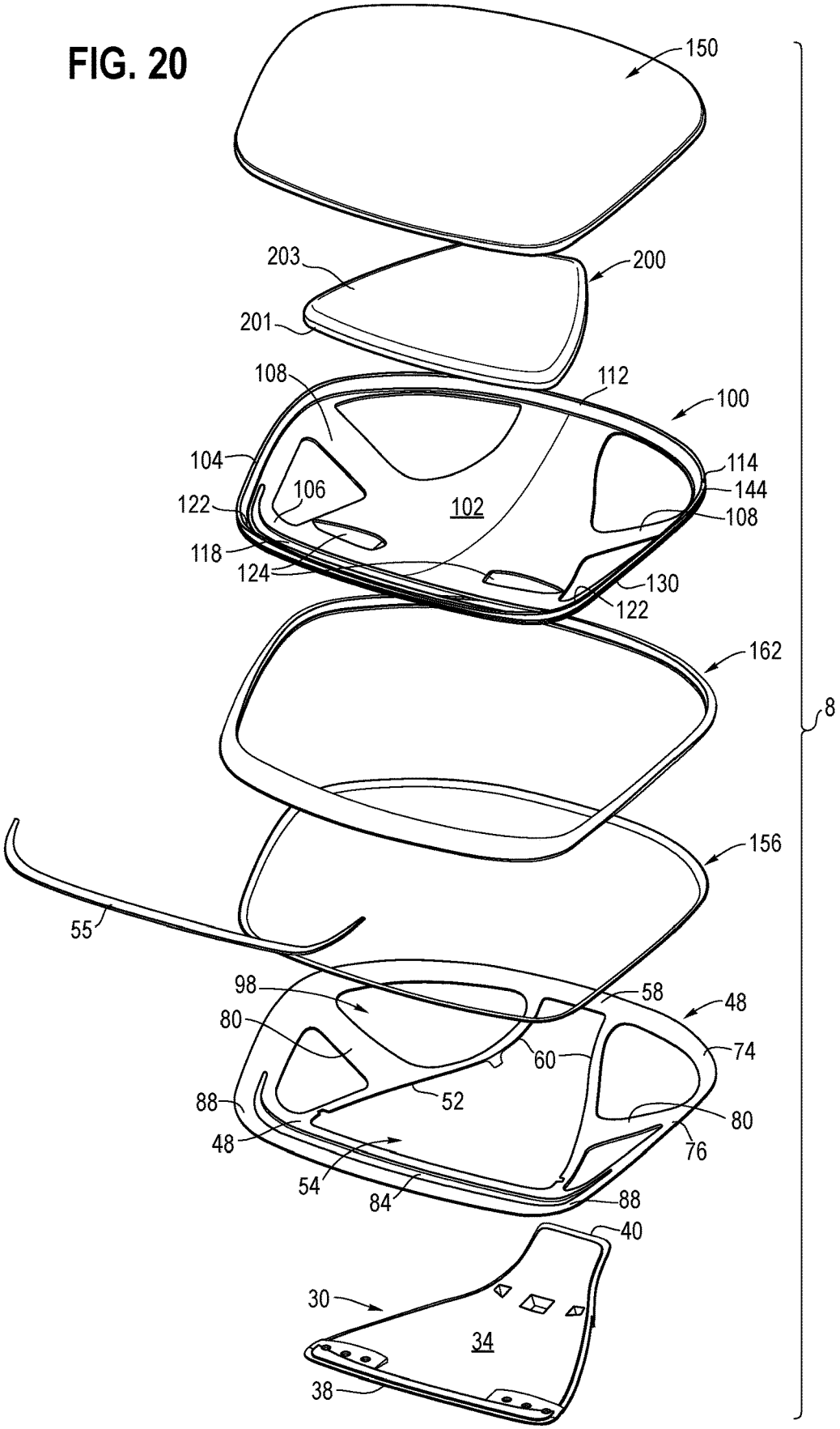
FIG. 20 is an exploded view of a seat assembly.

In one embodiment, an auxiliary support member 200, shown as a cushion, is disposed between the upper surface 126 of the carrier frame 100 and a bottom surface 190 of the textile material 150, configured as a suspension material, or the space defined therebetween. An upper surface 202 of the auxiliary support member 200 is spaced apart from the bottom surface 190 of the suspension material such that a gap G2 or space is defined therebetween when the suspension material is in an unloaded configuration (i.e., without a user disposed on the suspension material). In various embodiments, the gap G2 may be maintained as a constant, with the cushion having a contoured upper surface 202 that matches the contour of the bottom surface 190 of the suspension material. In various embodiments, the gap G2 is greater than 0 and less than 5 mm, and in one embodiment is 3 mm, such that the suspension material contacts the auxiliary support member 200 as soon as the user engages, or sits on, the suspension material. The auxiliary support member 200 may have a generally trapezoidal shape in plan view that matches the shape of the central portion 102 of the carrier frame or the support platform 30. The auxiliary support member 200 extends forwardly to cover the opening 118 and support the thighs of the user. The auxiliary support member may be made of foam. The auxiliary support member 200 may be secured to the support platform 30 and/or carrier frame 100 with fasteners, including mechanical fasteners such as screws or adhesive. In one embodiment, the auxiliary support member 200 has a bottom substrate 201, for example a plastic or wood sheet, that may be engaged with fasteners and which is connected to, or embedded in, an upper foam cushion 203 as shown in FIG. 20.

Figure 18:
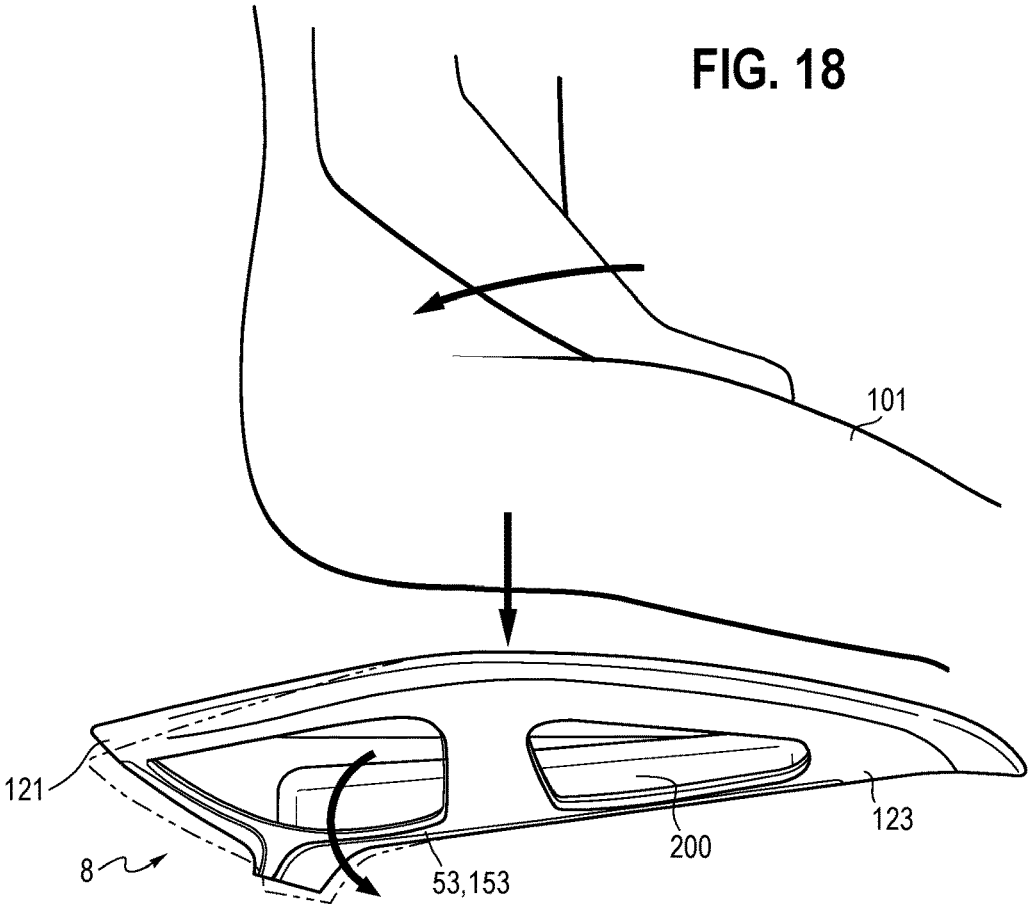
FIG. 18 is a schematic side view illustrating flexing of the seat assembly during recline.
Figure 19:
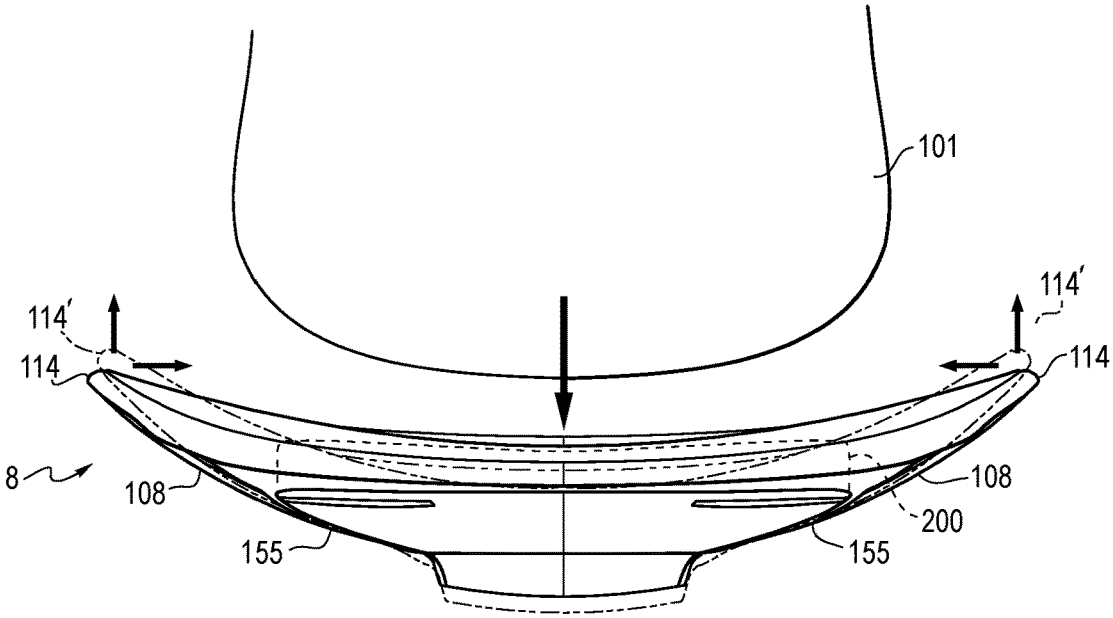
FIG. 19 is a schematic front view illustrating flexing of the seat assembly during recline.

In operation, and referring to FIGS. 18, 19 and 21, as a user sits on the suspension material 150, the load applied to the suspension material 150 causes it to deflect downwardly toward the auxiliary support member 200. If the load is such that the suspension material deflects across the distance G2 and comes into contact with the auxiliary support member 200, the auxiliary support member 200 thereafter may absorb the additional loading and support the user.

It should be understood that in other embodiments, the auxiliary support member 200 abuts and supports the textile material in an unloaded condition. For example, the textile material may simply cover a cushion, which fills the space of the cavity 132 of the carrier frame, with the textile material forming an upholstery cover over the top of the cushion.

In one embodiment, a method of manufacturing or assembling a body support member 10 includes positioning and securing the auxiliary support member 200 on top of the carrier frame 100. The method further includes disposing the peripheral edge portion 154, 252 of the textile material 150, 234 into the peripheral groove 136, 244 formed in the peripheral edge surface 130, 246 of the frame, with the stay 156, 250 engaging one surface of the groove. As the stay 156, 250 is rolled over for insertion into the groove, the suspension material covers the portion of the peripheral edge surface 130, 246 between the groove and the upper (or front) surface 126 (i.e., body-facing first surface of the frame). The carrier frame 100, 242 is then connected to the support frame 62, 236, which has a flexible edge member 162, 240 secured thereto for example by way of support ring 48. Conversely, the flexible edge member 162 may first be connected to the carrier frame 100, for example by way of the support ring 48, with those components thereafter being coupled to the support platform 30. In one embodiment, the flexible edge member 162, 240 is secured to the support frame 62, or support ring 48, by over molding the flexible edge member 162 onto the peripheral edge 92 of the support frame/support ring. The flexible edge member may be secured in other ways, including with adhesive or mechanical fasteners. Energy, for example thermal energy or heat applied by radiation or convection, may be applied to the suspension material 150, 234, causing the suspension material to shrink and create tension therein. The energy may be applied to the suspension material either before or after the carrier frame 100, 242 is secured to the support frame 62, 212. As the suspension material shrinks, the suspension material is put in tension across the opening 134 and the stays 250, 156 are anchored in the grooves 136, 244.

Figure 79:
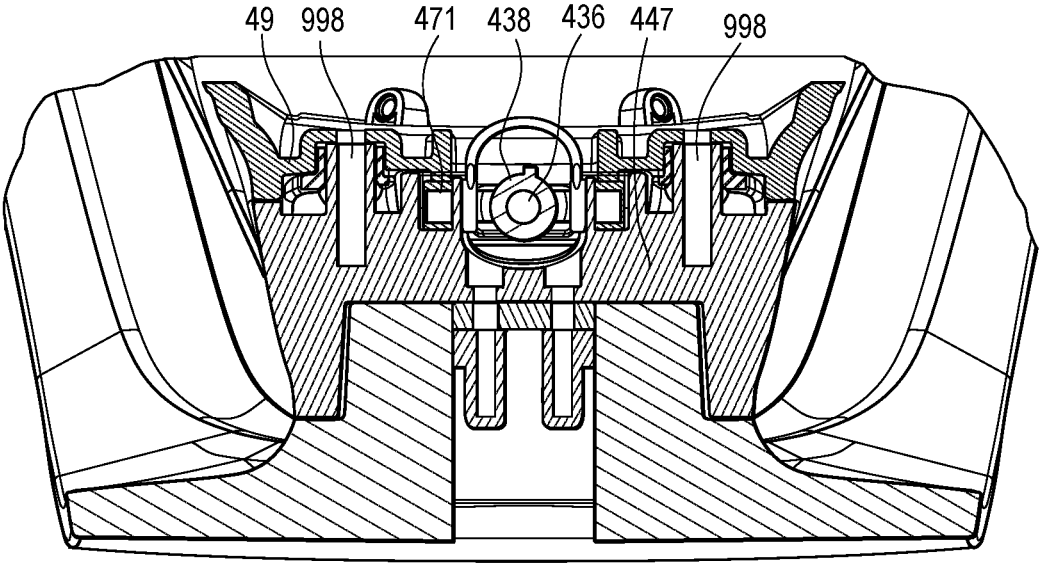
FIG. 79 is a cross-sectional view of the tilt control assembly, recline limiter and energy boost taken along line 79-79 of FIG. 78.

Backrest Assembly:

Referring to FIGS. 1-6, 7B, 22-43 and 77-79, the backrest assembly 6 includes a back frame 210 and a back support 212, otherwise referred to as a support frame. The back frame is relative rigid, meaning it does not substantially flex/bend or otherwise elastically deform during recline. The back frame 210 has a lower portion 214 that is connected to the rear portion of the tilt control assembly 18. The portion 214 includes an upwardly extending arm 992 or post structure having a forwardly facing cavity 994 in which the arm 407 is disposed or nested. The connector 479 has a downwardly facing cavity 938 in which the arms 407, 992 are disposed or inserted, thereby trapping and securing the arms 407, 992 to together to define at least in part the rear link 25. A front wall 944 of the connector, defining in part the cavity 938, has a forwardly curved lip that transitions towards and interfaces with the lower portion 400, while a rear wall 946 nests in a recess defined by a rear of the arm 992. The lower portion 214, or lower support arm, extends generally horizontally in the longitudinal direction 2' along a central axis of the seating structure. The lugs 94 of the seat assembly extend downwardly from the inner ring and are disposed along the sides of the boss structure 49, where they are disposed in the cavity or otherwise secured to the arm and rear link. The boss structure 49 covers the top of the cavity and captures the cross member 471 therebetween as shown in FIG. 79, with an upper portion 940 of the connector 479 defining an insert portion received in the boss structure 49. The boss structure 49 and connector 479 define a forwardly facing opening 942 through which an end of the shroud 950 is disposed as shown in FIG. 78. The back frame 210 is pivotable with the rear link 25 about the flex region 31, with the lower portion 214 being an extension of and defining in part the rear link 25. The back frame 210 is pivotable rearwardly relative to the base 12 during recline.

Figure 49:
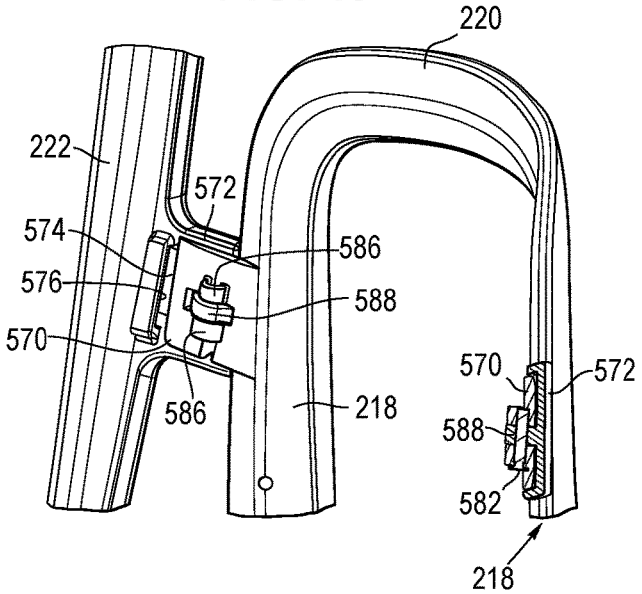
FIG. 49 is a partial front view of a connection between the back frame and the back support.

A transition portion 216, which is a curved and defines a rearwardly facing convex bow shape in one embodiment, extends rearwardly and upwardly from the lower portion 214. A pair of laterally spaced uprights 218 extend upwardly from the transition portion 216. The back frame 210 further includes an upper cross member 220 extending between and connecting upper ends of the uprights 218, with the cross member 220, upright 218 and lower portion 214 defining a central opening. The lower portion, including a portion (arm 992) of the rear link, uprights, and cross member may be integrally formed. As shown in FIG. 49, the cross-section of the uprights 218 are angled forwardly and outwardly, which increases the (bending) moment of inertia of the uprights and thereby makes the uprights, in combination, resistant to flexing or bending about a lateral axis 4, and also resistant to deformation in the lateral direction, i.e., resistant to bending about the horizontal longitudinal axis 2'. It should be understood that in an alternative embodiment, the back frame may include a single upright, for example a central spine member arranged along a longitudinal centerline of the backrest, with laterally extending arms having ends connected to the back support. Alternatively, the upright may be configured as a shell that extends laterally between and has side portions connected to the back support. The back frame may also be configured with more than two uprights.

The back support 212, otherwise referred to as a support frame, is flexible, and includes flex regions 225, 233 allowing it to bend and deflect in response to the user reclining in the body support structure. The back support has opposite sides spaced apart in the lateral direction and a top and bottom spaced apart in a longitudinal direction. The back support, or support frame 212, includes a pair of laterally spaced uprights 222, each having a forwardly facing convex bow shaped portion 223 at a first location proximate a lumbar region of the back support, with each bow shaped portion including and defining a flex region 225, which may be configured with thinner and flatter cross-sections, or sections having lower bending moments of inertia, for example about a horizontal axis, than the adjacent or remaining portions of the uprights. It should be understood that in an alternative embodiment, the back support may include a single upright, for example a shell that extends laterally between and has side portions connected to the back frame. The shell may be made of a flexible plastic. The shell may have a flex region defined laterally across the entire width thereof adjacent the lumbar region. The shell may have a forwardly facing concave contour, with side portions positioned forwardly of a central portion and defining a lateral space therebetween, and may support a suspension material secured to the side portions across the lateral space, for example with stays as disclosed herein. If configured with a single upright, the back support may be connected to the back frame, whether configured with one more uprights, with a pair of connectors arranged along each side of the single upright.

A bottom portion 224 extends between and connects the uprights. The back support 212 further includes a lower portion or support arm 226 that extends forwardly from the bottom portion, with the support arm or lower portion coupled to the control assembly, and in particular the rear link 25 below the seat 8, including seat support 308. The lower portion includes a transition portion 217 connecting the support arm 226 and the bottom portion 224. The transition portion 217 has a rearwardly facing convex bow shape, with the curved transition portion 217 also having a forwardly facing concave bowl shape, with the curvature of the transition portion making it relative rigid, or resistant to flexing or bending. The front end of the lower portion 226 has an upturned central lip 219 or post and a pair of laterally spaced lugs 221, which partially surround upwardly extending boss structures 998 on the connector 479, with the lip 219 and lugs 221 connected to and defining part of the rear link 25, with the seat platform, seat support, back frame and back support all having overlapping portions defining in part the rear link. The lip 219 is captured by a rear wall 331 of the boss structure 49. A relatively thin and flat section 231 of the lower portion extending in a longitudinal direction 2' defines a flex region 233 below the seat support and seating surface, and between the rear link 25 and the lumbar region 223 of the backrest and the flex region 225 defined thereby, which permits the transition portion 217 to pivot relative to the rear link 25 about the flex region 233. The thinner and flatter cross-section has a lower bending moment of inertia about a horizontal axis than the adjacent or remaining portions of the lower portion. In one embodiment, one or both of the flex regions 225 and 233 may be formed as a living hinge, or a thin flexible hinge made from the same material as the two more rigid pieces the living hinge connects, so as provide for relative rotation or pivoting between the more rigid pieces by bending of the living hinge.

Figure 25:
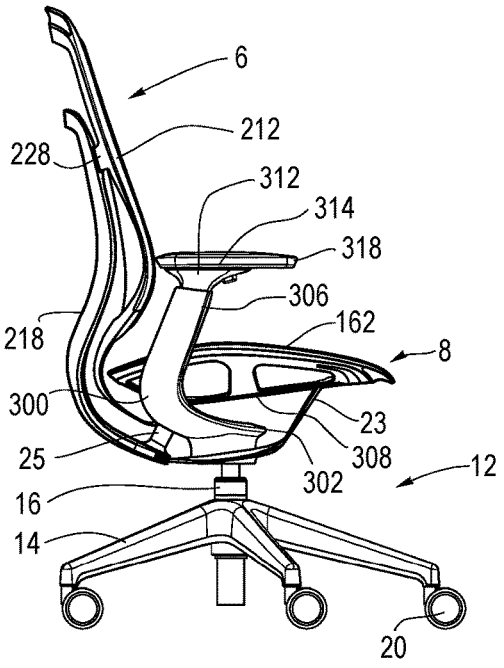
FIG. 25 is a right side view of the body support assembly shown in FIG. 22, with the left side view being a mirror image thereof with the exception of the actuator controls.
Figure 37:
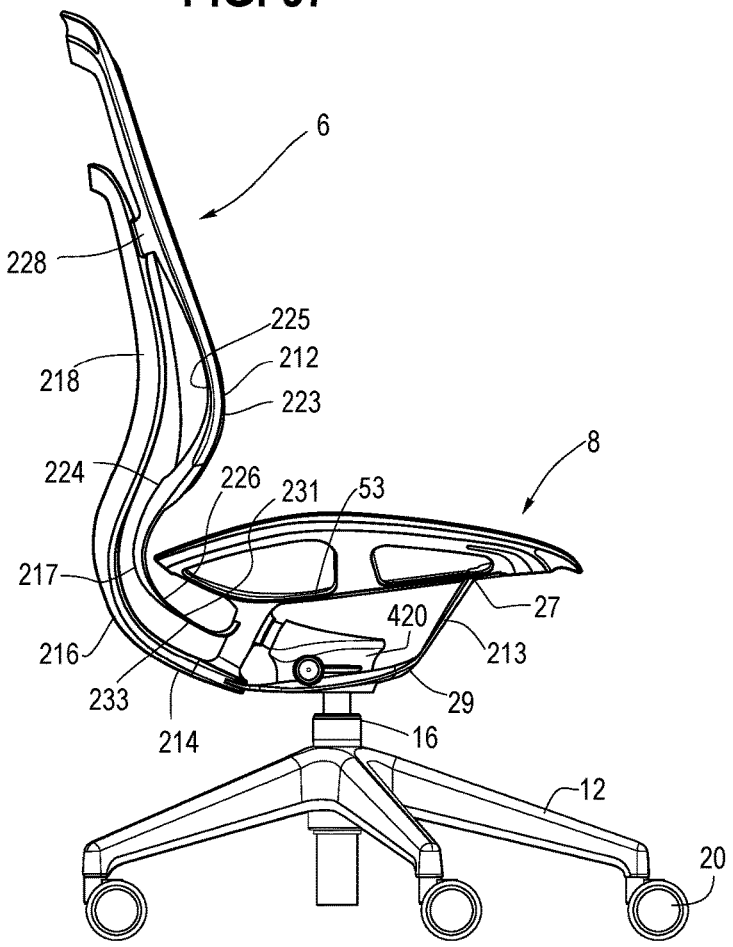
FIGS. 37 and 38 are right and left side views of a fourth embodiment of a body support assembly.
Figure 38:
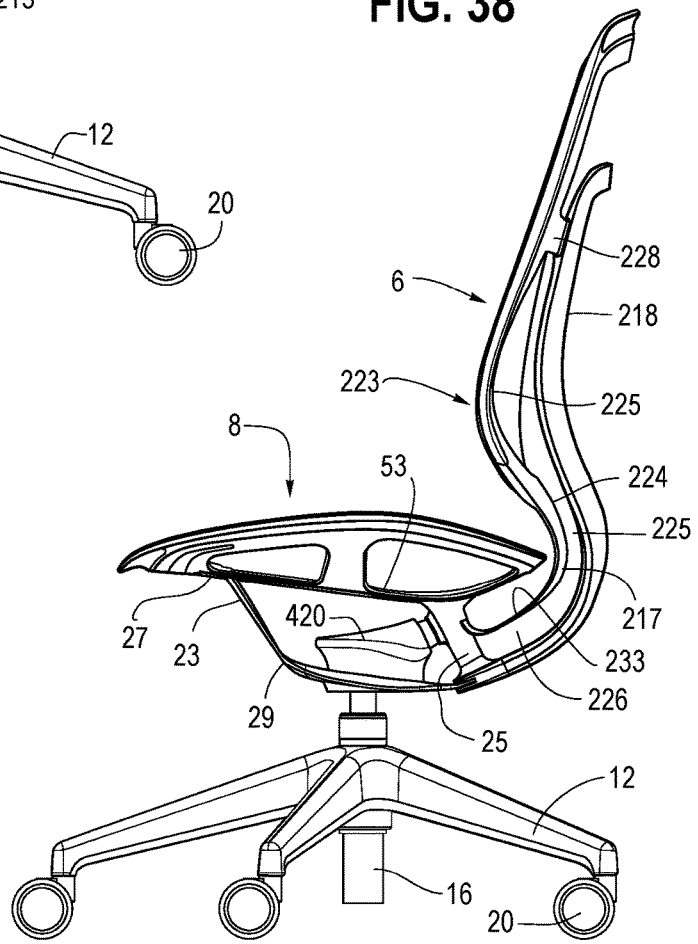
Figure 39:
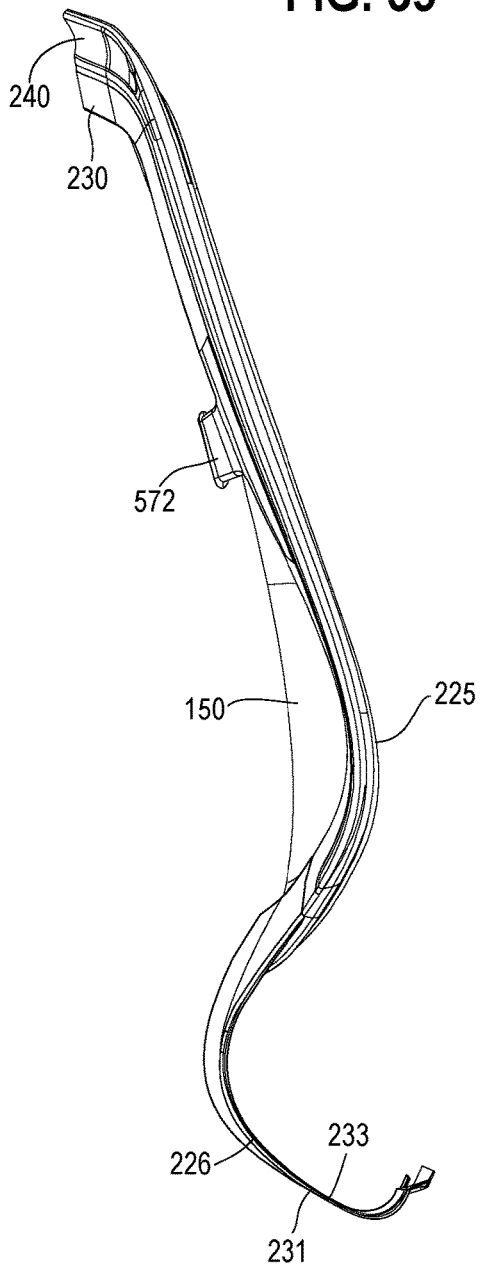
FIG. 39 is a right side view of a back support.
Figure 40:
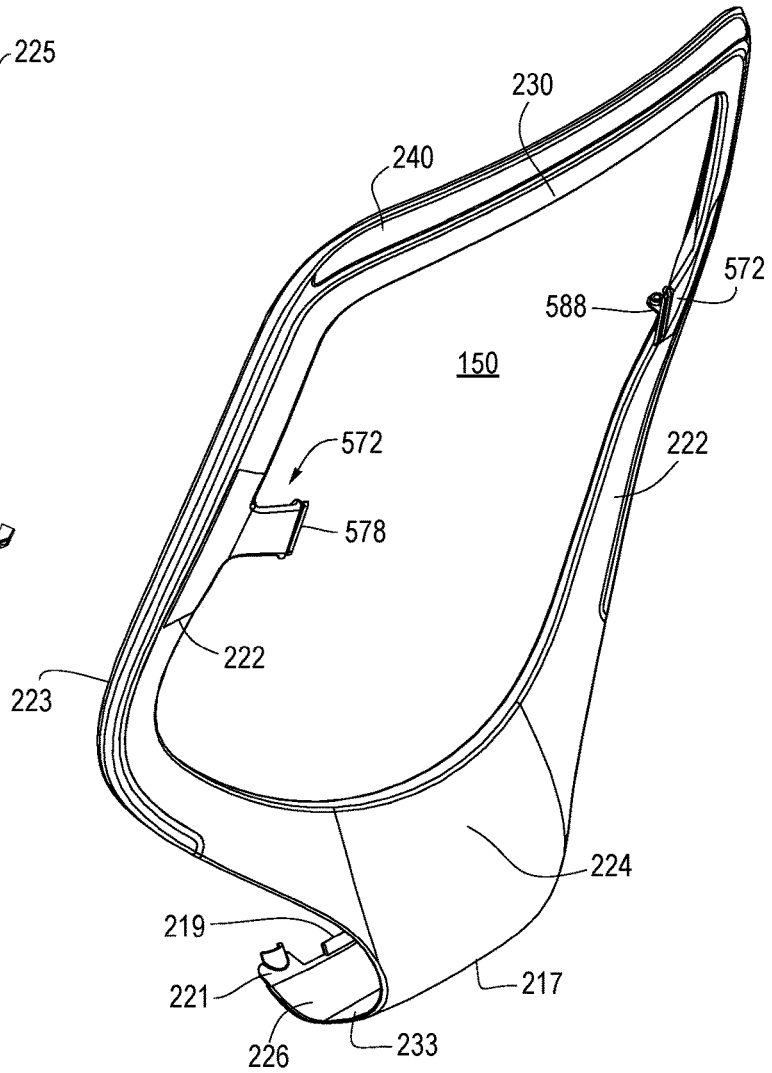
FIG. 40 is a perspective view of the back support shown in FIG. 39.
Figure 41:
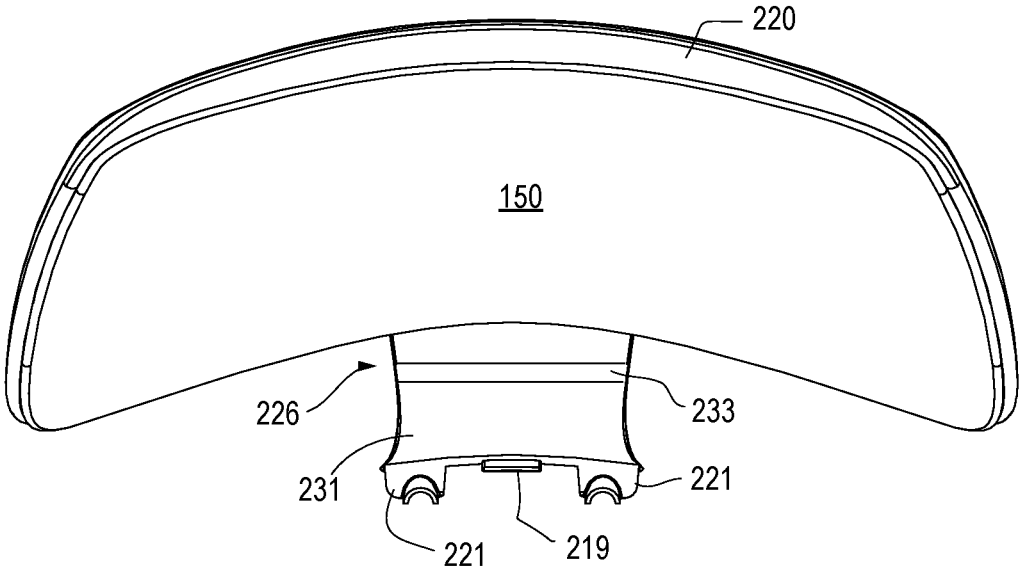
FIG. 41 is a top view of the back support shown in FIG. 39.

Flex regions 225 are defined in each of the uprights 222 adjacent the lumbar region above the seating surface, with the lumbar regions of the uprights having a forwardly facing convex curvature. The back support has an S-shaped profile when viewed from a right side thereof as shown in FIGS. 25, 37 and 39. The uprights 222 of the back support are coupled to the uprights 218 of the back frame with connectors 228. The uprights 222 are disposed laterally outwardly and forwardly of the uprights 218, with a lateral space defined therebetween. The back support 212 is pivotable with the back frame 210 and rear link about the flex region 31. In one embodiment, the uprights 218, 222 may be pivotally connected with a mechanical pivot joint, including for example the pivot structure disclosed in U.S. Pat. No. 9,826,839, the entire disclosure of which is hereby incorporated herein by reference.

In another embodiment, each of the pair of connectors 228 extends laterally between one of the back frame uprights 218 and one of the back support uprights 222. The connectors include a first connector tab 570 extending laterally from the back frame upright and a second connector tab 572 extending laterally from the back support upright, with the first and second connector tabs 570, 572 overlapping. The connector tab 572 is disposed rearwardly of covers the connector tab 570. The connector tab 572 is relatively rigid and not flexible such that the back support 212 is not moveable in a fore/aft direction relative to the back frame at the location of the connectors 228. The first connector tab 570 has a first insert portion 574 received in a channel 576, or socket, formed in the back support upright, while the second connector tab 572 has a second insert portion 578 received in a channel 580, or socket, formed in the back frame upright. The first and second connector tabs 570, 572 are coupled with a vertically extending pin 582 at a location between the first and second uprights, which location is proximate a neutral pivot axis extending in a lateral direction. The first connector tab 570 has a through opening, or horizontally elongated slot 584, at the mid-point, and a pair of lugs 586 extending forwardly from a front surface of the tab adjacent a top and bottom of the slot 584, with the lugs defining axially aligned through openings 590. The second connector tab 572 includes a forwardly facing lug 588 extending from a front surface, with the lug 588 inserted through the slot 584 and having a through opening aligned with the openings 590 of the lugs. The pin 582 is inserted upwardly through the openings of the lugs on the front side of the connector tabs so as to secure the tabs 572, 574 one to the other. The pin 582 may have a head and be threadably engaged with one or all of the lugs 588, 586, and preferably at least the uppermost lug 586. The suspension material 150 is disposed over and covers the front of the tabs, the pins and the lugs.

The insert portions 574, 578, which are non-cylindrical, are rotatable about a laterally extending axis 592 relative to the channels or sockets 576, 580 as the back support flexes about flex regions 225, 233 relative to the back frame 210 and rear link 25. The connector tabs each include a shoulder portion 594 that abuts a stop surface 596 of the opposing upright so as to locate the connector tabs and align the lugs.

Figure 50:
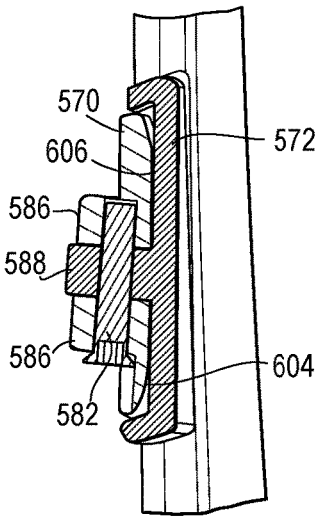
FIG. 50 is a partial, cross-sectional view of the connection between the back frame and back support taken along line 50-50 of FIG. 48.
Figure 51:
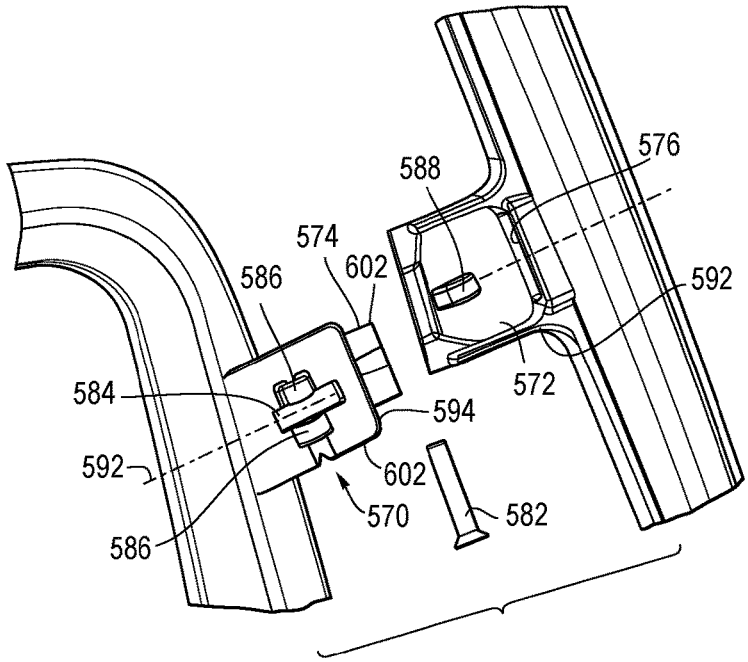
FIG. 51 is an exploded view of the connection between the back frame and back support.
Figure 52:
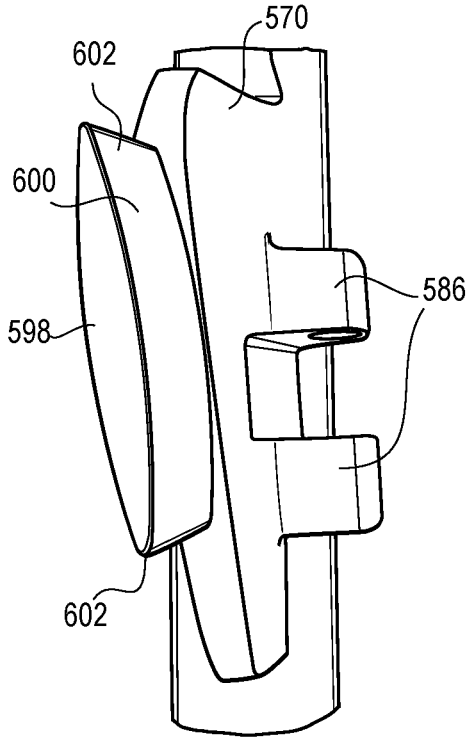
FIG. 52 is a partial, side view of the back frame connector.
Figure 53:
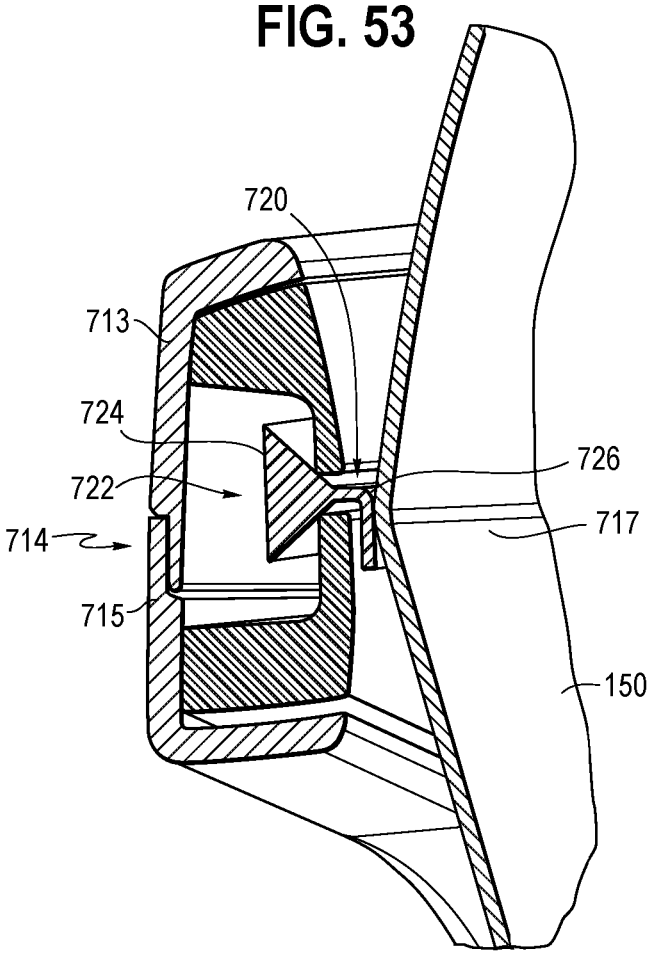
FIG. 53 is a cross-sectional view of a cross member and a stay coupled thereto with a textile material in an assembled configuration.
Figure 54:
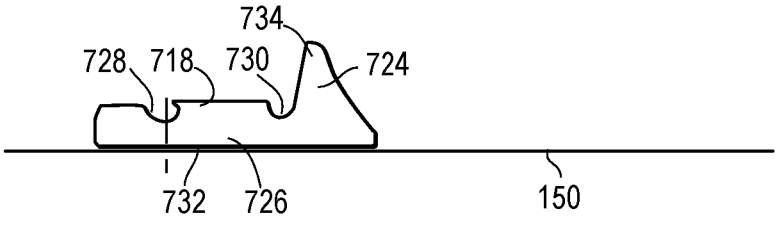
FIG. 54 is a cross-sectional view of a stay and textile material in a preassembly configuration.

Referring to FIGS. 52 and 74-76, the insert portion 574 of the first connector tab 570 has opposing front and rear convex curved engagement surfaces 598, 600 that interface with opposing stop surfaces 599, 601 of the channel or socket 576 having a substantially rectangular cross sections. As such, the upright 222 and channel 576 may rotate or pivot relative to the insert portion 574 about an axis 603 in first and second rotational directions until the engagement surfaces 598, 600 on opposite ends 602 of the insert portion engage opposite stop surfaces 599, 601 defined by the walls of the channel or socket at opposite ends thereof and thereby limit the pivoting motion in either rotational direction. As shown in FIG. 50, the rear surface of the connector tab 570 also has a rearwardly facing curved surface 604 that interfaces with a flat surface 606 of the overlapping connector tab 570, so as to not inhibit rotation of the upright 222, and connector tab 572, relative to the first connector tab 570, which is relative rigid and immobile.

Figure 74:
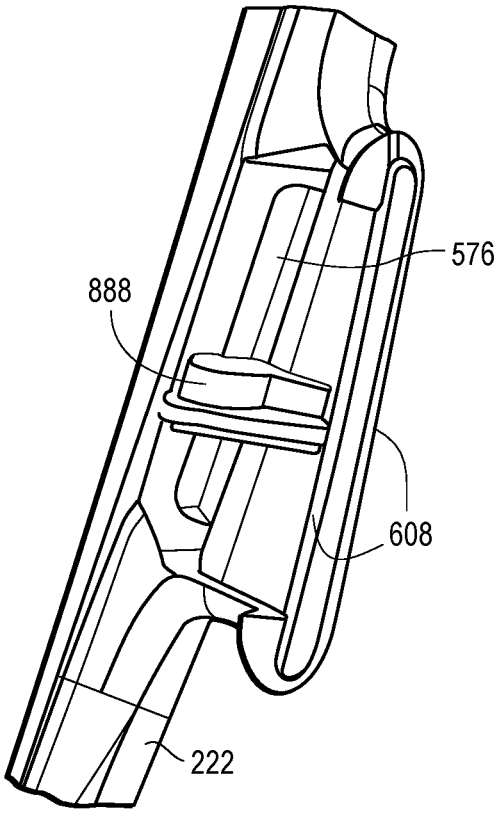
FIG. 74 is an end view of the back support connector tab.
Figure 75:
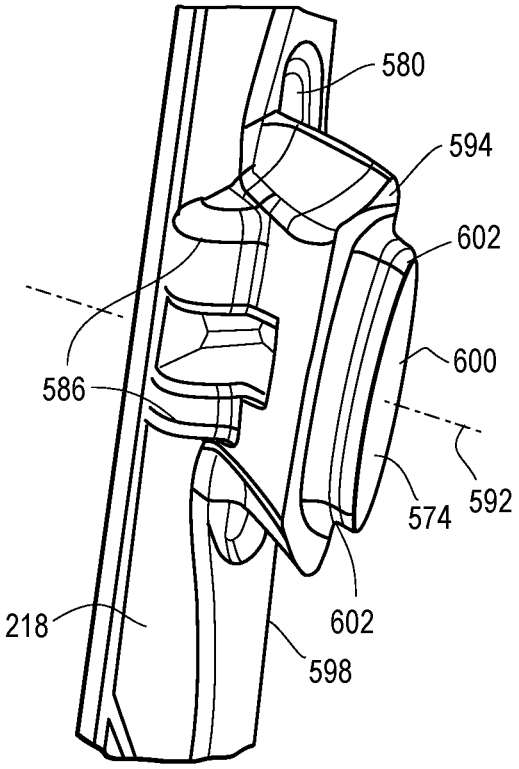
FIG. 75 is an end view of the back frame connector tab.
Figure 76:
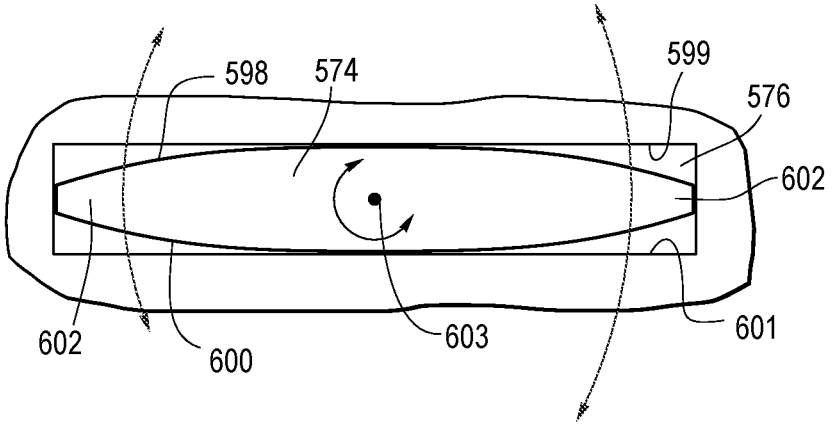
FIG. 76 is a schematic cross-sectional view showing the rotational limiter between the back frame and back support.

Referring to FIG. 74, the insert portion 578 of the second connector tab 572 also is configured with convex curved surfaces 608, which allows for pivoting of the connector tab 572 relative to the channel 580 and upright 218. In this way, the back support uprights 222 pivot or rotate relative to the back frame uprights 218 about axes 592 between various pivot positions, including at least first and second pivot positions, wherein the insert portion 574 engages first and second stop surfaces of the first channel 576, and the insert portion 578 engages first and second stop surfaces of the channel 580. For example and without limitation, the uprights 222 may be rotated 5 and 7 degrees relative to the uprights 218.

The spacing W2, for example about 330 mm in one embodiment, between the connectors 228 on the opposite sides of the back support provides relative stability to the upper portion of the back support 212, which resists rotation or torsional movement about a longitudinal axis 2 or fore-aft bending or flexing. In contrast, the centrally located rear link 25, and the overall width (W3) thereof, which is the only support for the bottom of the back support 212, allows for rotation or torsional movement of the bottom 224 of the back support relative to the top of the back support about a longitudinal axis 2', with the rotation or torsional movement of the top of the back support being restricted as previously explained. In one embodiment, the ratio of W2 to W3 is about 2:1 or greater.

The lower portions 214, 226, or support arms, of the back frame and back support are vertically spaced and define an open lateral pass through therebetween, notwithstanding that both support arms pivot about the same flex region 31 due to their common connection to the vertically extending and rigid rear link 25.

In addition, because the seat 8, including the seat support 308, and back support 212 are separate, and independently connected to the rear link 25 and therefore independently pivotable relative to the rear link 25, side-to-side rotation of the rear portion of the seat, and bottom of the back support, are not restricted by a connection to each other. In other words, the rear of the seat assembly 8 is not directly connected to the back support 212, but rather the seat assembly 8 and back support 212 are only interconnected through the centrally located rear link 25, such that the rear of the seat assembly 8 and the bottom of the back support 212 are independently rotatable about their respective longitudinal axes 2, 2'. Likewise, the back frame 210 is also supported at a lower portion 214 thereof by the centrally located rear link 25.

The back support 212 includes an upper member 230 extending between and connected to upper ends of the pair of second uprights 222, and the bottom portion 224 extends between and is connected to the lower ends of the pair of second uprights. The upper member 230, uprights 222 and the bottom portion 224 define a central opening 232. A suspension material 234 is stretched across the central opening 232 and is secured to the back support 212 in a similar fashion as the seat.

Specifically, the upper member 230, the bottom portion 224 and the pair of second uprights 222 define a support frame 236 having a peripheral edge 238 as shown in FIG. 7B. A flexible edge member 240 is secured to the peripheral edge of the upper member 230 and uprights 222, or along a face of the bottom portion 224. A carrier frame 242 is coupled to the support frame 236 and includes a peripheral groove 244 facing outwardly from a peripheral edge surface or face 246, oriented horizontally between the front and rear surfaces of the carrier frame, which is spaced apart from an inner surface or inwardly facing face 248 of the flexible edge member 240 and defines a space or gap G therebetween as disclosed above with respect to the seat assembly. The groove 244 opens outwardly from the carrier frame 242 along the peripheral edge 246 thereof. The suspension material 234 includes at least one stay 250, configured as a ring in one embodiment, secured along a peripheral edge portion 252 of the suspension member, wherein the at least one stay is disposed in the groove 244. The stay 250 may be held by friction alone, without any auxiliary support material such as adhesive. In one embodiment, the stay directly 250 engages one surface, e.g., a front surface, of the groove 244, while the fabric engages the rear surface. In this way, as with the seat, the stay engages the surface of the groove 244 closest to the surface of the carrier frame covered by the fabric. In one embodiment, the stay 250 is formed as a continuous ring having a fixed length, with the stay 250 being relatively inelastic and resistant to elongation along a length thereof, but which may be flexible and bendable.

Figure 88:
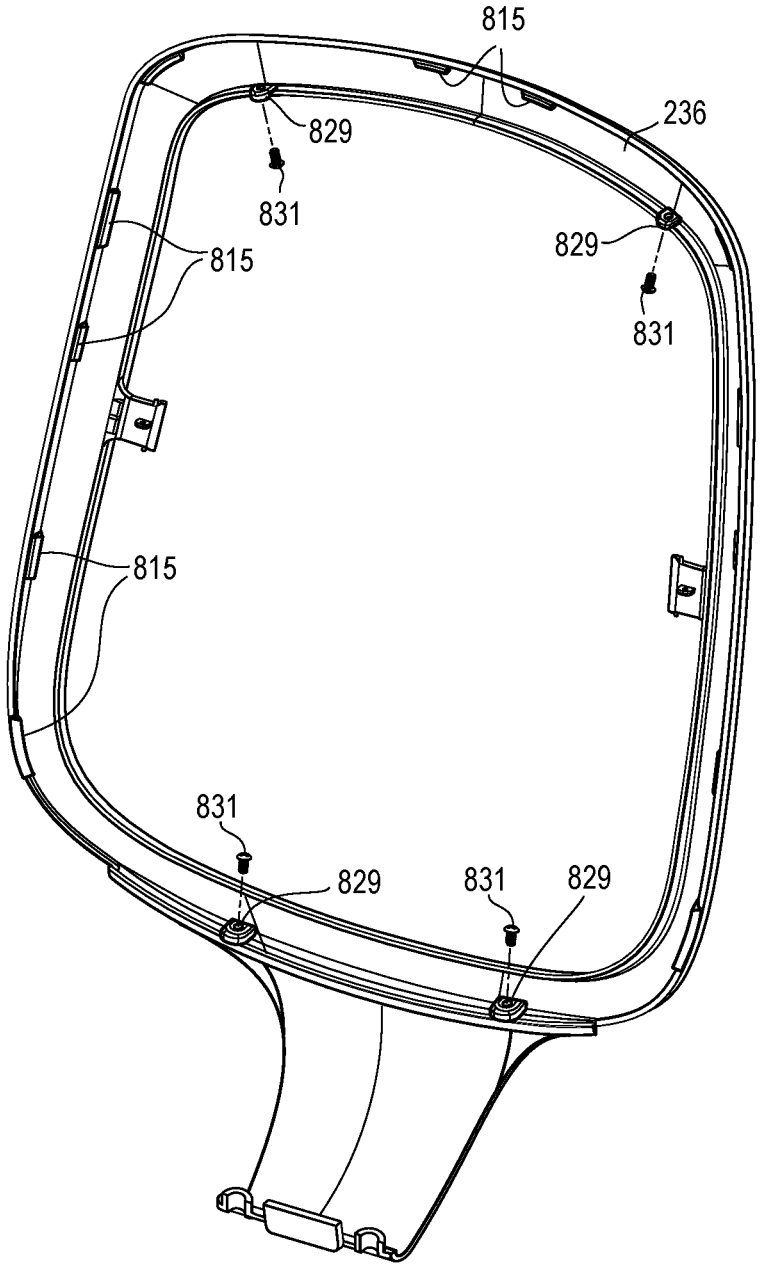
FIG. 88 is a front perspective view of a support frame.
Figure 89:
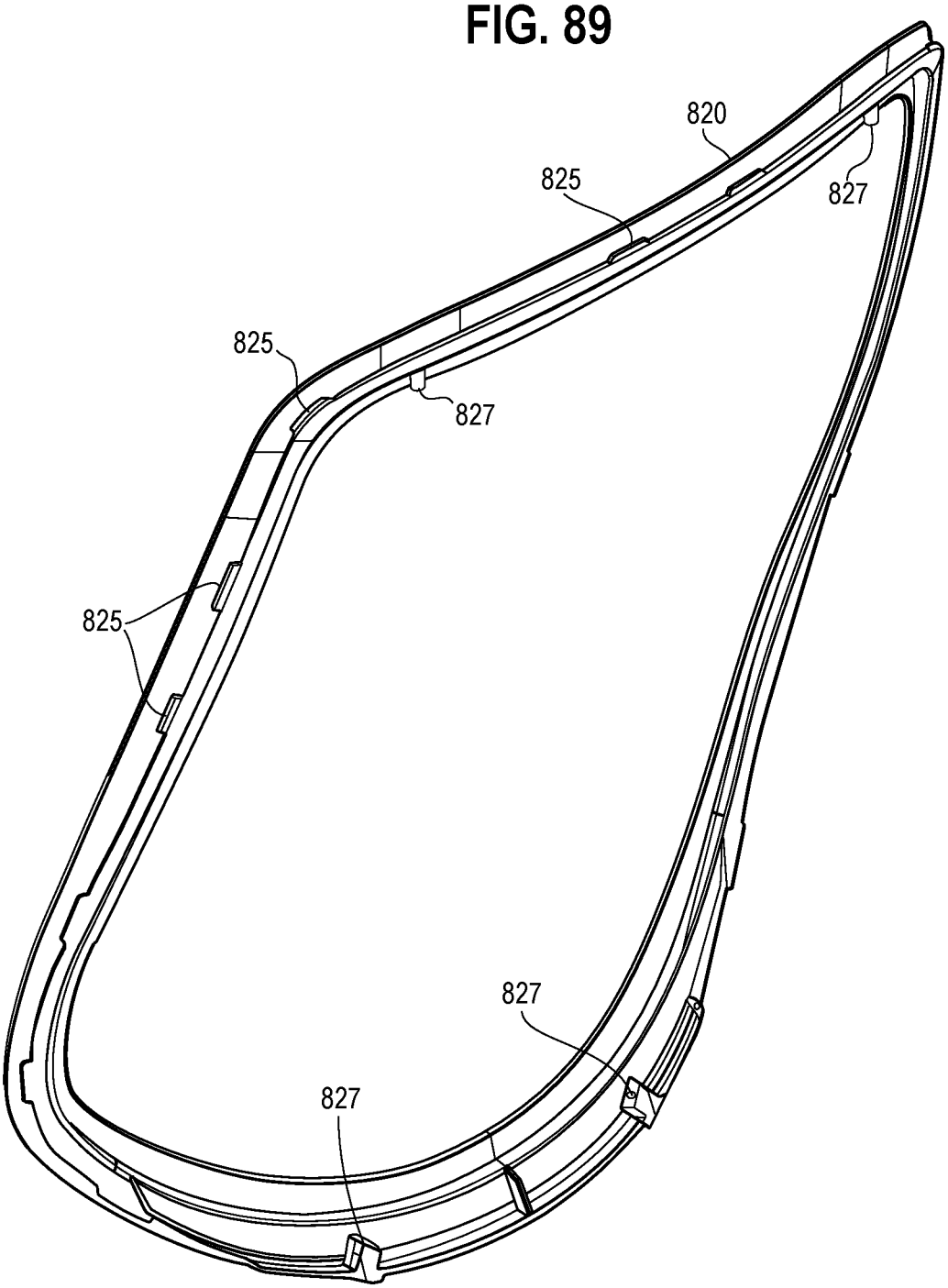
FIG. 89 is a rear perspective view of a carrier frame.
Figure 90:
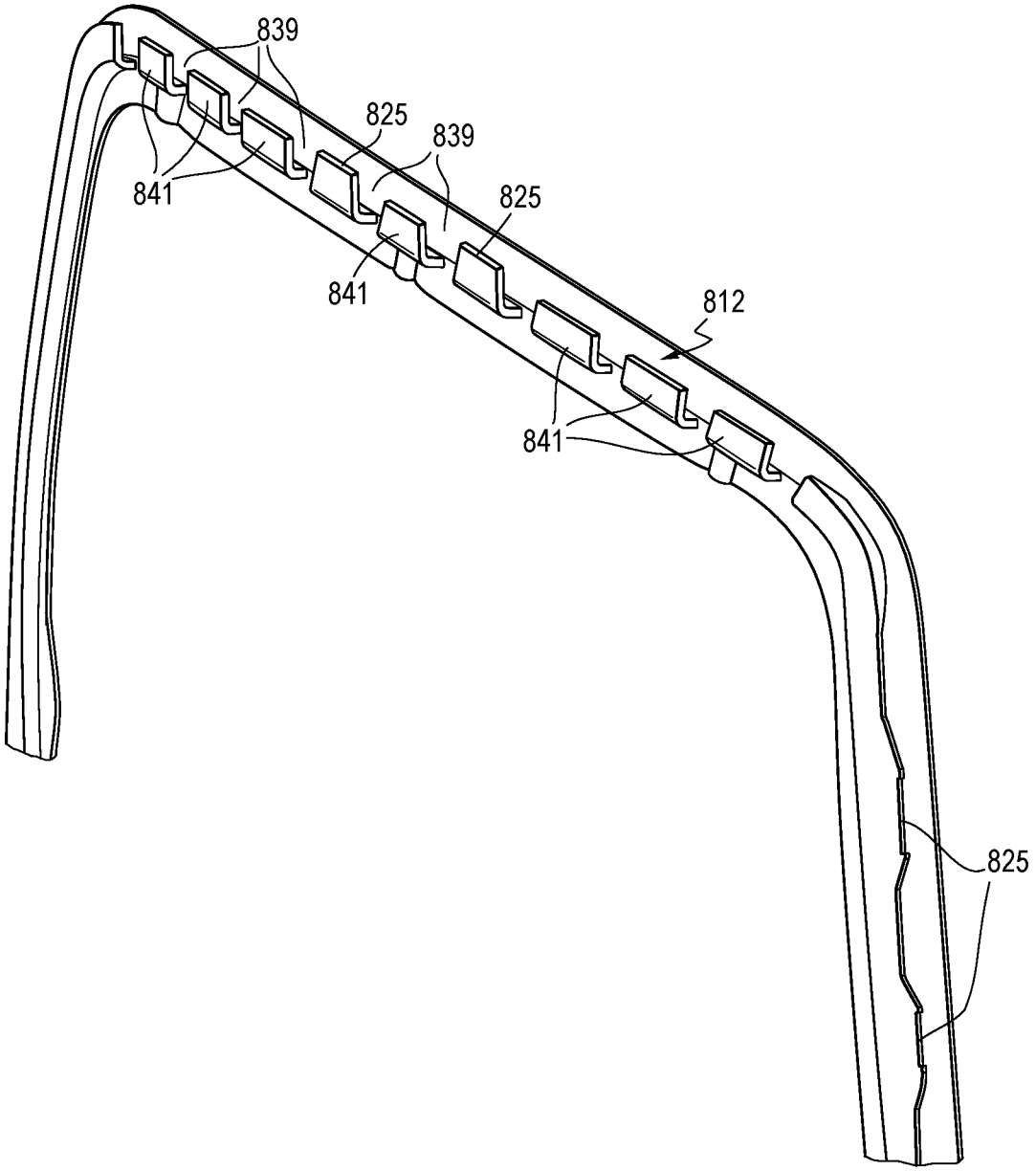
FIG. 90 is a partial, front perspective view of an alternative embodiment of a carrier frame.
Figure 91A:
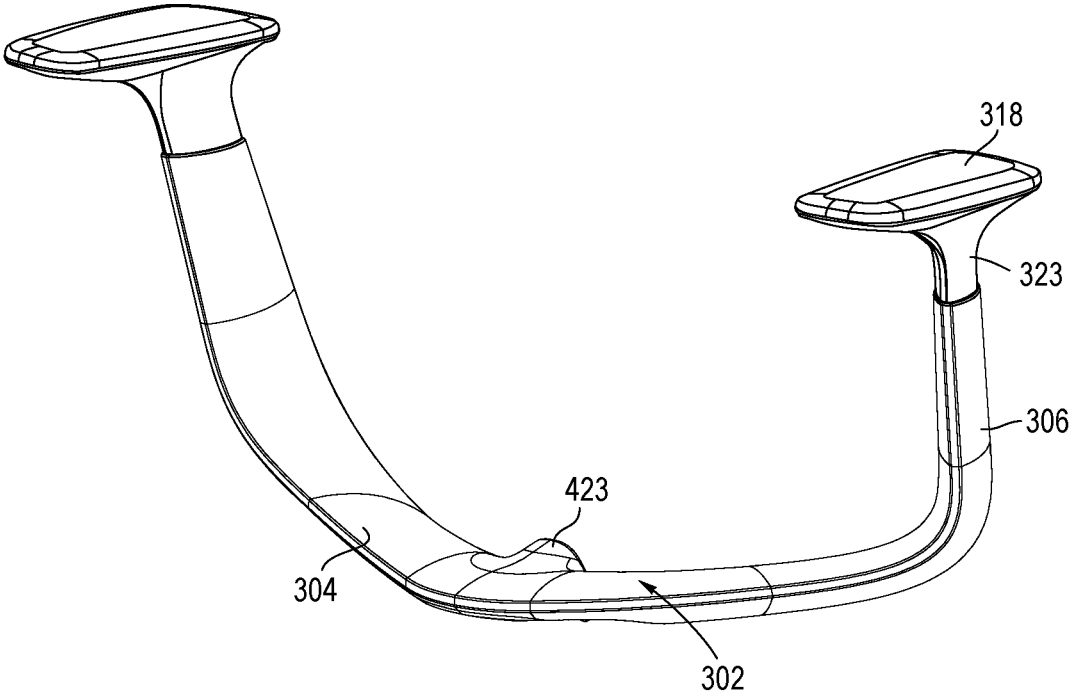
FIGS. 91A and B are perspective views of alternative embodiments of armrest assemblies.
Figure 91B:
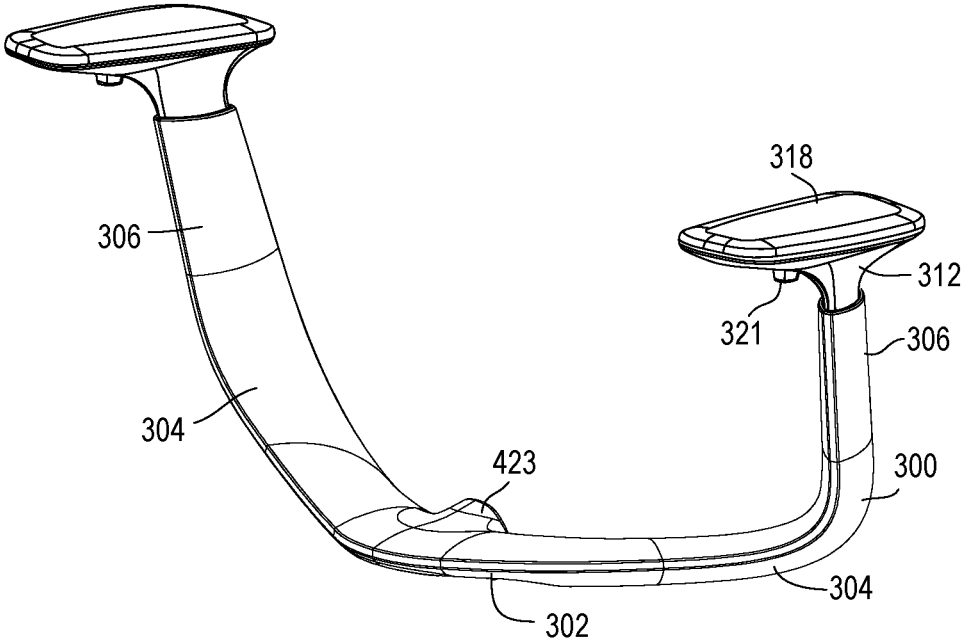

In another embodiment, and referring to FIGS. 46, 47, 88 and 89, the support frame 236 includes a rear wall 800 defining a body facing surface 802, an outer peripheral edge wall 804 having an outer surface 806 and an inner peripheral edge 808 wall, with the walls 804, 808 defining a forwardly facing channel 810. A lip 812, or catch, extends laterally inwardly from the outer peripheral edge wall and defines a channel 816 with the rear wall 800, with a rear surface of the lip defining an engagement surface 814. As shown in FIG. 88, the lip 812 may be defined by or include a plurality of tabs 815 spaced apart around the periphery of the support frame 236. In one embodiment shown in FIGS. 90 and 91, the portion of the lip 812 running along the top of the frame has a plurality of spaced apart notches 839 or slots, which make the top portion of the carrier frame more flexible such that the carrier frame may be more easily installed (e.g., bowed) within the support frame. At the same time, the lip 812 (or plurality of tabs 841 defined by the slots) remains sufficiently rigid to engage the stay attached to the periphery of the fabric suspension material that is wrapped around the carrier frame, with the stay secured in the groove 816. A carrier frame 820 has a body with a rear flange 822 defining a rear surface overlying and engaging the rear wall and an insert portion 824, defined by a plurality of tabs 825 spaced apart around the periphery of the carrier frame 820 in one embodiment.

The insert portion 824 is received in the channel 816 and engages the engagement surface 814. The carrier frame 820 further includes upper and lower pairs of lugs 827 that are aligned with lug 829 on the support frame 236, with fasteners 831 securing the lugs 827, 829 to further connect the support frame 236 and carrier frame 820. The carrier frame 820 includes a second flange 826 that forms an outwardly facing groove 830 with the flange 822 and defines an outer peripheral edge wall 827. The flange 826 extends across the channel 810 with an edge 832 positioned adjacent the inner peripheral edge wall 808 and closing the channel. Tension applied by the textile material, configured as a suspension material 150 in one embodiment, thereafter applies a moment to the carrier frame 820 causing it to bear up against the bottom surface of the support frame and the engagement surface. A flexible edge member 240 is coupled to the outer surface of the peripheral edge wall 804 of the support frame, with a lip portion overlying a top surface of the support frame. The flexible edge member 240 has an inner surface spaced apart from and facing inwardly toward the peripheral edge wall of the carrier frame, with the inner surface and the peripheral edge wall 827 of the carrier frame defining a gap therebetween. A portion of the textile material is disposed in the gap, with the textile material covering the peripheral edge wall 827 and body facing surface of the carrier frame. The peripheral edge of the textile material is secured to a stay 156, with the edge portion of the textile material and the stay disposed in the groove 830. The carrier frame 242 may be secured to the support frame with the overlapping tabs 815, 825 and fasteners 831, including mechanical fasteners and/or adhesive.

Referring to FIGS. 29-36, 54A and B, and 55, another embodiment of a backrest assembly 700 includes a back support 702 having first and second laterally spaced uprights 704 each having upper and lower portions 706, 708 defining separate first and second forwardly facing convex curvatures/curved surfaces 710, 712, and a cross member 714 extending between and coupled to the uprights at the junction between the upper and lower portions 706, 708. The upper and lower portions may each include a cross member portion 713, 715, which with the upper and lower portions being joined, and having overlapping flanges, to define the overall cross member 714. The upper and lower portions define a forwardly facing concave curved surface 711 at the junction thereof. A suspension material 150, preferably configured as a single piece of material or blank, is connected to the first and second uprights 704 and spans across the central opening therebetween, the suspension material having a front surface and a rear surface. At least opposite side portions 716 of the suspension material bear against and follow the contour of the upper and lower portions 706, 708, including having first and second forwardly facing convex curvatures overlying and mating with the front surface of the uprights, and concave curvature overlying the junction. A laterally extending stay 718 is coupled to the suspension material and extends between the rear surface of the suspension material and the cross member 714 so as to pull the suspension material 150 rearwardly toward the cross member 718 and thereby define a seam 717 and provide forwardly facing convex and concave curvatures along a central portion of the suspension material laterally spaced, and at an intermediate location, relative to the uprights. The periphery of the suspension material is connected to the back support with a stay as disclosed herein elsewhere, for example in FIGS. 46 and 47. The lower portion 708 of the uprights 704 are connected to the back frame uprights 218 with connectors 228 as disclosed herein elsewhere.

The cross member 718 has a forwardly facing and laterally extending slot 720 and a laterally extending cavity 722 disposed rearwardly of the slot. The stay 718 has a head portion 724 disposed in the cavity and a neck portion 726 extending through the slot. The stay is sewn to the suspension material. The stay comprises a first thinned region 728 formed along a length thereof, wherein the stay is sewn to the suspension material along the thinned region. The stay is resiliently bendable. In a pre-installation configuration, the stay has a flat surface 732 that lies flat against the suspension material, such that the suspension material and stay may be easily translated and processed under a sewing machine. The neck portion is connected to the head portion adjacent a second thinned region 730, which defines a flex region. The head portion includes a catch member 734, which extends upwardly from the flat surface. After the stay is secured to the fabric, the stay may then be bent with the head portion 724 rotatable relative to the neck portion from an insert position, wherein the head is insertable through the slot 720, to a retention position, wherein the head portion, and catch member 734 in particular, is retained in the cavity and the catch portion engages one or more edges of the channel 720.

Figure 57:
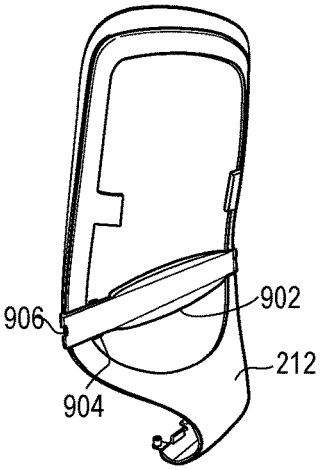
FIG. 57 is a rear perspective view of a back support with a lumbar connected thereto.
Figure 58:
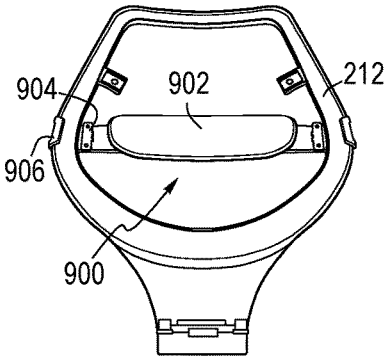
FIG. 58 is a front view of the back support and lumbar shown in FIG. 57.
Figure 59:
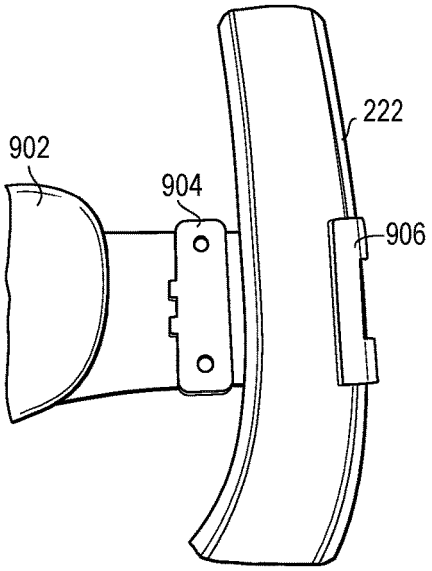
FIG. 59 is a partial, enlarged front view of the back support and lumbar connection.

Referring to FIGS. 57-59, a lumbar support 900 includes a central pad 902, one or more elastic straps secured to the pad and extending laterally outwardly therefrom, and a hook 906 secured to the end of each strap. The hooks 906 are wrapped around the outer edge of the back support and slide there along to various vertical positions as desired by the user. A pair of inner pads 904 are disposed and slide along an inner surface of the support, and help maintain engagement of the hooks on the support. Due to the resilient/elastic nature of the straps, the hooks may move inboard/outboard relative to the pad to accommodate different dimensions between the uprights 222. In addition, the elastic straps allow for the hooks to rotate, for example as they slide along curved portions of the uprights and/or lower portion of the back support.

Figure 99A:
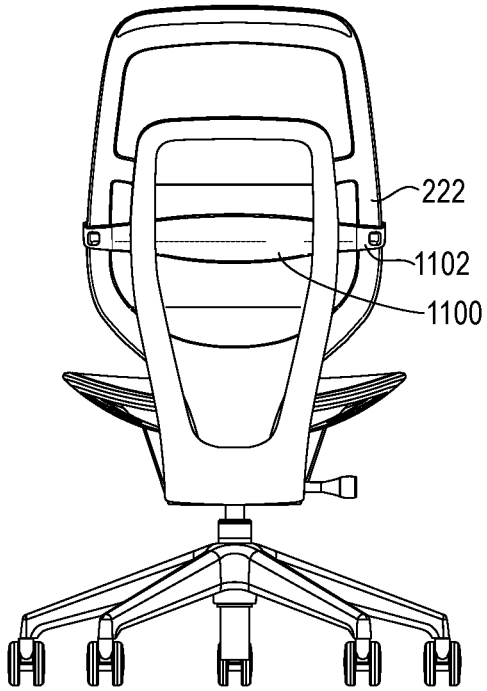
FIGS. 99A and B are rear views of a chair with a lumbar support applied thereto in an upper and lower position respectively.
Figure 99B:
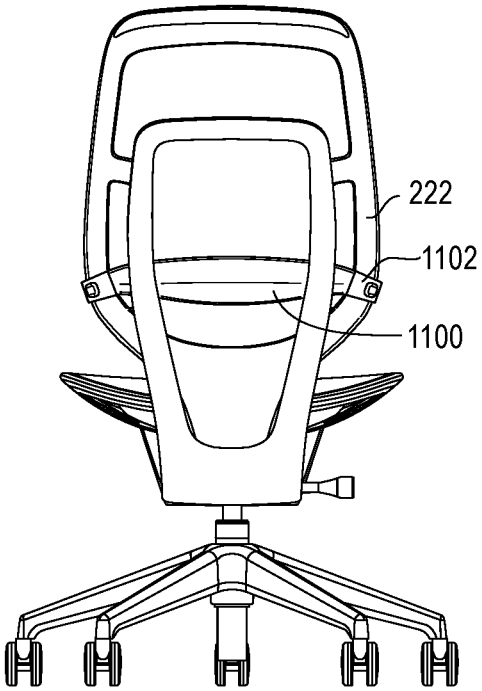

In an alternative embodiment, shown in FIGS. 96-99B, a lumbar support 1100 is connected to the pair of uprights 222 defining a part of the frame across the opening. The lumbar support extends between the uprights and has a pair of hooks 1102 connected to opposite ends of the lumbar. Due to the elastic connection between the lumbar and the hooks, the hooks may pivot or rotate relative to the lumbar, allowing the hooks to follow the curved contour of the frame uprights 222 while the lumbar remains taught across the opening, as shown for example in FIGS. 99A and B, with the lumbar support 1100 in high and lower positons respectively. The lumbar support has a central pad 1104 with a pair of grooves 1106 extending along the upper and lower edges thereof. A looped band 1108 includes upper and lower cords 1110, 1112 positioned in the grooves, with looped end portions 1114 extending from and joining the upper and lower cords. The looped end portions are disposed in a U-shaped groove 1116 formed on an inboard end, or hub 1118, of an adapter 1120. The hub has a pair of spaced apart lips 1122 that define in part the groove and retain the end portions 1114 in the groove. The end portions 1114 are tucked or press-fit into the groove, with the lips 1122 holding the end portions. The adapter includes an insert portion 1124, or flange, with a flexible tab 1126, or detent, extending transversely from the flange. The insert portion 1124 extends laterally from the hub and is inserted into a passage 1128 in the end of the hook. The adapter includes a shoulder 1130 defined at a junction of the hub and insert portion that engages an inboard, abutment surface 1132 of the hook defined by an inboard wall or flange. An outboard surface 1134 of the wall has a pair of angled surfaces defining an apex, or pad, which engage an inboard surface of the frame uprights 222, but allows sliding relative thereto while helping maintain engagement with the uprights. The tab 1126 snaps into engagement with an opening 1136 formed in the hook that communicates with the passage. In this way, the central pad 1104 is coupled to the pair of hooks 1102. The looped band, including the upper and lower cords, allows the hook 1102 to rotate slightly relative to the pad 1104, for example when the lumbar is moved along a lower portion of a backrest frame uprights, which are tapered inwardly toward a centerline as shown in FIG. 99B. The looped band 1108 is flexible, with the cords 1110, 1112 being slightly pretensioned when the hooks are engaged with the outer edge of backrest frame. Due to the pretension, the lumbar support 1100 remains engaged with the frame even as the width dimension thereof is diminished as the lumbar support moves toward the bottom of the backrest.

Figure 96:
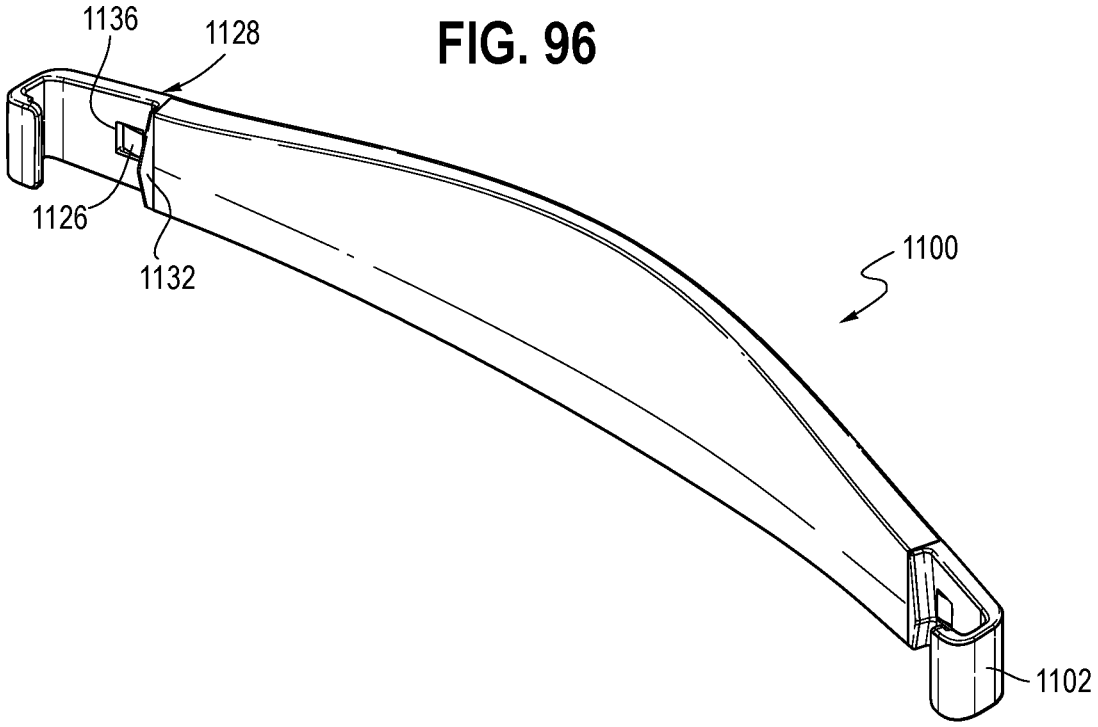
FIG. 96 is a front perspective view of a lumbar support.
Figure 97:
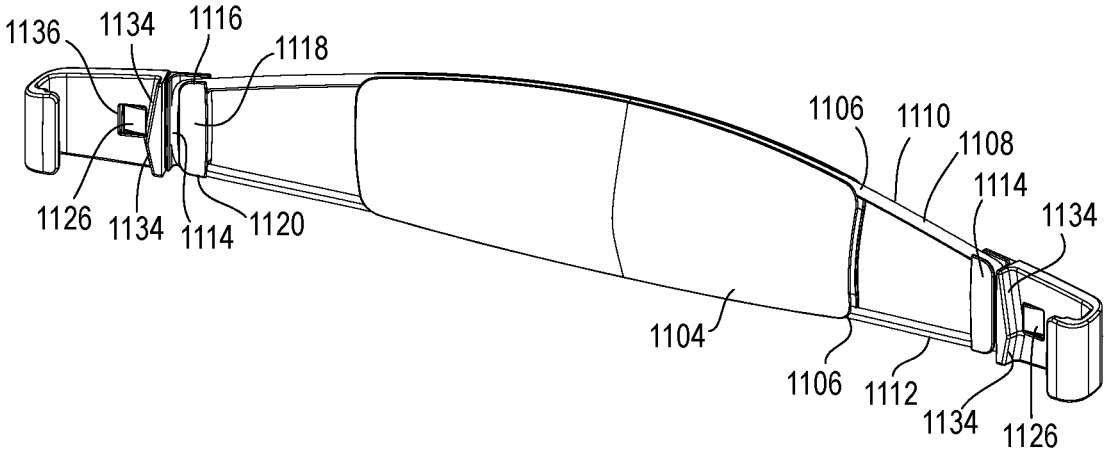
FIG. 97 is a front perspective view of the lumbar support shown in FIG. 97 with the sleeve removed.
Figure 98:
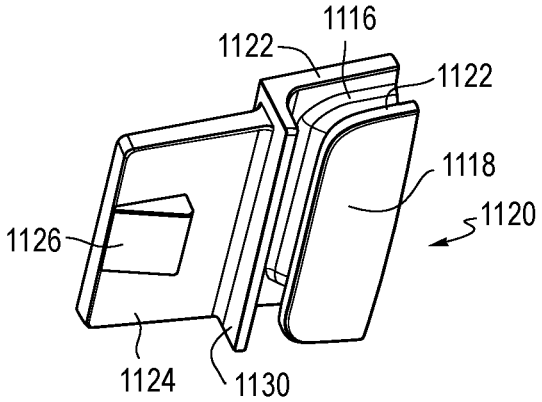
FIG. 98 is a perspective view of a lumbar support adapter.

Referring to FIG. 96, the central pad 1104 (e.g., printed or foam pad) may be fitted within an elastic sleeve. Ends of the sleeve may be coupled to the adapters, for example the faces thereof, and abuts the end surface of the hook, with the hook and sleeve being flush at the junction thereof. The sock is made of an elastic material, such as knit material. In this way, the sock provides both a pleasing aesthetic appearance while also providing function, namely allowing the lumbar to be tensioned, and lengthened or shortened, between the frame members. The elasticity of the sock maintains tension in the sock even as the hooks get closer together near the curved bottom of the frame. The front of the pad, or the sleeve covering the pad, engages the rear surface of the suspension material and provides lumbar support to the user.

Figure 100:
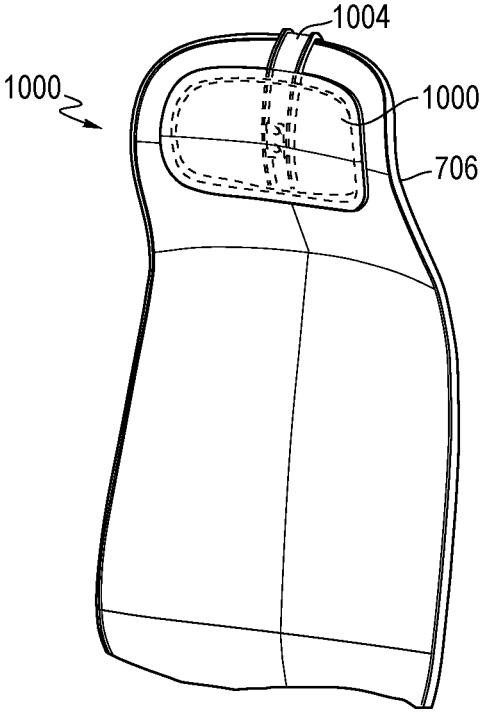
FIG. 100 is a partial, perspective view of a backrest with a headrest applied thereto.
Figure 101:
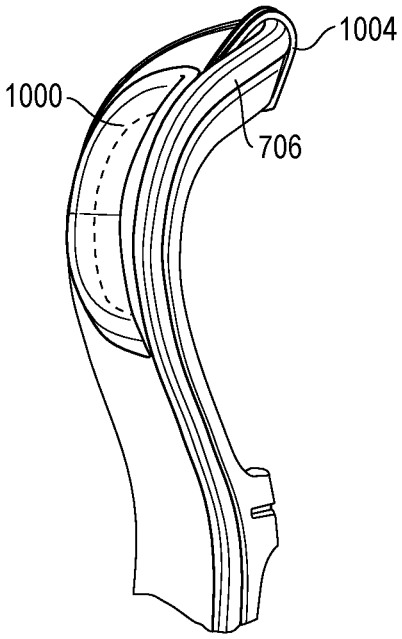
FIG. 101 is a partial side view of the backrest shown in FIG. 100.
Figure 102:
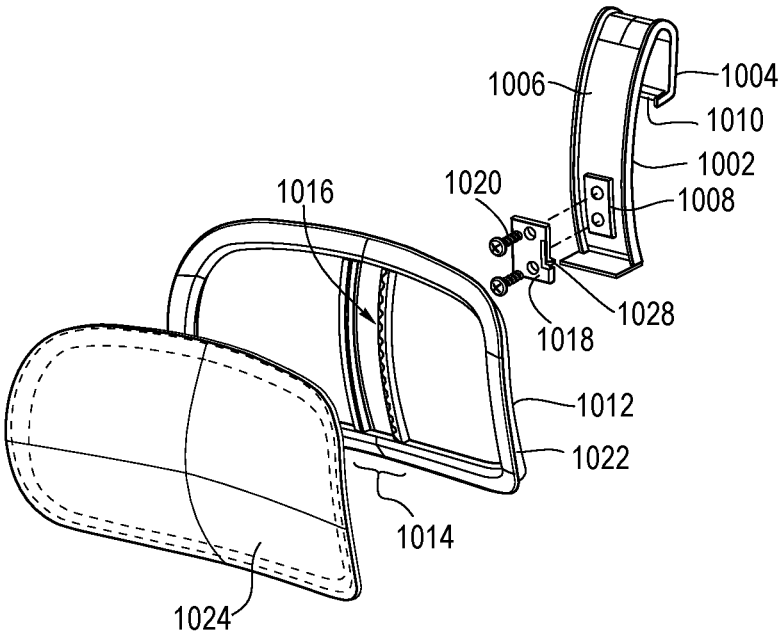
FIG. 102 is an exploded view of the headrest assembly shown in FIGS. 100 and 101.

Referring to FIGS. 100-102, the backrest may be configured with an adjustable headrest 1000. The headrest includes an (inverted) J-shaped strap 1002, which forms a hook 1004 that fits over the top of upper portion 706, for example a cross member thereof, or over the upper member 230, with a friction/snap fit. The hook may have a forwardly extending lip 1010 that fits under and engages a bottom side of the cross member. The strap has a downwardly extending leg 1006 lying along a front surface of the backrest. The leg includes a mounting portion 1008, shown as a platform having a pair of fastener openings.

The headrest includes an insert frame 1012 having a central track 1014, with one side of the track having a plurality of indents 1016. A ratchet block 1018 is inserted in the track. The ratchet block is fixedly coupled to the leg mounting portion 1008, or platform, with a pair of fasteners 1020, with the frame 1012 trapped therebetween. The block 1018 includes a flexible pawl 1028 extending laterally from the block. A cushion 1024, which may be a suspension material or a foam member covered with fabric, is connected to the frame, for example by engaging a peripheral groove 1022 extending around the periphery of the frame. The headrest 1000 is vertically moveable relative to the fixed ratchet block 1018, which moves within the track 1014. The flexible ratchet pawl or arm flexes laterally, with an end portion engaging at least one of the indents 1016 to index the headrest on the leg 1006. The headrest 1000 may be gripped and moved vertically to position the headrest at a desired location along the length of the strap, with pawl 1028 flexing in and out of engagement with the indents 1016. As shown in FIG. 101, the headrest 1000 has a low profile, and may lie almost entirely within the concave recess defined between the upright portions of the upper portion 706.

Operation:

In operation, and referring to FIGS. 18, 19, 21 and 55, a user 101 may sit in the body support structure 10. Depending on the weight of the user, and the amount of deflection of the suspension material 150, and the deflection of the side portions of the support/carrier frames coupled to the suspension material, the suspension material may engage the upper surface 202 of the auxiliary support member 200, or cushion 203, which thereafter assists in absorbing the load of the user. In essence, the side portions are inwardly deflectable a first amount from a first unloaded configuration to a first loaded configuration in response to a load applied to the elastic material, and define in essence a first spring to absorb the load of the user. The elastic textile material, or suspension material 150, coupled to the side portions 114 across the opening is downwardly deflectable a second amount from a second unloaded configuration to a second loaded configuration in response to the load applied thereto, and defines a second spring to absorb the load of the user. Stated another way, the deflection of the frame, or side portions, and the deflection of the suspension material act in combination to provide a first amount of support to the user. The cushion disposed beneath the textile material engages and provides auxiliary support to the elastic material when the first and second amounts of deflection, or first amount of support, result in the elastic material contacting the cushion, which defines a third spring to absorb the load of the user. The upper surface of the cushion 203 is spaced apart from the textile material when the side portions 114 are in the first unloaded configuration and the elastic suspension material 150 is in the second unloaded configuration. In this way, the flexible support/carrier frame, elastic suspension material and cushion provide first, second and third amounts of resilient support to a user engaging and supported by the textile material, with the suspension material and flexible frame working in combination. It should be understood that the elastic suspension material 150 is downwardly deflectable a first amount in response to the deflection of the at least one side portion 114, or both side portions depending on where the load is applied.

The resilience and deflection of the side portions 114 is primarily a function of the deflection of the at least one connector 80, 108 extending between the central portion 102 and support platform 30 and the side portions 114. The connectors 80, 108 extend upwardly and outwardly from the central portion, and curved with an upwardly facing concave surface such that is rigid and resists outward/downward deflection/deformation. As noted above, the connectors 80, 108 includes a pair of opposite side connectors that are inwardly deflectable from the first unloaded configuration to the first loaded configuration in response to the load applied to the elastic material.

The user 101 may recline, with the tilt control assembly 18 providing for the seat and/or backrest assemblies 8, 6 to move rearwardly, whether by pivoting, rotation, translation or a combination thereof, for example by way of a four-bar mechanism including links 8, 23, 25 and 33.

Referring to FIGS. 18, 19 and 21, as the seat assembly 8 tilts or reclines rearwardly, the support platform 30 and the carrier frame 100 flex or bend about the flex regions 53, 153, such that the rear portion 121 of the seat assembly, and rear portion of the support platform, rotates or deflects downwardly relative to the front portion 123 of the seat assembly, and front portion of the support platform, about the flex region. At the same time, and due to the geometry of the seat assembly, including the configuration of the outer ring 104, the geometry of the connectors 108, the concavity of the carrier frame 100, and the configuration of the openings 109, 119, the intermediate connectors 108 flex or bend upwardly about flex regions 155, such that the side member 114 of the outer ring 104 move upwardly relative to the support platform and inwardly toward each other to a new configuration or shape of the side member 114', with the textile material 150 assuming a more concavely configured textile material 150' that slightly hammocks and hugs the user. As the connectors 108 and outer ring 104 deflect, the overall length of the outer ring 104 is maintained, and is not increased. It should be understood that referring to the side members 114 moving upwardly is relative to the support platform 30, which in part may be moving downwardly, such that the overall or absolute movement of the side members relative to ground is negligible. The support ring 48 is sufficiently flexible and compliant that the support ring 48 does not interfere with the flexing of the carrier frame 100, but rather provides a decorative and tactile skin covering a bottom surface of the carrier frame. If needed, the support ring 48 may also be provided with flex regions to allow such flexing. Due to the geometry of the seat assembly, including the configuration of the outer ring 104, the geometry (e.g., upwardly concavity) of the curved connectors 108, the concavity of the carrier frame 100, and the configuration of the openings 109, 119, the side members 114 and connectors 108 are relatively rigid, and resist/avoid a downward deformation, in response to downward load applied along the sides of the seat at the perimeter of the chair.

As the user reclines, the back frame 218 tilts rearwardly with the rear link 25, with the back support 212 also tilting with the rear link 25. At the same time, and in response to a load applied to the backrest by the user, the back support 212, and the lower portion 226 and uprights 222 in particular, will flex about the flex regions 225, 231 respectively, while pivoting relative to the back frame 218 by way of the connectors 228. In particular, the flex region 225 of each upright 222 adjacent the lumber region will bend or flex to provide more support at the lumbar, while the lower flex region 231 accommodates and permits the flexing of the lumbar region. At the same time, the connectors 228 above the flex region 225 permit rotation of the back support 212, and the uprights 222 in particular, relative to the back frame 210 and uprights 218 to accommodate the flexing of the lumbar region.

Due to the orientation of the front and rear links, and relative positioning of the flex regions 27, 53, which are disposed upwardly and forwardly of the flex regions 29, 31 respectively, the four-bar linkage provides a weight activated system, meaning the weight of the user is taken into account when reclining since the increase in potential energy is offset by the kinetic energy required to recline. In this way, the four-bar mechanism will provide more resistance to a heavier user and automatically counterbalance the user. As noted previously, the amount of recline may be limited by the recline limiter, while energy may supplied to boost the resistance to recline and return the body support assembly to the upright, nominal position.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A body support assembly comprising:

a base member;

a lower support structure comprising:

a longitudinally extending portion coupled to the base member at a first location;

a front link extending upwardly from the longitudinally extending portion forwardly of the first location; and a rear link extending upwardly from the longitudinally extending portion rearwardly of the first location;

a back frame comprising a first lower portion extending rearwardly from the rear link and an upright portion extending upwardly from the lower portion;

a seat support member coupled to the front link and to the rear link, wherein the seat support member supports a seating surface; and a back support pivotally connected to the upright portion at a second location above the seating surface, wherein the back support comprises a second lower portion separate from the first lower portion and connected to the rear link below the seat support member.

2. The body support assembly of claim 1 wherein the front link comprises a pair of laterally spaced front links.

3. The body support assembly of claim 1 wherein the upright portion comprises a pair of laterally spaced first uprights, and wherein the back support comprises a pair of laterally spaced second uprights pivotally connected to the first uprights.

4. The body support assembly of claim 3 wherein the back support further comprises an upper member, wherein the upper member and second lower portion are joined to the second uprights and define a central opening, and further comprising a suspension member disposed across the central opening and secured to the back support.

5. The body support assembly of claim 1 wherein the second lower portion of the back support comprises a curved transition portion spaced above the first lower portion of the back frame and defining an open lateral pass through there between.

6. The body support assembly of claim 1 wherein the first lower portion of the back frame and the lower support structure comprise overlapping portions defining at least in part the rear link.

7. The body support assembly of claim 1 wherein the longitudinally extending portion and/or the front link define a first flex region, wherein the longitudinally extending portion defines a second flex region adjacent the rear link, wherein the seat support member and front link define a third flex region adjacent the front link, and wherein the seat support member defines a fourth flex region adjacent the rear link.

8. The body support assembly of claim 1 further comprising an armrest assembly comprising a base portion disposed above the longitudinally extending portion of the lower support structure and coupled to the base member, wherein the base portion of the armrest assembly comprises a pair of laterally extending arms disposed between and extending outwardly from the lower support structure and seat support member and a pair of upright portions connected to the laterally extending arms and extending upwardly along opposite sides of the seat support member.

9. The body support assembly of claim 8 wherein the armrest assembly is fixed relative to the base member, and wherein the seat support member is moveable from an upright, nominal position to a reclined position relative to the armrest assembly.

10. The body support member of claim 1 further comprising a booster spring disposed between the base and the rear link, the booster spring biasing the lower support structure from a reclined position to an upright, nominal position.

11. The body support member of claim 1 wherein the back support has an S-shaped profile when viewed from a left side thereof.

12. The body support member of claim 1 wherein the back support comprises a forwardly facing convex bow shape at a third location proximate a lumbar region of the back support and a rearwardly facing convex bow shape at a fourth location spaced below the third location.

13. The body support member of claim 12 wherein the lower portion of the back support comprises an arm extending forwardly from the rearwardly facing convex bow shape, wherein the arm is coupled to the rear link.

14. The body support member of claim 13 wherein an end of the arm comprises an upturned end, and where the seat support member comprises a boss structure disposed over the rear link and the upturned end to secure the arm to the rear link.

15. A backrest assembly comprising:

a base;

a rigid back frame comprising a first upright portion and a first lower portion extending forwardly from the first upright portion and coupled to the base, wherein the first lower portion is reclinable relative to the base about a first flex region; and a flexible back support comprising a second upright portion having a second flex region proximate a lumbar region of the back support, wherein the second upright portion is flexible about the second flex region, and a second lower portion extending forwardly from the second upright portion and coupled to the first lower portion, wherein the second lower portion is reclinable with the first lower portion relative to the base about the first flex region, and wherein the second lower portion has a third flex region located between the first and second flex regions, wherein the second lower portion is flexible about the third flex region, and wherein the second upright portion is pivotally coupled to the back frame at a third location spaced above the second flex location.

16. The backrest assembly of claim 15 wherein the second upright portion comprises a forwardly facing convex bow shape defining the second flex region.

17. The backrest assembly of claim 16 wherein the second lower portion comprises a rearwardly facing convex bow shaped portion.

18. The backrest assembly of claim 15 wherein the first and second lower portions are connected to a vertically extending link.

19. The backrest assembly of claim 15 wherein the first upright portion comprises a pair of laterally spaced first uprights, and wherein the second upright portion comprises a pair of laterally spaced second uprights pivotally connected to the first uprights.

20. The backrest assembly of claim 19 wherein the back support further comprises an upper member extending between and connected to the pair of second uprights, and wherein the lower portion extends between and is connected to the pair of second uprights, wherein the second uprights, the upper member and the second lower portion define a central opening, and further comprising a suspension member disposed across the central opening and secured to the back support.

21. A body support assembly comprising:

a base member;

a lower support structure comprising:

a longitudinally extending portion coupled to the base member at a first location, the longitudinally extending portion defining a first flex region positioned rearward of the first location;

a front link extending upwardly from the longitudinally extending portion forwardly of the first location, wherein at least one of the lower support member and/or the front link define a second flex region positioned forward of the first location; and a rear link extending upwardly from the longitudinally extending portion rearward of the first location;

a seat support member coupled to the front link and to the rear link, wherein the seat support member supports a seating surface, wherein at least one of the seat support member and/or the front link define a third flex region and wherein the seat support member defines a fourth flex region adjacent the rear link;

a rigid back frame extending upwardly and rearwardly from the lower support structure, wherein the rigid back frame is rigidly connected to the rear link; and a flexible back support having an upper portion pivotally connected to the rigid back frame at a second location vertically spaced above the seat support and a lower portion rigidly connected to the rear link, wherein the flexible back support has a fifth flex region located between the seat support and the second location and a sixth flex region located between the fifth flex region and the rear link.

22. The body support assembly of claim 21 wherein the upper portion of the back support comprises a pair of laterally spaced uprights and upper and lower members extending between and connected to the uprights, wherein the uprights and upper and lower members define a central opening therebetween, and further comprising a suspension member disposed across the central opening and secured to the upper and lower members and to the uprights.

23. The body support assembly of claim 21 wherein the first, second, third, fourth and fifth flex regions are defined by bendable portions of the lower support structure and the back support.

24. The body support assembly of claim 21 wherein the back frame comprises a pair of first uprights and the back support comprises a pair of second uprights, each of the second uprights positioned laterally outwardly from one of the first uprights, and further comprising a pair of connectors extending between one of the first uprights and one of the second uprights, wherein the connectors pivotally connect the first and second uprights.

* * * * *